US005862795A

United States Patent [19]

Osanai

[11] Patent Number: 5,862,795

[45] Date of Patent: Jan. 26, 1999

[54] EVAPORATIVE CONTROL SYSTEM FOR A MULTICYLINDER INTERNAL COMBUSTION ENGINE

[75] Inventor: Akinori Osanai, Susono, Japan

[73] Assignee: Toyota Jidosha Kabushiki Kaisha, Aichi, Japan

[21] Appl. No.: 913,841

[22] PCT Filed: Jan. 23, 1997

[86] PCT No.: PCT/JP97/00150

§ 371 Date: Sep. 22, 1997

§ 102(e) Date: Sep. 22, 1997

[87] PCT Pub. No.: WO97/27392

PCT Pub. Date: Jul. 31, 1997

[30] Foreign Application Priority Data

Jan. 23, 1996 [JP] Japan ..... 8-009165

[51] Int. Cl.[6] ..... F02M 33/04

[52] U.S. Cl. ..... 123/520

[58] Field of Search ..... 123/518, 519, 123/520, 436

[56] References Cited

U.S. PATENT DOCUMENTS

| | | | |
|---|---|---|---|
| 5,425,349 | 6/1995 | Nagaishi et al. | 123/520 |
| 5,694,904 | 12/1997 | Osanai | 123/520 |
| 5,699,778 | 12/1997 | Muraguchi et al. | 123/520 |
| 5,706,789 | 1/1998 | Yamada et al. | 123/520 |

FOREIGN PATENT DOCUMENTS

| | | |
|---|---|---|
| 4-1658 | 1/1992 | Japan . |
| 6-229330 | 8/1994 | Japan . |
| 6-241129 | 8/1994 | Japan . |

OTHER PUBLICATIONS

Copending U.S. Appln. Serial No. 08/548,887, filed Oct. 26, 1995.

Copending U.S. Appln. Serial No. 08/785,456, filed Jan. 17, 1997.

Copending U.S. Appln. Serial No. 08/785,446, filed Jan. 17, 1997.

*Primary Examiner*—Thomas N. Moulis
*Attorney, Agent, or Firm*—Kenyon & Kenyon

[57] ABSTRACT

It is an object of the invention to control the fluctuation in an air-fuel ratio in a multicylinder internal combustion engine when the driving period of a purge control valve is substantially synchronized with an engine cycle, thereby better purifying exhaust gas and preventing lean misfires. The evaporative control system for the engine comprises a canister 37 for storing evaporated fuel from a fuel tank 15, a purge passage 39 for connecting the canister 37 to an intake passage of the engine 1, and a purge control valve 41 disposed in the purge passage 39, to control the quantity of gas to be purged from the canister 37 into the intake passage, a drive condition detecting means A for detecting driving conditions of the engine 1, a delay time setting means B for setting a delay time to delay the valve opening start timing in the driving period in response to the engine driving conditions, and a purge control valve driving means C for driving the purge control valve 41 with a delay time set by the delay time setting means B, a delay time correcting means D for correcting a delay time in response to a duty factor or etc, and a delay control interruption means E for interrupting the delay time setting to be performed when the purged gas substantially continuously flows.

17 Claims, 37 Drawing Sheets

EVAPORATIVE CONTROL SYSTEM FOR A MULTICYLINDER INTERNAL COMBUSTION ENGINE

TECHNICAL FIELD

The present invention relates to an evaporative control system for a multicylinder internal combustion engine and, more particularly, to one that purges fuel vapor, to equally distribute the fuel vapor into cylinders, whereby a fluctuation of the air-fuel ratio of the engine is controlled and the exhaust gas is better purified.

BACKGROUND ART

An evaporative control system for a multicylinder internal combustion engine, in general, has a purge passage that connects a canister for temporarily storing evaporated fuel from a fuel tank and an intake air passage of an internal combustion engine (hereinafter simply referred to as an engine) and a purge control valve disposed in the intake air passage. The purge control valve is activated depending on the engine operating condition, and is opened and closed at a given frequency in response to a pulse signal having a given duty factor. If a period of the pulse signal is substantially synchronized with an engine cycle, fuel purged from the canister will be drawn into a specific cylinder of the engine to make an air-fuel ratio in the cylinder rich and an air-fuel ratio in any other cylinder that draws no purged fuel lean, thereby fluctuating an air-fuel ratio in the engine as a whole and causing misfires in the lean cylinders. To solve this problem, a technique to change the driving frequency of the purge control valve to another driving frequency when the driving frequency is substantially synchronized with an engine cycle is disclosed (Refer to Japanese Patent Publication No. 6-241129).

However, the technique disclosed in Japanese Patent Publication No. 6-241129 suddenly changes the driving frequency of the purge control valve at a boundary where it is substantially synchronized with an engine cycle. This results in fluctuating an air-fuel ratio in the engine, and the exhaust emission is deteriorated. To converge the fluctuating air-fuel ratio to a target air-fuel ratio, the disclosure corrects a fuel injection quantity. It takes time, however, until the fluctuation is stabilized at the target air-fuel ratio.

DISCLOSURE OF INVENTION

Therefore, it is an object of the present invention to solve the above problems and provide an evaporative control system for a multicylinder internal combustion engine, capable of keeping an air-fuel ratio stabilized even if the driving period of a purge control valve is substantially synchronized with an engine cycle, thereby maintaining exhaust purifying performance and preventing lean misfires.

FIG. 1 is a drawing showing a basic constitution of the present invention. The evaporative control system for a multicylinder internal combustion engine according to the present invention which solves the above problems, comprises a canister 37 for temporarily storing evaporated fuel from a fuel tank 15, a purge passage 39 for connecting the canister 37 to an intake passage of the engine 1, and a purge control valve 41 disposed in the purge passage 39, to control the quantity of gas to be purged from the canister 37 into the intake passage by opening and closing the valve at a given frequency. The evaporative control system is characterized in that it comprises a drive condition detecting means A for detecting driving conditions (for example the revolution speed) of the engine 1, a delay time setting means B for setting a delay time to delay the valve opening start timing in the driving period from the start of the driving period in response to the engine driving conditions detected by the drive condition detecting means A, and a purge control valve driving means C for driving the purge control valve 41 with a delay time set by the delay time setting means B.

In the evaporative control system for a multicylinder internal combustion engine according to the present invention, the drive condition detecting means A comprises an equal distribution judging means that detects on-off periods of the intake valve of the engine 1 and judges whether or not the purged gas is equally distributed into cylinders of the engine 1 on the basis of the detected on-off period of the intake valve and the driving period of the purge control valve 41, and the delay time setting means B sets a delay time so as to equally distribute the purged gas into cylinders when the equal distribution judging means judges that the purged gas is unequally distributed into cylinders.

In the evaporative control system for a multicylinder internal combustion engine according to the present invention, the drive condition detecting means A comprises a revolution speed detecting means for detecting a revolution speed of the engine 1, and the delay time setting means B sets a delay time in response to the revolution speed detected by the revolution speed detecting means.

The evaporative control system for a multicylinder internal combustion engine according to the present invention operates in such a way that the drive condition detecting means A detects the engine operating conditions, for example, the means A detects an engine speed region where the engine speed is substantially synchronized with the purge control valve driving period, the delay time setting means B sets a delay time to delay the valve opening timing of the purge control valve from the start of the driving period in such a manner that the purge gas may not be drawn into a specific cylinder for each driving period under the engine operating condition detected by the drive condition detecting means A, and the purge control valve driving means C drives the purge control valve in accordance with the delay time set by the delay time setting means B. Thus, the purged gas is equally distributed into cylinders and a fluctuation in the air-fuel ratio is stabilized.

In the evaporative control system for a multicylinder internal combustion engine according to the present invention, the system further comprises a delay time correcting means D for correcting a delay time set by the delay time setting means B, and the delay time correcting means D corrects the delay time in response to, for example, a duty factor that determines a valve opening interval in the driving period of the purge control valve 41.

The delay time correcting means D corrects the delay time in accordance with duty factors, namely, the means D does not correct the delay time when the duty factor is small when the purged gas flows intermittently (i.e., when the amount of the purged gas is small), thereby avoiding unnecessary control. On the other hand, the means D corrects the delay time to ensure the valve opening time to compensate for the amount of the purged gas when the duty factor is large (i.e., when there is a less intermittent flow).

In the evaporative control system for a multicylinder internal combustion engine according to the present invention, the system further comprises a delay time correcting means D for correcting a delay time set by the delay time setting means B, and the delay time correcting means D corrects the delay time in response to, for example, a valve opening end timing in the driving period of the purge control valve 41.

The delay time means correcting means D corrects the delay time in accordance with a valve opening end timing in the driving period of the purge control valve 41, for example, the means D corrects the delay time so that the purge control valve may surely complete the closing within a driving period. Thus, the purge control valve can surely be opened and closed in the driving period, and the required amount of the purged gas can be properly supplied into the intake passage.

In the evaporative control system for a multicylinder internal combustion engine according to the present invention, the system further comprises a delay time correcting means D for correcting a delay time set by the delay time setting means B, and the delay time correcting means D comprises a traveling speed detecting means for detecting a traveling speed of the purged gas in the intake passage of the engine 1, and corrects the delay time in response to the detected traveling speed.

The delay time is corrected in response to the traveling speed of the purged gas in the intake passage so that the purge is controlled by taking into consideration the traveling speed of the purged gas in the intake passage at the engine transient time. Namely, the delay time is set longer at the acceleration time as the purge gas flow rate in the intake passage becomes high, and is set shorter at the deceleration time as the purge gas flow rate in the intake passage becomes low. In this way, the traveling speed of the purged gas in the intake passage is taken into consideration, and the purged gas can be equally distributed into cylinders.

In the evaporative control system for a multicylinder internal combustion engine according to the present invention, the system further comprises a delay time correcting means D for correcting a delay time set by the delay time setting means B, and the delay time correcting means D comprises a period changing means, for example, being provided with a plurality of driving periods of the purge control valve 41 and changes driving periods in a given order by sequentially selecting from the plurality of driving periods, and corrects the delay time in response to the driving period changed by the period changing means.

The period changing means changes driving periods in a given order by sequentially selecting from the plurality of driving periods, the delay time correcting means D corrects the delay time in accordance with the each driving period, thus the change in flow rate of the purged gas is controlled, the continuous purge gas flow into a specific cylinder can be avoided, the purge gas is equally distributed into cylinders, and the fluctuation in the air-fuel ratio is stabilized.

In the evaporative control system for a multicylinder internal combustion engine according to the present invention, the system further comprises a delay time correcting means D for correcting a delay time set by the delay time setting means B, and the delay time correcting means A, for example, corrects the delay time on the basis of the central timing between the start and the end timings of the valve opening interval in the driving period of the purge control valve 41.

The delay time setting means B sets the delay time on the basis of the central timing between the start and the end timings of the valve opening interval in the driving period of the purge control valve 41, thus the purge gas purged just after the opening of the purge control valve 41 can be drawn into a cylinder which usually is to close an intake valve of the cylinder just before the purged gas reaches to the cylinder, particularly during the transient time, such as acceleration time and deceleration time when the duty factor suddenly changes. As a result, the equal distribution of the purge gas into cylinders is promoted, and the fluctuation in the air-fuel ratio is stabilized.

In the evaporative control system for a multicylinder internal combustion engine according to the present invention, the drive condition detecting means A comprises a cylinder detecting means for detecting a cylinder in the intake stroke when the purge control valve 41 is opened in the current driving period, and the delay time setting means B sets the delay time in such a way that a cylinder to be in the intake stroke when the purge control valve 41 is opened in the next driving period will be different from the cylinder detected by the cylinder detecting means.

The delay time setting means 5 sets the delay time in such a way that a cylinder to be in the intake stroke when the purge control valve 41 is opened in the next driving period will be different from the cylinder detected by the cylinder detecting means, thus the purge gas is equally distributed into cylinders, and the fluctuation in the air-fuel ratio is stabilized.

In the evaporative control system for a multicylinder internal combustion engine according to the present invention, the system further comprises a delay time correcting means D for correcting a delay time set by the delay time setting means B, and the delay time correcting means D comprises a load estimating means for estimating a load of the engine in the next driving period during the current driving period of the purge control valve, and corrects the delay time on the basis of the load in the next driving period estimated by the load estimating means.

The delay time setting means B sets the delay time on the basis of the load or increase or decrease of the load in the next driving period estimated by the load estimating means, thus the delay time is properly set in accordance with the engine load (or the change in the load) particularly at the transient time such an acceleration time and an deceleration time when the duty factor suddenly changes, thus the purge control considering a response to the purged gas (the traveling time of the purged gas in the intake passage) can be carried out. As a result, the equal distribution of the purged gas into cylinders is ensured, and the fluctuation in the air-fuel ratio is stabilized.

In the evaporative control system for a multicylinder internal combustion engine according to the present invention, the system further comprises a delay time correcting means D for correcting a delay time set by the delay time setting means B, and the delay time correcting means D comprises an engine revolution speed estimating means for estimating a revolution speed of the engine in the next driving period during the current driving period of the purge control valve 41, and corrects the delay time on the basis of the revolution speed in the next driving period estimated by the engine revolution speed estimating means.

The delay time setting means B sets the delay time on the basis of the revolution speed (change in the revolution speed) or the estimated increase and decrease of the revolution speed in the next driving period estimated by the engine revolution speed estimating means, thus the delay time is properly set in accordance with the engine revolution speed (or the change in the engine revolution speed) particularly at the transient time, thus the purge control considering a response to the purged gas (the traveling time of the purged gas in the intake passage) can be carried out. As a result, the equal distribution of the purged gas into cylinders is ensured, and the fluctuation in the air-fuel ratio is stabilized.

In the evaporative control system for a multicylinder internal combustion engine according to the present invention, the drive condition detecting means A comprises a crank angle detecting means for detecting a crank angle at each valve opening start timing in each driving period of the purge control valve 41, and the delay time setting means B sets the delay time in such a way that a valve opening start timing in the next driving period will be at a second crank angle which is different from a first crank angle in the current driving period detected by the crank angle detecting means. The second crank angle is preferably in an opposite revolutional phase to the first crank angle, that is, 360° CA shifted from the first crank angle. The second crank angle can be in 120° CA or 180° CA or the like shifted from the first crank angle depending On the requirements.

In the evaporative control system for a multicylinder internal combustion engine according to the present invention, the drive condition detecting means A comprises a valve timing angle detecting means for detecting a valve timing angle of the intake valve at each valve opening start timing in each driving period of the purge control valve 41, and the delay time setting means B sets the delay time in such a way that a valve opening start timing in the next driving period will be at a second valve timing angle which is different from a first valve timing angle detected by the valve timing angle detecting means. The second valve timing angle is preferably in an opposite phase to the first valve timing angler that is, 360° vvt shifted from the first valve timing angle, wherein a unit of valve timing angle, namely, vvt, corresponds to a unit of valve timing angle, namely, ° CA. The second valve timing angle can be 120° vvt or 180° vvt or the like shifted from the first valve timing angle depending on the requirements.

In the evaporative control system for a multicylinder internal combustion engine according to the present invention, the drive condition detecting means A comprises an intake air frequency calculation means for calculating an intake air frequency of the engine in the current driving period from the fuel injection frequency in the current driving period of the purge control valve 41, and for calculating the difference between the calculated intake air frequency and a best intake air frequency, and the delay time setting means B sets the delay time in such a way that the next cylinder in an intake stroke that is to draw gas to be purged at the valve opening start timing in the next driving period will be different from a cylinder currently in an intake stroke, that has drawn the gas purged at the valve opening start timing in the current driving period on the basis of the calculated intake air frequency calculated by the intake air frequency calculation means and the best intake air frequency. The best intake air frequency means a frequency of the intake air that allows the next intake air cylinder that is to draw gas to be purged during the valve opening interval in the next driving period to be in an opposite revolutional phase (360° CA shifted phase when calculated in terms of the crank angle) to that of the current intake air cylinder having drawn the gas purged during the valve opening interval in the current driving period. The above opposite revolutional phase can be 120° CA or 180° CA or the like shifted from the crank angle of the current intake air cylinder depending on the requirements.

In the evaporative control system for a multicylinder internal combustion engine according to the present invention, the drive condition detecting means A comprises an intake air frequency calculation means for calculating an intake air frequency of the engine in the current driving period from the ignition frequency in the current driving period of the purge control valve 41, and for calculating the difference between the calculated intake air frequency and a best intake air frequency, and the delay time setting means B sets the delay time in such a way that the next cylinder in an intake stroke that is to draw gas to be purged at the valve opening start timing in the next driving period will be different from a cylinder currently in an intake stroke, that has drawn the gas purged at the valve opening start timing in the current driving period on the basis of the calculated intake air frequency calculated by the intake air frequency calculation means and the best intake air frequency.

In the evaporative control system for a multicylinder internal combustion engine according to the present invention, the drive condition detecting means A comprises an intake air frequency calculation means for calculating an intake air frequency of the engine in the current driving period from an air pressure pulse signal in the intake passage of the engine, and for calculating the difference between the calculated intake air frequency and a best intake air frequency, and the delay time setting means B sets the delay time in such a way that the next cylinder in an intake stroke that is to draw gas to be purged at the valve opening start timing in the next driving period will be different from a cylinder currently in an intake stroke, that has drawn the gas purged at the valve opening start timing in the current driving period on the basis of the calculated intake air frequency calculated by the intake air frequency calculation means and the best intake air frequency.

In the evaporative control system for a multicylinder internal combustion engine according to the present invention, the system further comprises a delay control interruption means E for interrupting the delay time setting to be performed by the delay time setting means B under the conditions that fluctuation in an air-fuel ratio in the engine does not occur even though the purged gas is supplied into the engine.

The delay control interruption means E interrupts the setting of the delay time by the delay time setting means B under the conditions where the air-fuel ratio does not fluctuate due to the purged gas, for example, when the duty factor is more than 80% in which the purged gas flow is hardly interrupted, in other words, when the purged gas almost continually flows, thereby avoiding unnecessary processes by the CPU and the load on the CPU is decreased,

BEST MODE FOR CARRYING OUT THE INVENTION

The preferred embodiments of the present invention will be described below with reference to the accompanying drawings.

Figure 2:
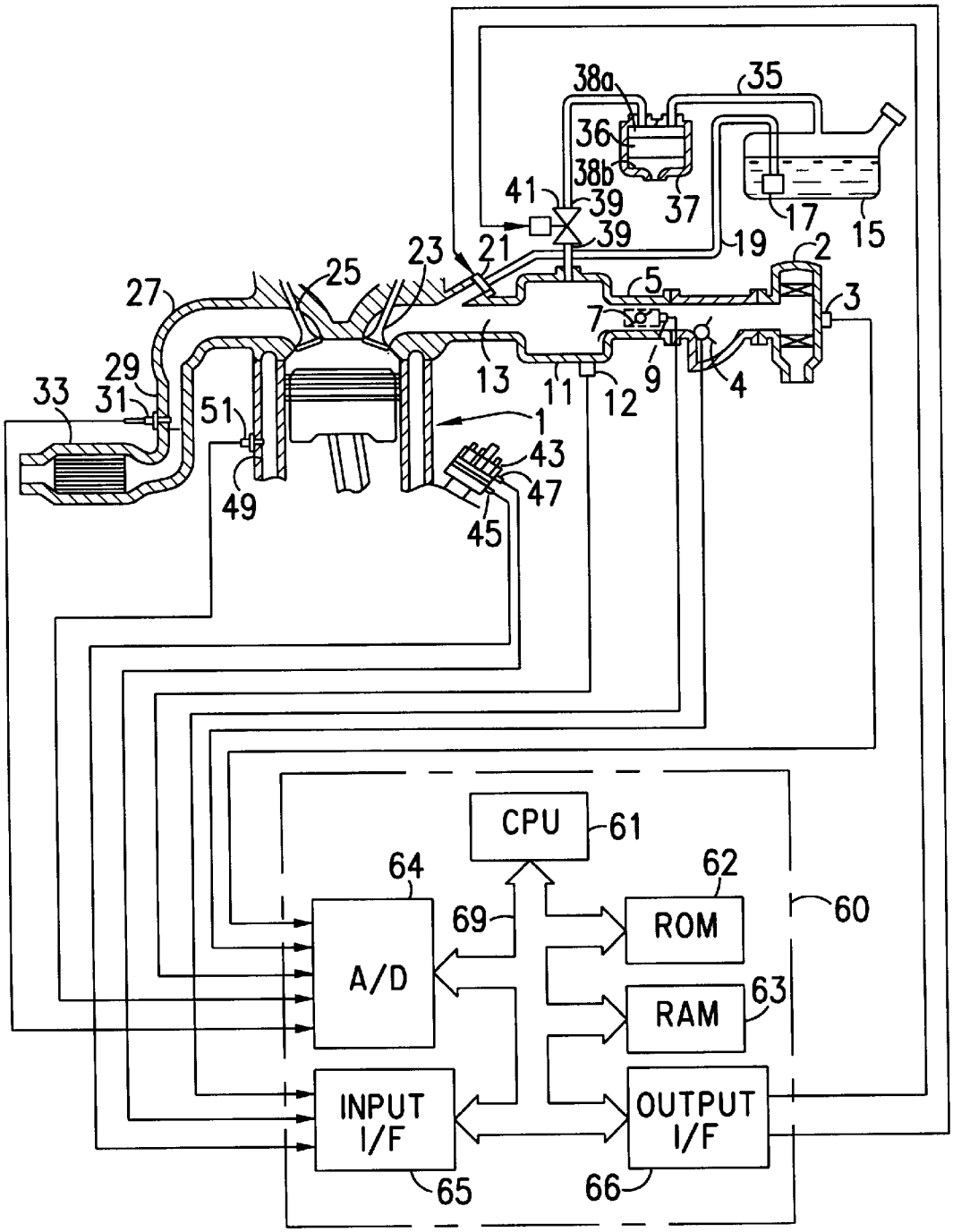
FIG. 2 is a general constitutional view showing an evaporative control system for a multicylinder internal combustion engine according to an embodiment of the present invention.

FIG. 2 is a drawing showing an evaporative control system for a multicylinder, for example, a four cylinder internal combustion engine according to an embodiment of the present invention. The engine 1 receives air used for combustion from an air cleaner 2 through a throttle body 5, a surge tank 11, and an intake duct 13 for each cylinder. The throttle body 5 has a throttle valve 7 for adjusting the quantity of intake air, which is measured by an airflow meter 4. A throttle opening sensor 9 detects the opening of the throttle valve 7. An intake air temperature sensor 3 detects the temperature of intake air. A vacuum sensor 12 detects the pressure in the intake duct 13.

A fuel tank 15 supplies fuel which is pumped by a fuel pump 17 and is passed through a fuel pipe 19 and is injected by a fuel injector 21 into the intake duct 13. A mixture of air and fuel in the intake duct 13 is drawn into a cylinder through a suction valve 23. In the cylinder, the mixture is compressed by a piston, is ignited by an igniter and a spark plug and is burnt to produce torque.

An ignition distributor 43 has a reference position sensor 45 and a crank angle sensor 47. The sensor 45 generates a pulse signal representing a reference position at every crank angle of 720 degrees. The sensor 47 generates a pulse signal representing a position at every crank angle of 30 degrees. A cooling water path 49 guides water for cooling the engine 1, and a water temperature sensor 51 detects the temperature of the cooling water.

The exhaust gas after combustion is discharged into an exhaust manifold 27 through an exhaust valve 25 and then into an exhaust pipe 29. The exhaust pipe 29 has an air-fuel ratio sensor 31 for detecting the oxygen concentration in the exhaust gas. A catalytic converter 33 is arranged in the exhaust pipe 29 downstream from the sensor 31. The catalytic converter 33 accommodates a three-way catalyst for oxidizing unburned HC and CO and reducing nitrogen oxides contained in exhaust gas. The exhaust gas cleaned by the catalytic converter 33 is discharged into the atmosphere.

A canister 37 contains activated carbon 36 as adsorbent. On each side of the activated carbon 36, the canister 37 has an evaporated fuel chamber 38*a* and an atmospheric chamber 38*b*. The chamber 38*a* is connected to the fuel tank 15 through a vapor collecting pipe 35 and to the surge tank 11 downstream from the throttle valve 7 through a purge pipe 39. The purge pipe 39 has a purge control valve 41, referred to as a D-VSV, for controlling the quantity of purged fuel. The evaporated fuel in the fuel tank 15 is guided into the canister 37 through the pipe 35 and is adsorbed by the activated carbon 36. When the purge control valve 41 is opened, a negative pressure in the intake duct 13 draws air from the atmospheric chamber 38*b* through the activated carbon 36 and purge pipe 39. When the air passes through the activated carbon 36, the fuel adsorbed in the activated carbon 36 is removed therefrom. As a result, the air containing the removed fuel is purged into the surge tank 11 through the purge pipe 39 and is combusted in each cylinder together with fuel injected from the fuel injector 21. In addition to the fuel from the activated carbon 36, evaporated fuel in the fuel tank 15 is directly guided to the purge pipe 39.

The engine 1 has an electronic control unit (ECU) 60. The control unit 60 is a microcomputer for carrying out fuel injection control, ignition timing control, etc., according to the operating conditions of the engine 1 detected from an engine revolution speed and signals from sensors. For example, the control unit 60 determines an optimum ignition timing and sends an ignition signal to the igniter. The control unit 60 has a ROM 62 for storing a program. According to the program, a CPU 61 receives signals from the sensors through an A/D converter 64 and an input interface 65, processes the signals, and provides control signals to actuators through an output interface 66. A RAM 63 temporarily stores data. These elements in the control unit 60 are connected to one another through a system bus 69 including an address bus, a data bus, and a control bus. Control operations carried out by the control unit 60 will be explained.

Figure 3:
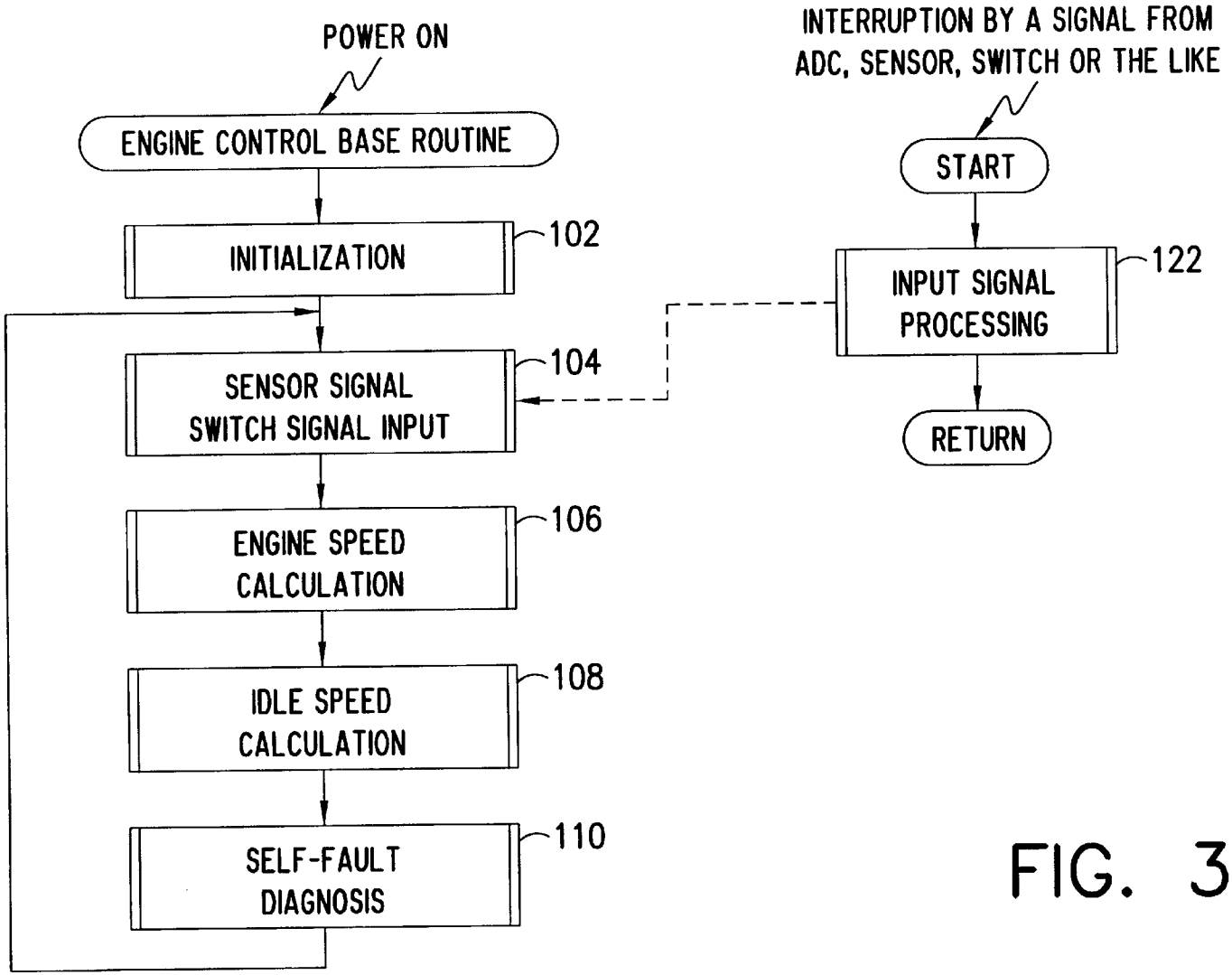
FIG. 3 is a flowchart explaining a basic control process for an internal combustion engine according to an embodiment of the present invention.
Figure 4:
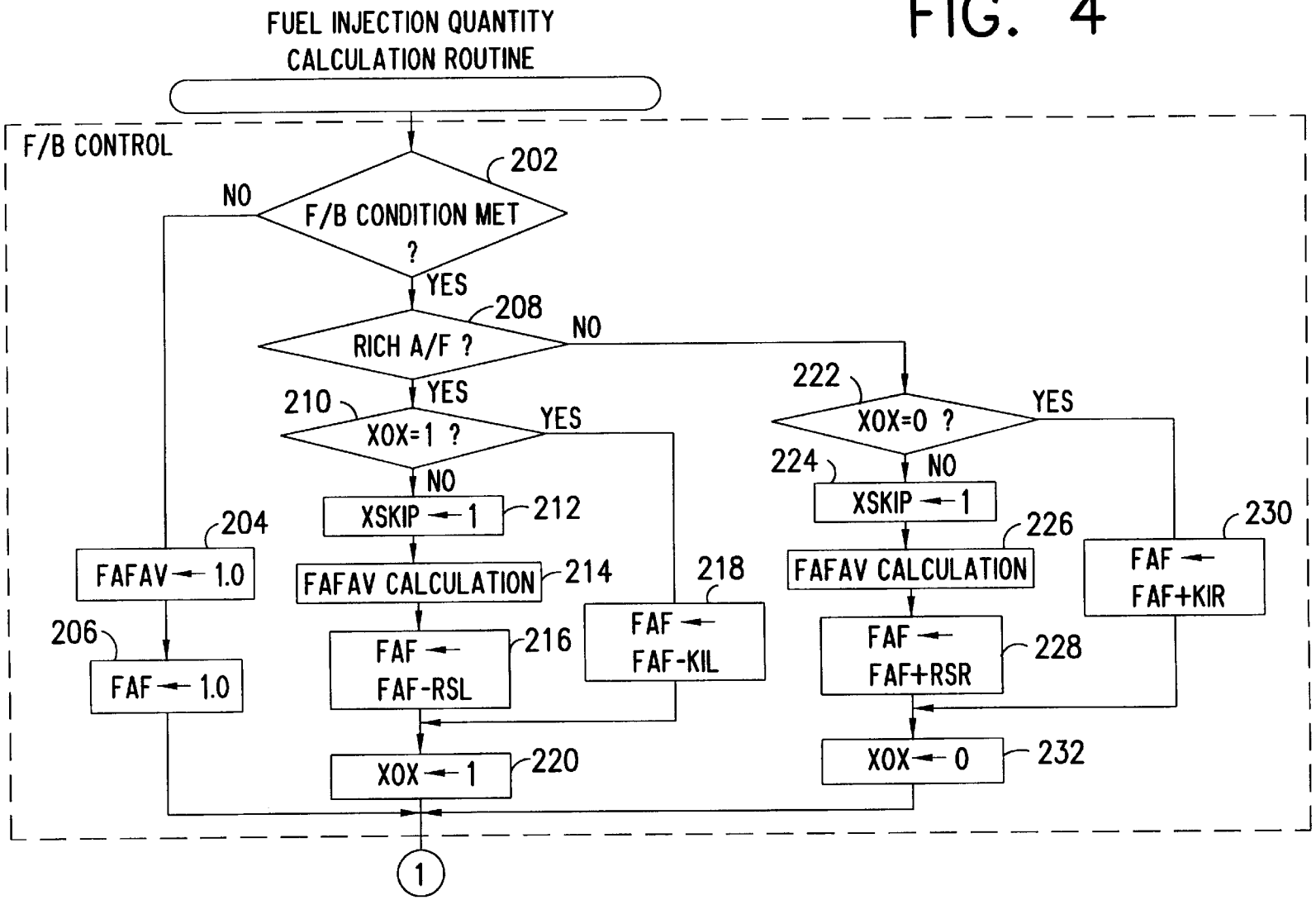
FIG. 4 is a flowchart showing an air-fuel ratio feedback control routine according to an embodiment of the present invention.

FIG. 3 is a flowchart showing a basic control routine according to the present invention for controlling the engine 1 of FIG. 2. The control unit 60 performs the basic routine in a loop. During the basic routine, interrupts are carried out regularly or irregularly in response to any input signal or an engine revolution speed. When turned on, the control unit 60 carries out initialization in step 102, receives signals from the sensors and switches in step 104, calculates an engine revolution speed in step 106, calculates an idling speed in step 108, and carries out self-diagnosis in step 110. These steps are repeated regularly. Step 122 carries out an interrupt when a signal is received from the A/D converter 64, from some sensor, or from some switch. The calculated fuel injection timing and the ignition timing are supplied to corresponding actuators in synchronization with a signal from the crank angle sensor 47. Other processes are carried out at regular intervals as timer interrupt routines.

The airflow meter 4 provides the quantity of intake air, and the crank angle sensor 47 provides an engine revolution speed. These data are used to calculate the quantity of injecting fuel, i.e., an injection time of the fuel injector 21, so that the fuel injector 21 injects the calculated fuel at a given crank angle. The fuel injection time is corrected according to signals from the throttle opening sensor 9, water temperature sensor 51, intake temperature sensor 3, etc. The fuel injection time is also subjected to an air-fuel ratio feedback correction based on a signal from the air-fuel ratio sensor 31, an air-fuel ratio learning correction for bringing a central value of the air-fuel ratio feedback correction to a theoretical air-fuel ratio, and a correction based on the quantity of fuel purged from the canister 37. The present invention relates to controlling the fuel purged from the canister 37 and correcting the quantity of injecting fuel accordingly. A fuel injection calculation routine and a purge control routine according to the present invention will be explained. These routines are carried out as timer interrupts.

FIGS. 4 to 7 are flowcharts showing the fuel injection calculation routine according to the present invention. The routine is carried out as a tinner interrupt at regular intervals of, for example, 1 msec and is composed of air-fuel ratio feedback control of FIG. 4, air-fuel ratio learning control of FIG. 5, vapor concentration learning control of FIG. 6, and fuel injection time (TAU) calculation control of FIG. 7. The air-fuel ratio feedback control will be explained with reference to FIG. 4.

Step 202 checks to see if all of the following air-fuel ratio feedback control conditions are met:

(1) engine has started (2) fuel being supplied (3) cooling water temperature $\geqq 40°$ C.

(4) air-fuel ratio sensor is active

If all conditions are met, step 208 checks to see if the air-fuel ratio is rich, i.e., if the output voltage of the air-fuel ratio sensor 31 is lower than a reference voltage, for example, 0.45 V.

If the air-fuel ratio is rich, step 210 checks a rich flag XOX to see if it is 1 and determines whether or not a preceding air-fuel ratio was rich. If XOX≠1, step 212 sets a skip flag XSKIP to 1. Step 214 calculates an average FAFAV between preceding and present air-fuel ratio feedback correction coefficients (FAFs). Step 216 subtracts a skip quantity RSL from the correction coefficient FAF. If XOX=1 in step 210, step 218 subtracts an integral quantity NIL from the correction coefficient FAF. Step 220 sets the flag XOX to 1 to complete the air-fuel ratio feedback control. Thereafter, the air-fuel ratio learning control (step 302) is carried out.

If the air-fuel ratio is lean in step 208, step 222 checks to see if XOX=0 and determines whether or not a preceding air-fuel ratio is lean. If XOX≠0, step 224 sets the skip flag XSKIP to 1. Step 226 calculates an average FAFAV between preceding and present air-fuel ratio feedback correction coefficients (FAFs). Step 228 adds a skip quantity RSR to the correction coefficient FAF. If XOX=0 in step 222, step 230 adds an integral quantity KIR to the Correction coefficient FAF. Step 232 resets the flag XOX to 0 to complete the feedback control routine. Thereafter, the air-fuel ratio learning control (step 302) is carried out.

If the feedback conditions are not met in step 202, steps 204 and 206 set FAFAV and FAF each to a reference value of 1.0 to complete the feedback control routine. Thereafter, the air-fuel ratio learning control (step 302) is carried out.

The air-fuel ratio learning control of FIG. 5 will be explained. Step 302 finds a learning area j (j=1 to 7) according to a pressure in the intake duct 13 detected by the vacuum sensor 12. There are learning areas 1 to 7 depending on pressures in the intake duct 13. The learning area found is set as tj (j=1 to 7). Step 304 checks tj to see if it is equal to a preceding learning area j. If tj≠j, step 306 sets tj to j, and step 310 clears a skip number CSKIP to complete the air-fuel ratio learning control. Thereafter, the vapor concentration learning control (step 402) is carried out.

If tj=j in step 304, step 308 checks to see if all of the following conditions for air-fuel ratio learning control are met;

(1) air-fuel ratio feedback control being carried out (2) no fuel increase after starting engine or during warming-up (3) cooling water temperature ≧80° C.

If any one of the conditions is not met, step 310 clears the skip number CSKIP to complete the air-fuel ratio learning control. Thereafter, the vapor concentration learning control (step 402) is carried out.

If all of the conditions are met in step 308, step 312 checks the skip flag XSKIP to see if it is 1, i.e., whether or not it is just after skipping. If XSKIP≠1, the air-fuel ratio learning control is terminated, and the vapor concentration learning control (step 402) is carried out. If XSKIP=1, step 314 clears the skip flag XSKIP to 0, and step 316 increments the skip number CSKIP by one. Step 318 checks to see if CSKIP≧KCSKIP, where KCSKIP is a reference number and is, for example, 3. If CSKIP<KCSKIP, the air-fuel ratio learning control ends, and the vapor concentration learning control (step 402) is carried out, If CSKIP≧KCSKIP in step 318, step 320 determines whether or not a purge ratio PGR is 0. The purge ratio PGR is the ratio of the quantity of purged fuel to the quantity of intake air and is calculated in the purge control routine to be explained later. If PGR≠0, i.e., if fuel is being purged, the air-fuel ratio learning control ends, and the vapor concentration learning control (step 410) is carried out. If PGR=0, i.e., if no fuel is being purged, the averaged correction coefficient FAFAV set in one of steps 204, 214, and 226 of the feedback control routine is checked to see if it is greater than a reference value, for example, 1.02. According to a deviation of the averaged correction coefficient FAFAV, a learning value KGj (j=1 to 7) for the learning area j is determined. If FAFAV≧1.02 in step 322, step 324 adds a value x to the learning value KGj. If FAFAV<1.02 in step 322 and if FAFAV≧0.98 in step 326, step 32B subtracts the value x from the learning value KGj. In any other case, step 330 sets an air-fuel ratio learning completion flag XKGj for the learning area j to 1. After the air-fuel ratio learning control, the vapor concentration learning control (step 402) is carried out. The vapor concentration learning control of FIG. 6 will be explained. Step 402 checks to see if the engine is starting. Namely, step 402 checks to see if an engine revolution speed after an ignition key has been turned on is a cranking speed. If the engine has been started already, the vapor concentration learning control ends, and the fuel injection time (TAU) calculation control (step 452) is carried out. If the engine is starting, step 404 sets a vapor concentration FGPG to a reference value of 1.0 and clears a counter CFGPG for counting the number of times of updating a vapor concentration to 0. Step 406 initializes a preceding duty factor DPGO, a preceding purge ratio PGRO, etc., to zero.

Figure 5:
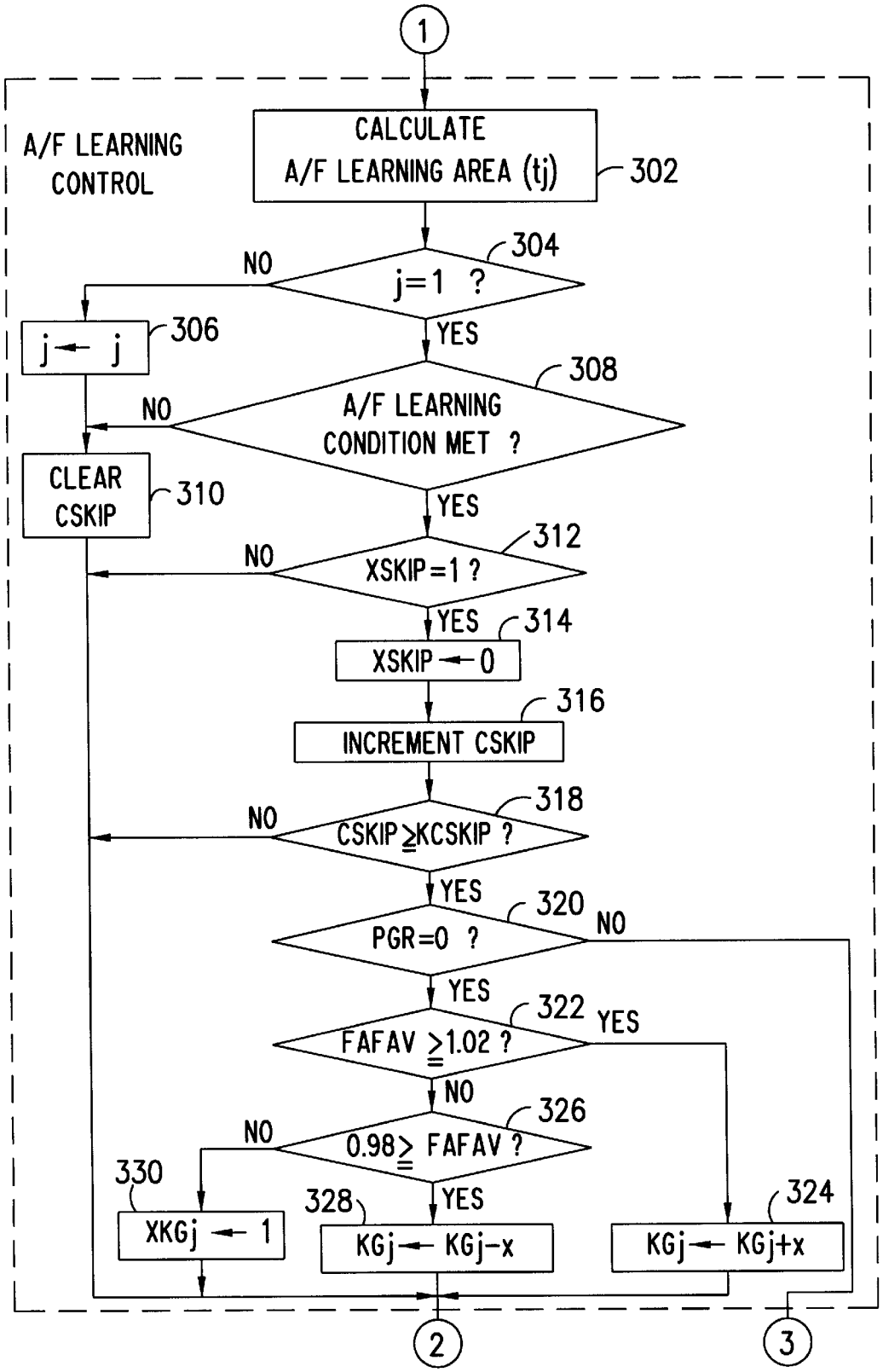
FIG. 5 is a flowchart showing an air-fuel ratio learning control routine according to an embodiment of the present invention.
Figure 6:
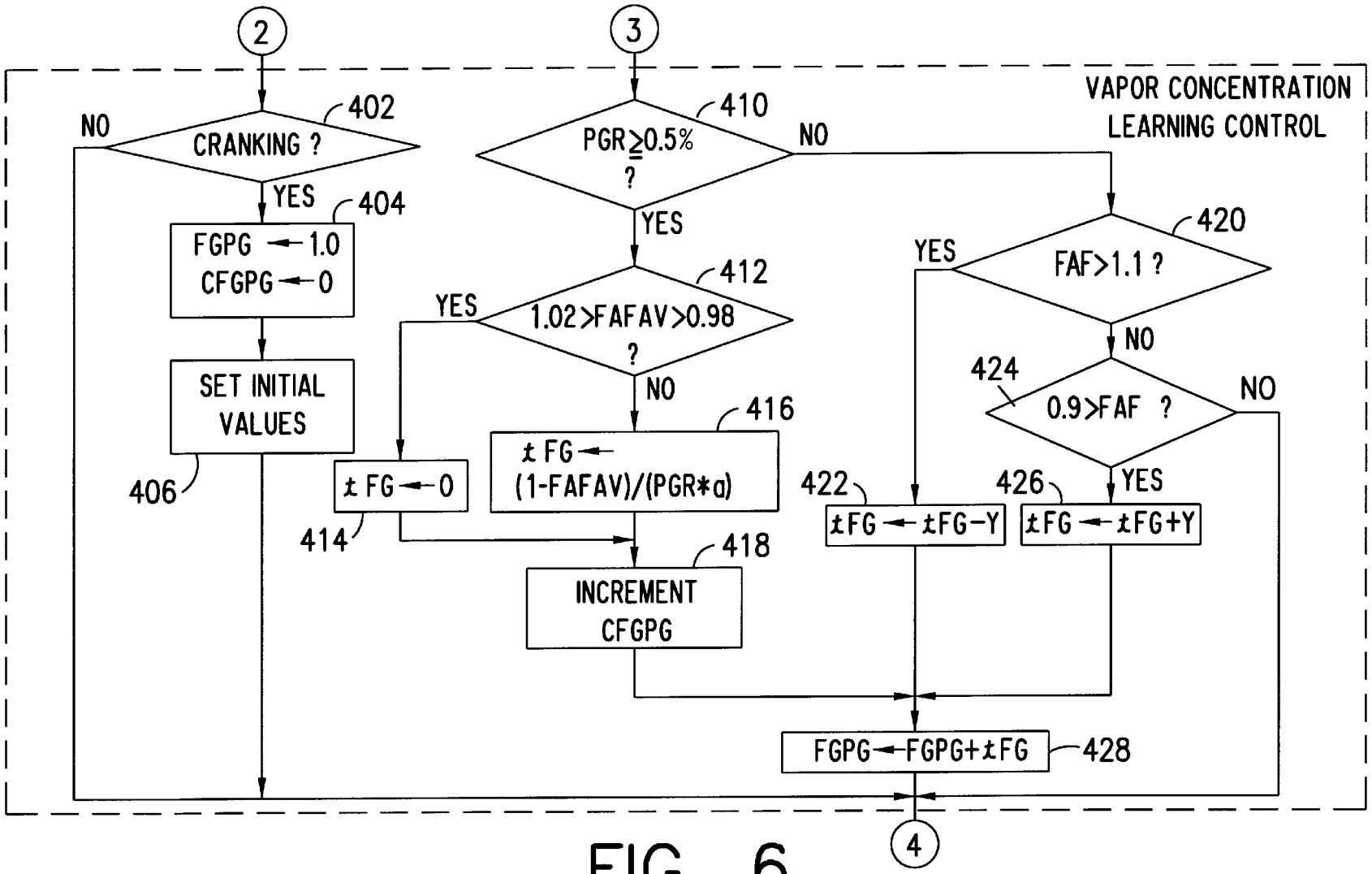
FIG. 6 is a flowchart showing a vapor concentration learning control routine according to an embodiment of the present invention.

If PGR≠0 in step 320 of the air-fuel ratio learning control of FIG. 5, step 410 determines if the purge ratio PGR is larger than, for example, 0.5%. If PGR≧0.5%, step 412 checks to see if the averaged correction coefficient FAFAV is within a range of ±2% around a reference value of 1.0. If 1.02>FAFAV>0.98, step 414 sets a vapor concentration updating value tFG per purge ratio to 0, and if not, step 416 calculates tFG as follows:

$$tFC-(1-FAFAV)/(PGR*a)$$

where "a" is a given value, for example, 2.

Step 418 increments the counter CFGPG by one, and step 428 is carried out.

If PGR<0.5% in step 410, it is determined that the vapor concentration updating accuracy is bad. Accordingly, step 420 checks to see if a deviation of the air-fuel ratio feedback correction coefficient FAF is ±10% or larger with respect to a reference value of 1.0. If FAF≦1.1 in step 420, step 422 subtracts a given value Y from the vapor concentration updating value tFG. If FAF≦1.1 in step 420 and if FAF<0.9 in step 424, step 426 adds the value Y to the vapor concentration updating value tFG. Step 428 corrects the vapor concentration FGPG by adding the vapor concentration updating value tFG thereto, to complete the vapor concentration learning control. Then, the fuel injection time (TAU) calculation control (step 452) is carried out.

Figure 7:
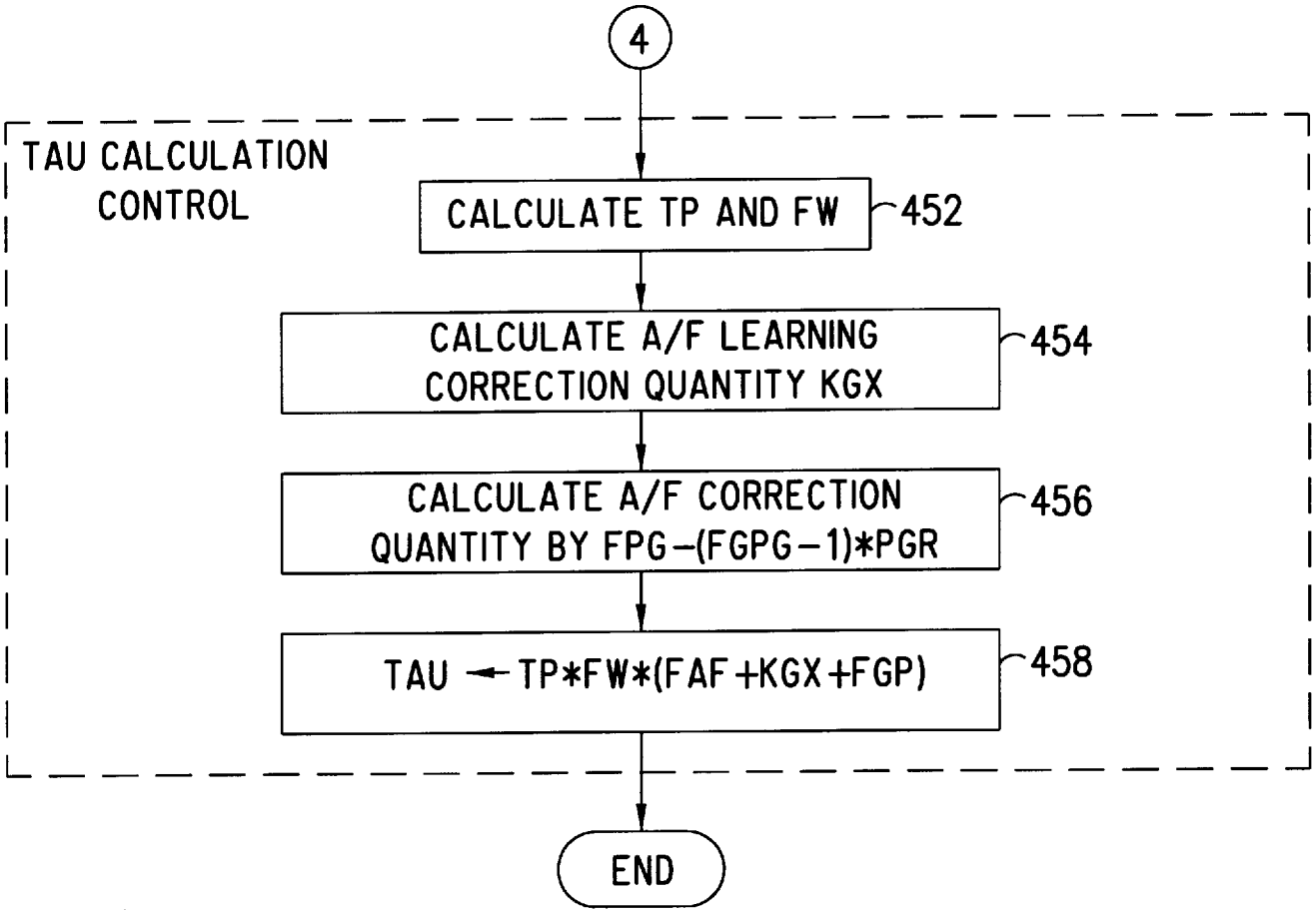
FIG. 7 is a flowchart showing a fuel injection time calculation routine according to an embodiment of the present invention.

The fuel injection time (TAU) calculation control of FIG. 7 will be explained. Step 452 refers to a map in the ROM 62 and finds a reference fuel injection time TP according to an engine revolution speed and an engine load (the quantity of intake air per engine revolution). At the same time, step 452 calculates a reference correction coefficient FW according to signals from the throttle opening sensor 9, water temperature sensor 51, and intake temperature sensor 3. The engine load may be estimated according to a pressure in the intake duct 13 and the engine revolution speed. Step 454 calculates an air-fuel ratio learning correction quantity KGX for a present pressure in the intake duct 13 according to the air-fuel ratio learning value KGj of an adjacent learning area by interpolation.

Step 456 calculates a purge-based air-fuel ratio correction quantity FPG according to the vapor concentration FGPG and purge ratio PGR as follows:

$$FPG-(FGPG-1)*PGR$$

Step 458 calculates a fuel injection time TAU as follows $$TAU-TP*FW*(FAF+KGX+FPG)$$

This completes the fuel injection quantity calculation routine. The fuel injector 21 of each cylinder is opened for the fuel injection time TAU at a crank angle calculated according to fuel injection timing provided by another routine.

FIGS. 8A, 8B, 9 and 10 are flowcharts showing the purge control routine according to the present invention. The purge control routine is a timer interrupt carried out at regular intervals of, for example, 1 msec. This routine determines the duty factor (the ON period) of a pulse signal that controls the opening of the purge control valve (hereinafter referred to D-VSV) 41. The routine consists of a purge ratio (PGR) calculation routine (FIGS. 8A and 8B), a delay time setting control routine for performing the delay time setting means B of the present invention (FIG. 9), and a VSV controlling routine for performing the purge control valve driving means C of the present invention (FIG. 10), each of which is carried out at intervals of 1 msec.

Figure 8A:
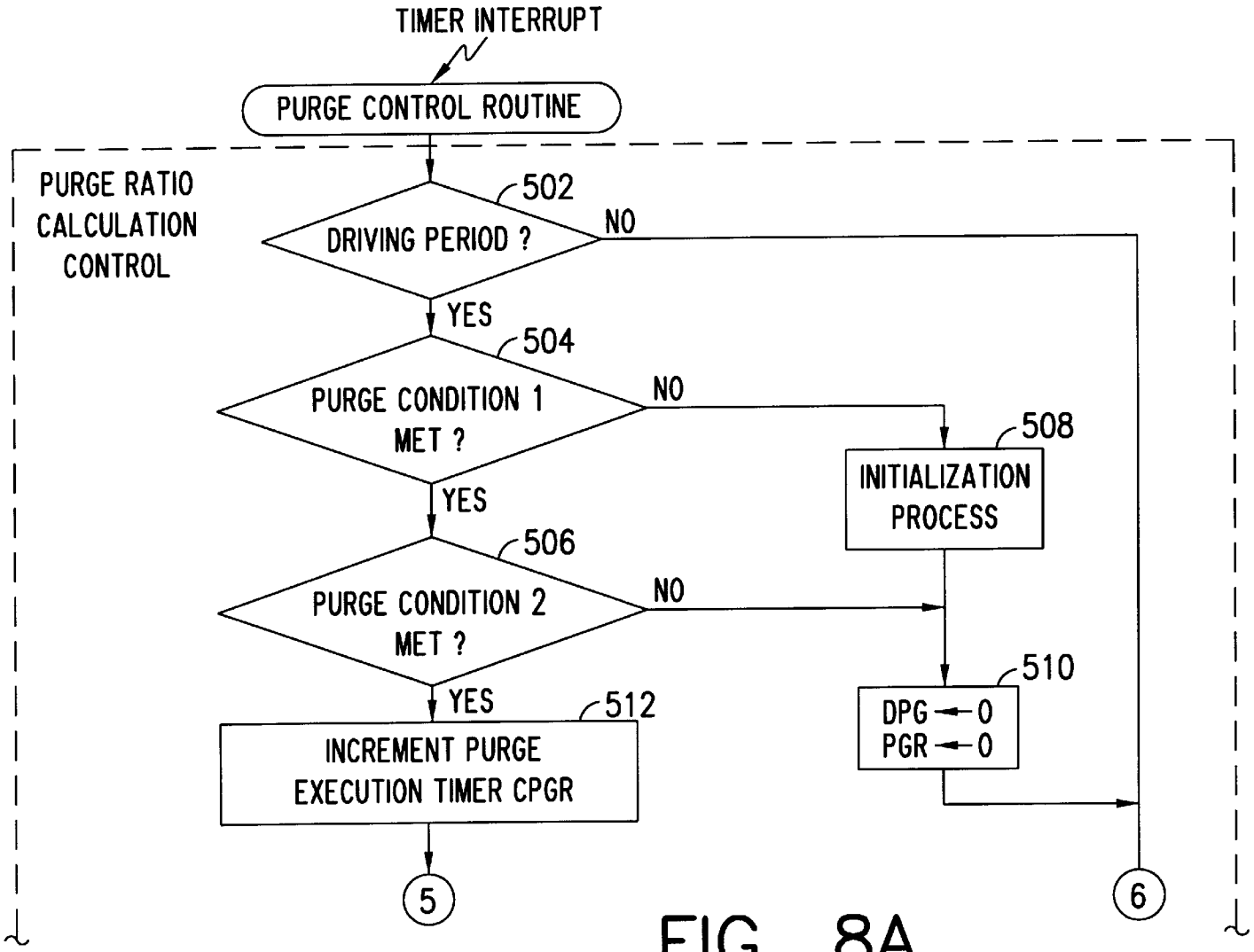
FIGS. 8A and 8B are a flowchart showing a purge ratio calculation routine according to an embodiment of the present invention.
Figure 8B:
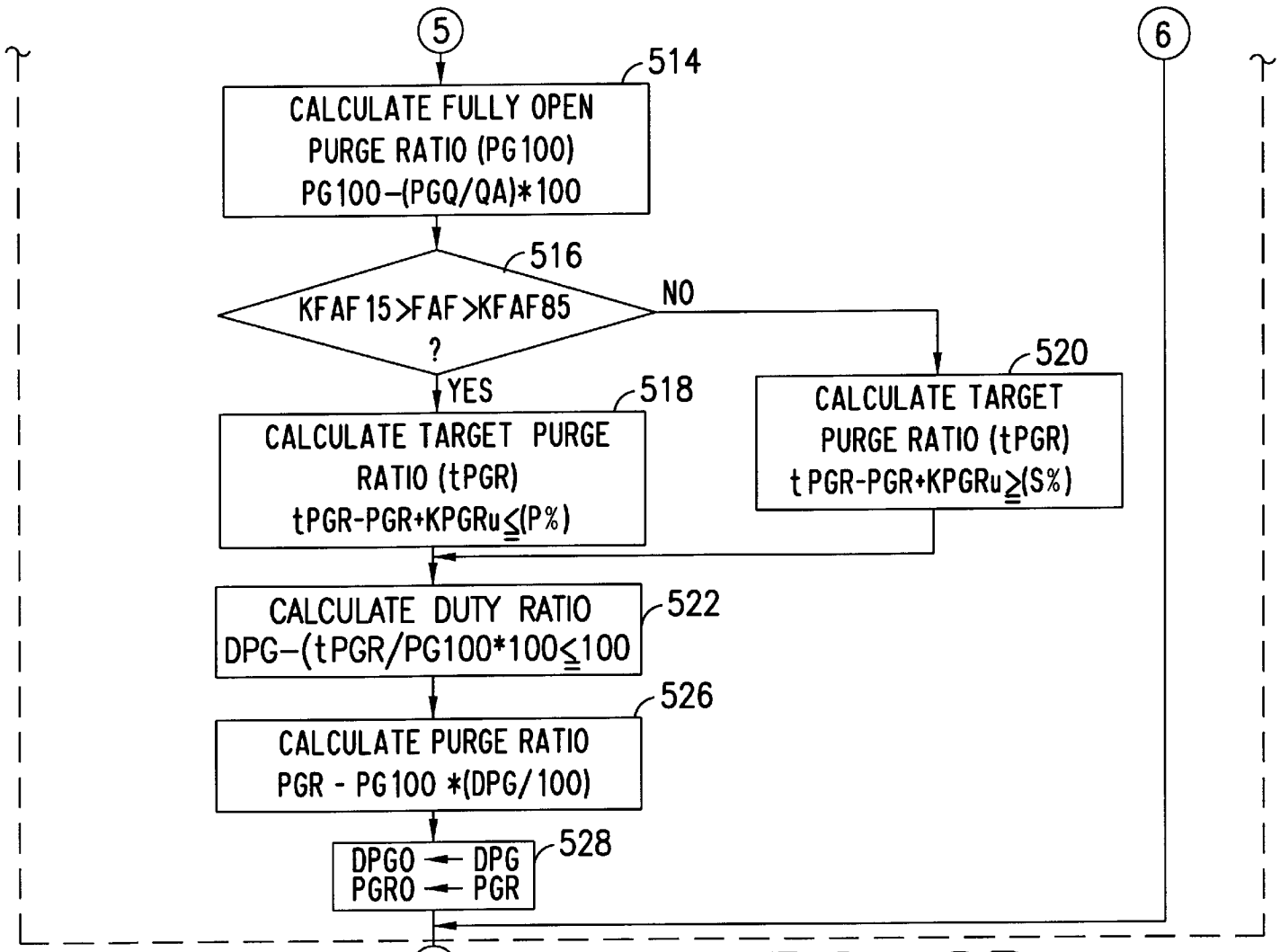

The purge ratio calculation routine of FIGS. 8A and 8B will be explained. Step 502 determines whether or not it is time to output the pulse signal for driving the purge control valve 41. Namely, step 502 determines whether or not it is a valve driving period of, for example, 100 msec when the driving frequency of the purge control valve 41 is 10 Hz. If it is so, step 504 determines whether or not a purge condition 1 is met, i.e., whether or not the air-fuel ratio learning conditions are met. If the purge condition 1 is met, step 506 determines whether or not a purge condition 2 is met, i.e., whether or not fuel is being supplied and the air-fuel ratio learning completion flag XKGj is 1 for the learning area j in question.

Figure 11:
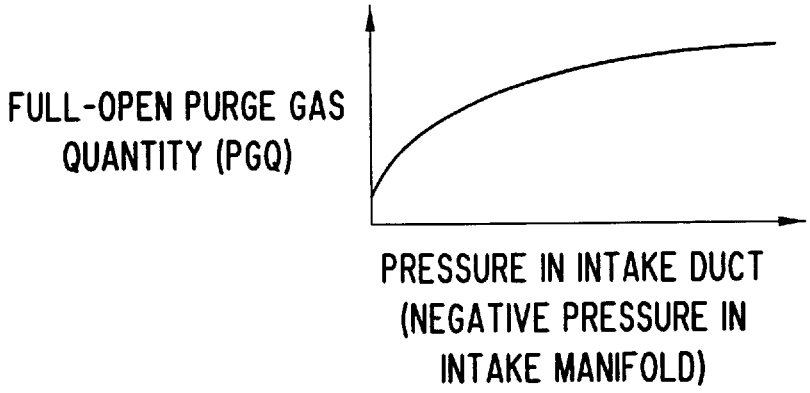
FIG. 11 is a characteristic diagram showing a relationship between an intake duct pressure and a purged fuel quantity with a purge control valve being fully opened.

If the purge condition 2 is met, step 512 increments a purge timer CPGR. Step 514 refers to a map of FIG. 11 stored in the ROM 62 according to a pressure in the intake duct 13, finds a purge fuel quantity PGQ with the purge control valve 41 being fully opened, and calculates a purge ratio PG100 with the purge control valve 41 being fully opened according to the ratio of the purged fuel quantity PGQ to an intake air quantity QA. Step 516 determines whether or not the air-fuel ratio feedback correction coefficient FAF is within a given range, i.e., if KFAF15>FAF>KFAF85.

Figure 12:
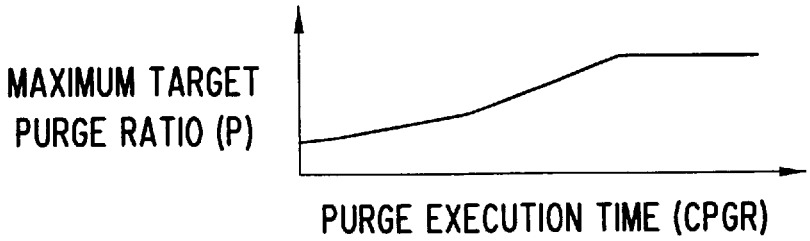
FIG. 12 is a characteristic diagram showing a relationship between a purge time and a maximum target purge ratio.

If KFAF15>FAF>KFAF85 in step 516, step 518 increases a target purge ratio tPGR by a given quantity KPGRu and limits the target purge ratio tPFGR equal to or below a maximum target purge ratio P% that is determined according toga map of FIG. 12 and the purge timer CPGR. If FAF≦KFAF15 or FAF≦KFAF85 in step 516, step 520 decreases the target purge ratio tPGR by a given quantity KPGRd and limits the target purge ratio tPGR to equal to or above a minimum target purge ratio 5%, which is, for example, 0% or 0.5%. This prevents an air-fuel ratio from fluctuating due to purged fuel.

Step 522 calculates a duty factor DPG as follows:

$$DPG-(tPGR/PG100)*100$$

Step 526 calculates an actual purge ratio PGR as follows:

$$PGR-PG100*(DPG/100)$$

Step 528 updates a preceding duty factor DPGO and a preceding purge ratio PGRO according to the DPG and PGR. Then, the delay time setting control routine of FIG. 9 (step 610) is carried out.

Figure 9:
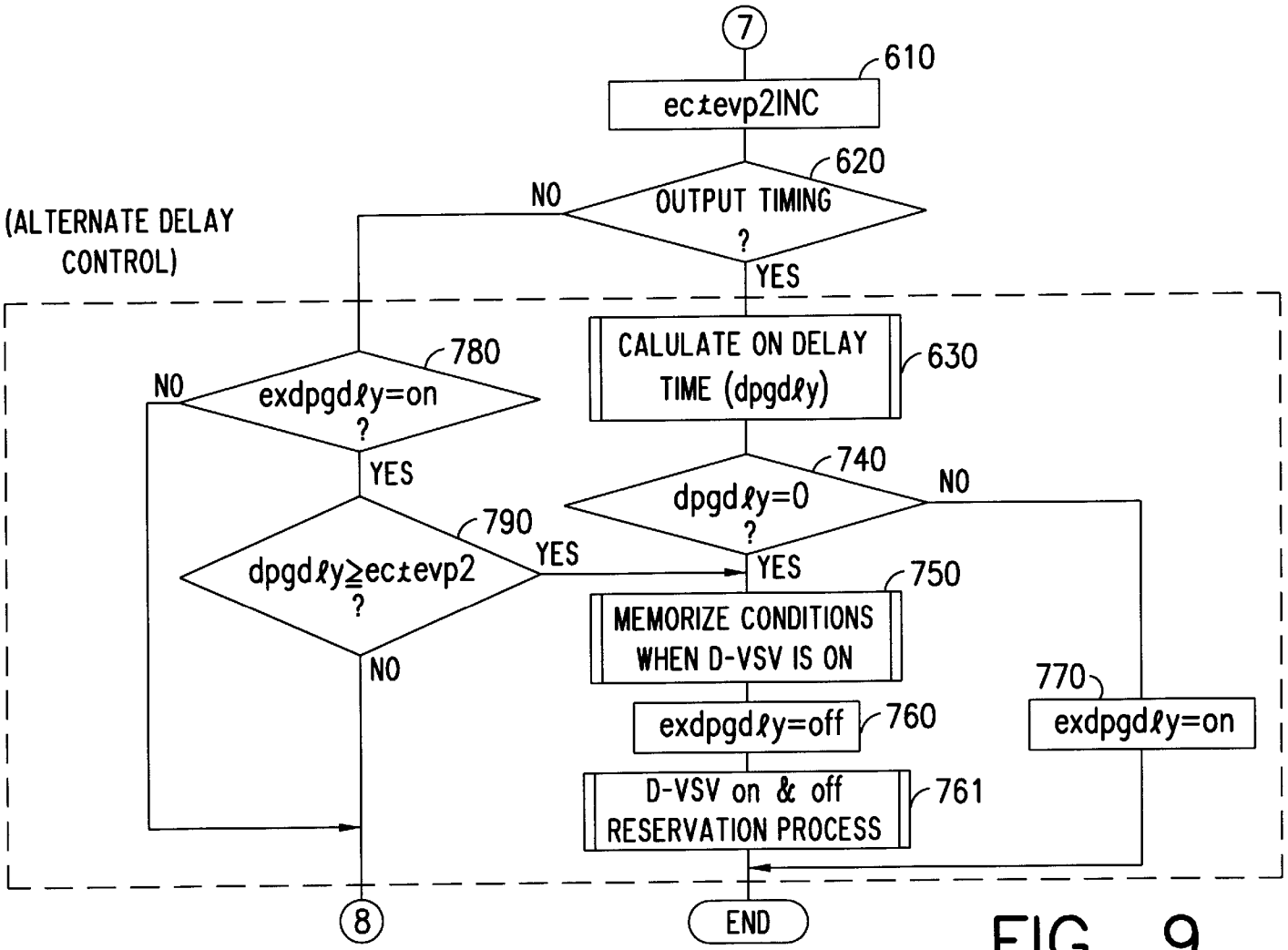
FIG. 9 is a flowchart showing a driving period changing routine according to an embodiment of the present invention.

On the other hand, if it is judged that it is not the time to output the pulse signal for driving the purge control valve 41 in step 502, the process proceeds to step 610 shown in FIG. 9, for carrying out the delay time setting control. If the purge condition 1 is not met in step 504, related RAM data such as the preceding duty factor DPGO and preceding purge ratio PGRO are initialized to 0 (step 508). After step 508 is executed or if the purge condition 2 is not met in step 506, zeroing the duty factor DPG and purge ratio PGR is executed (step 510), and step 610 shown in FIG. 9, for carrying out the delay time setting control, is executed. Next, processes of the delay time setting control (FIG. 9) for carrying out the delay time setting means B of the present invention will be explained.

FIG. 9 is a flowchart showing processes for the delay time setting control according to the present invention. First, in step 610, a current driving period counter ectevp2 is incremented. Namely, ectevp2 is counted up by one. Then, in step 620, whether it is a timing for driving the D-VSV or not is determined, if the result is YES, the process proceeds to step 630, if the result is NO, the process proceeds to step 780. In step 630, a delay time (on-delay time) dpgdly for delaying the valve opening start timing of the D-VSV from the start timing in the valve opening interval of the D-VSV. In step 740, whether or not the delay time dpgdly is 0 is checked, if dpgdly=0, the process proceeds to step 750. In step 750, the D-VSV driving process for setting the opening timing of D-VSV is executed. If dpgdly≠0 in step 740, the process proceeds to step 770, a flag exdpgdly is set to 1 (on) in step 770, in which the flag exdpgdly indicates that the delay control is on the process, namely, the delay time setting is on the process, and ends the routine.

Next, in step 760, the delay control flag exdpgdly is reset to 0 (off), then an engine revolution speed NE, a crank angle CCRNK and a valve opening time t-dpg in a driving period of a D-VSV corresponding to a duty factor (hereinafter referred to a D-VSV opening time) when the D-VSV is on, are read in step 761. On the other hand, if it is determined that it is not a timing for driving the D-VSV in step 620, whether the delay control flag exdpgdly is 1 (on) or 0 (off) is checked in step 780, namely, whether or not the delay control is on the process is determined, and if the result is YES, the process proceeds to step 790, if the result is NO, the process proceeds to step 755 shown in FIG. 10. In step 790, whether or not the current driving period counter ectevp2 has been reached to the delay time dpgdly is determined, if the result is YES, the process proceeds to step 750, and the D-VSV driving process for setting the opening timing of D-VSV is executed. If the result is NO in step 790, the process proceeds to step 755 shown in FIG. 10. Next, the D-VSV on-off process executed by step 750 in FIG. 9 will be explained.

Figure 10:
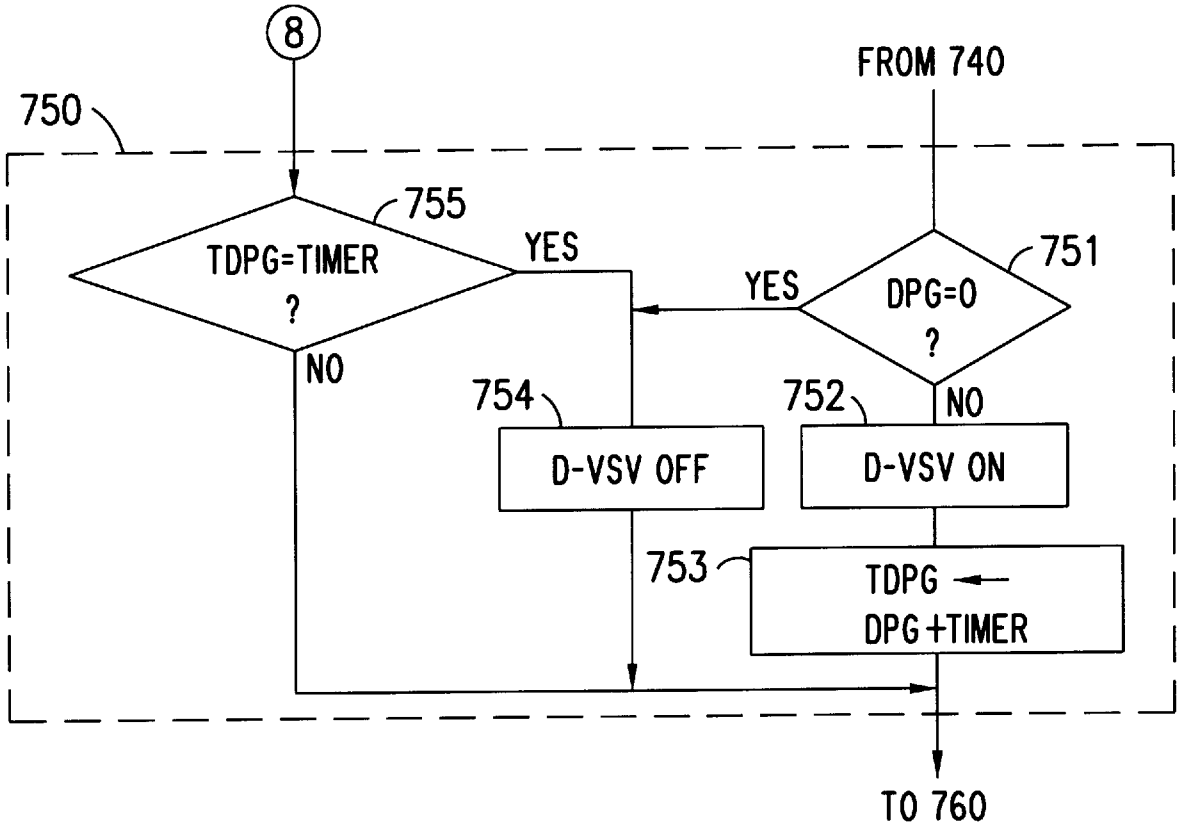
FIG. 10 is a flowchart showing a D-VSV valve controlling routine according to an embodiment of the present invention.

FIG. 10 is a flowchart showing detailed processes of step 950 shown in FIG. 9, which shows processes of the D-VSV control according to an embodiment of the present invention. First, if dpgdly=0 in step 740 for the purge rate control shown in FIG. 9, or when the current driving period counter ectevp 2 reached to the delay time dpgdly, step 751 determines whether or not the duty ratio DPG calculated in step 522 shown in FIG. 8B is 0. If the result is YES, namely, the purge control is not on, the process proceeds to step 754, if the result is NO, namely, purge control is on, the process proceeds to step 752 and turn on the D-VSV (in step 752). Next, step 753 calculates a valve OFF time TDPG as follows, and the process proceeds to step 760 shown in FIG. 9.

$$TDPG-DPG+\mathrm{TIMER}$$

where TIMER is incremented whenever the purge control routine is carried out.

On the other hand, if the result in step 620 shown in FIG. 9 of the purge rate control is NO, namely, if it is judged that it is not a time to switch the driving period and step 780 determines NO, or step 790 determines NO after step 780 determined YES, step 755 shown in FIG. 10 executes a process to close the D-VSV, That is, whether or not the current TIMER value agrees with the valve OFF tin TDPG of the D-VSV is checked, if the result is NO, the process proceeds to step 760 shown in FIG. 9, if the result is YES, the process proceeds to step 754, If the result in step 751 is YES, the process also proceeds to step 754. Step 754 turns off the D-VSV and proceeds to step 760 shown in FIG. 9. This completes the purge control routine. Here, the differences between the purge control according to the embodiment of the present invention explained above and that of the prior art will be explained below referring to FIG. 13 and FIG. 14.

Figure 13:
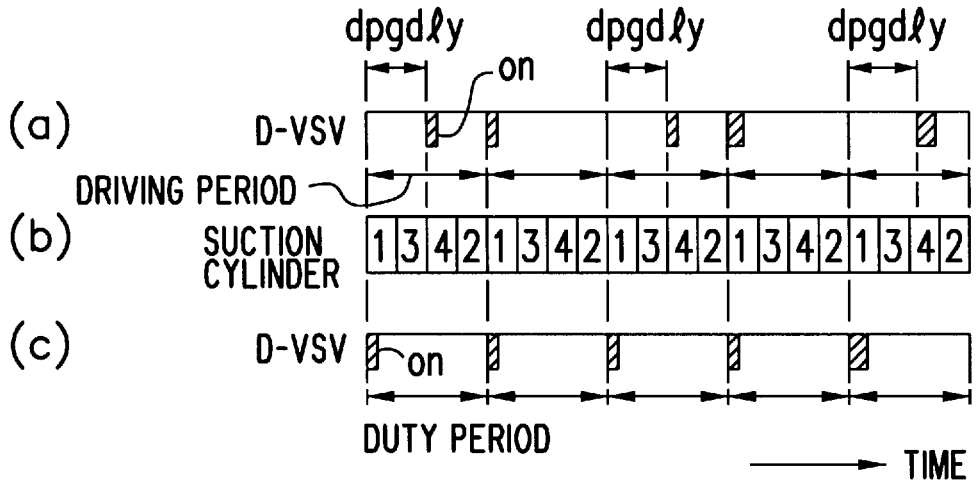
FIG. 13 is an explanatory view showing a driving timing of a D-VSV, the upper part (a) shows the driving timing of the D-VSV according to an embodiment of the present inventions the middle part (b) shows the cylinder number in an intake stroke, and the lower part (c) shows the driving timing of the D-VSV according to the prior art.

FIG. 13 is an explanatory view showing a driving timing of D-VSV under a determined engine condition, the upper part (a) shows the driving timing according to an embodiment of the present invention, the middle part (b) shows the cylinder number in an intake stroke, and the lower part (c) shows the driving timing according to the prior art. As can be seen from the lower part in FIG. 13(*c*), it is understood that No. 1 cylinder in the intake stroke is synchronized with the drive timing of the D-VSV. In this case, the purge gas is mainly drawn into No. 1 cylinder, and the air-fuel ratio in No. 1 cylinder becomes rich, while the air-fuel ratio in No. 4 cylinder becomes lean, which means the purge gas is not equally distributed into each of cylinders. On the other hand, as can be seen from the upper part in FIG. 13(*a*), according to the embodiment of the present invention, the purge gas is not only drawn into No. 1 cylinder but is also drawn into No. 4 cylinder because the drive start timing of the D-VSV (on timing of the D-VSV) is delayed with the delay time dpgdly from the start timing (zero point) of the driving period every other driving period. Thus, the purge gas equally distributed into cylinders, thereby allowing the fluctuation in the air-fuel ratio in the engine to be stabilized. Next, the fluctuation in the air-fuel ratio will be explained.

Figure 14:
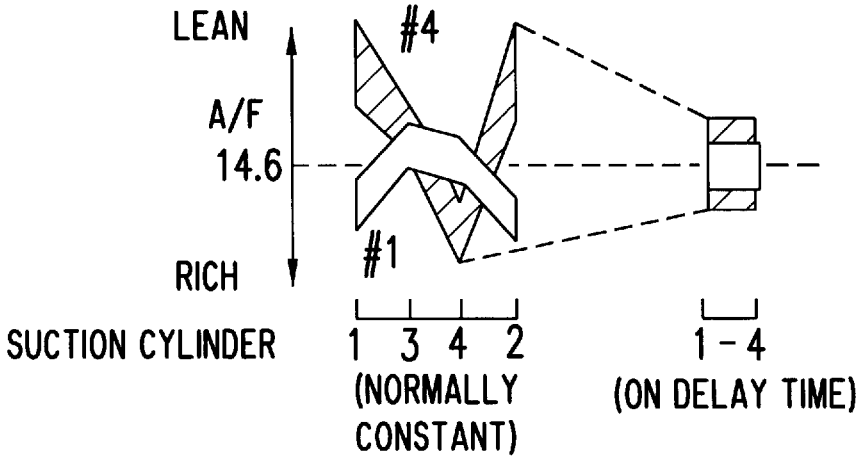
FIG. 14 compares fluctuations in an air-fuel ratio caused by purged fuel between the present invention and the prior art.

FIG. 14 compares fluctuations in an air-fuel ratio caused by purged fuel between the present invention and the prior art. An ordinate represents an air-fuel ratio. On an abscissa, suction cylinders 1, 3, 4, and 2 on the left side are of the prior art and their suction timing is synchronized with the open timing of the purge control valve 41. Suction cylinders 1 to 4 on the right side are of the present invention and their suction timing is not synchronized the open timing of the purge control valve 41. According to the prior art, the cylinder 4 is lean and the cylinder 1 is rich when the suction timing of the cylinder 1 is synchronized with the open timing of the purge control valve 41, and when the suction timing of the cylinder 2 agrees with the same, the cylinder 4 is lean and the cylinder 1 is rich. When the suction timing of the cylinder 3 of the prior art agrees with the open timing of the purge control valve 41, the cylinders 1 and 4 are near the stoichiometric (theoretical) air-fuel ratio of 14.6. When the cylinder 4 of the prior art is a suction cylinder, the cylinder 1 is near the theoretical air-fuel ratio of 14.6 but the cylinder 4 is rich. On the other hand, the present invention keeps the cylinder 1 near the stoichiometric air-fuel ratio of 14.6 and the cylinder 4 near the same because the suction timing of the suction cylinders 1 to 4 alternately agrees with the open timing of the purge control valve 41.

Figure 15:
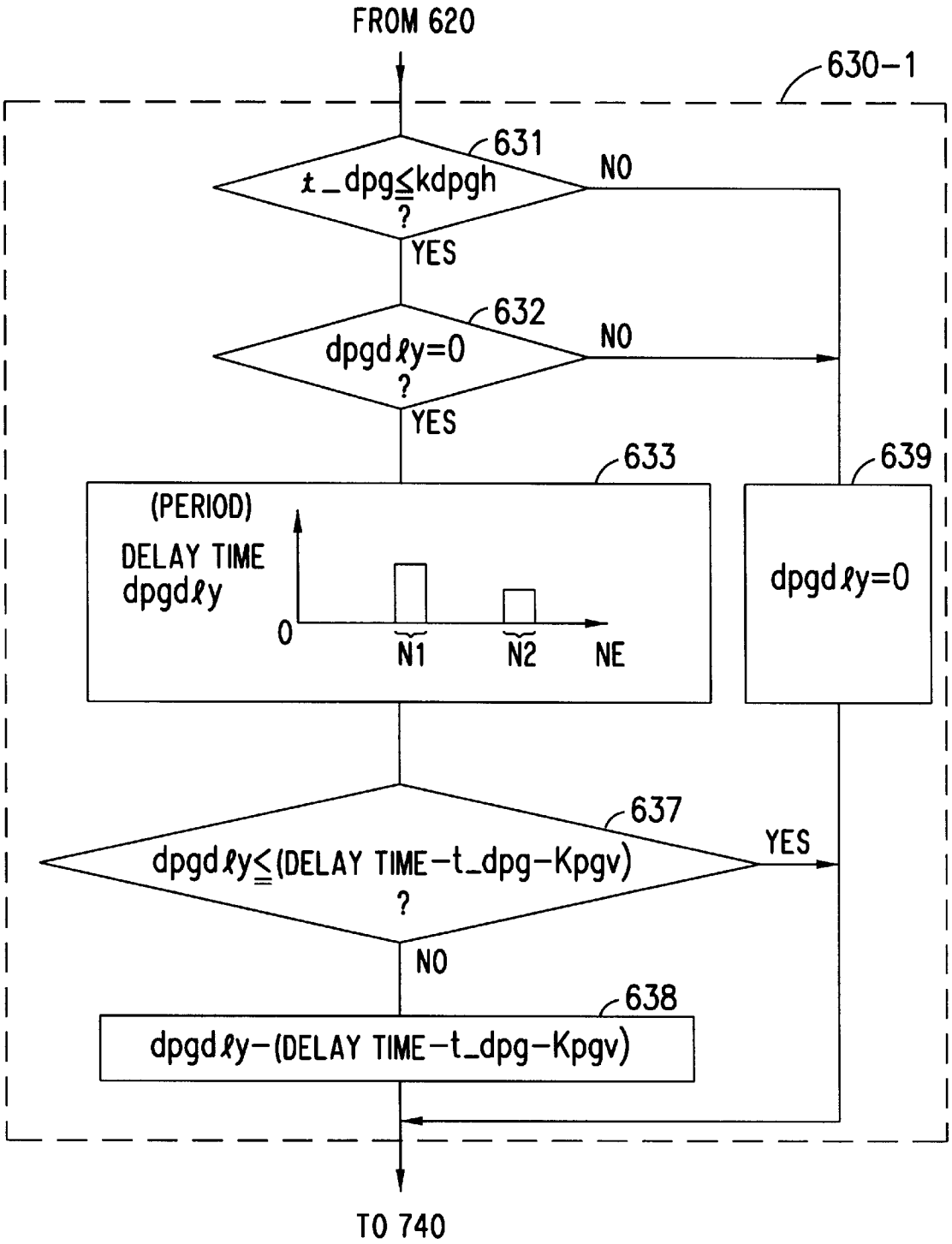
FIG. 15 is a flowchart showing a detailed process of step 630 shown in FIG. 9 according to a first embodiment of the present invention.

FIG. 15 is a flowchart showing a detailed process of step 630 in FIG. 9. In the flowchart according to the first embodiment of the invention, the process of step 630 in the flowchart of FIG. 9 is replaced by the flowchart 630-1 shown in FIG. 15. In the delay time setting process according to the first embodiment, the delay time is set for each two periods of the duty cycle in accordance with the engine speed calculated from the output signal of the crank angle sensor 47 by the driving condition detection means (engine speed detection means) A. First, step 631 judges whether the duty valve opening time (t_dpg) of the present processing period is smaller than a predetermined value kdpgh (a valve opening time corresponding to the duty factor of 80%, for example). When the result of judgement is YES, the process proceeds to step 632 for judging whether the delay time dpgdly of the present processing period is zero or not. When dpgdly is zero, the process proceeds to step 633, while when dpgdly is not zero, the process proceeds to step 639 where the delay time dpgdly is set to zero. In the case where the judgement in step 631 is NO, on the other hand, the process proceeds to step 639 for setting the delay time of the next processing period dpgdly to zero.

In step 633, the delay time dpgdly for the engine speed NE of the present processing period calculated by the engine speed detection means according to the invention is calculated from the map of the delay time dpgdly of the next processing period for the engine speed NE stored in the ROM in advance. This map handles engine speed regions N1 and N2 between which the intake stroke of a specific cylinder is synchronized with the basic duty cycle T (=100 msec) providing the base of the D-VSV. In the engine speed region N1, the delay time dpgdly is set to one half (=50 msec) of the basic duty cycle T, and in the engine speed region N2, the delay time dpgdly is set to one fourth (=25 msec) of the basic duty cycle. In this way, the D-VSV is turned on after one half of the basic duty cycle T from the beginning of the basic duty cycle T in the engine speed region N1, and the D-VSV is turned after one fourth of the basic duty cycle T in the engine speed region N2. As a result, the D-VSV is turned on during the intake stroke of the cylinder #1 or #4 alternately for each combustion cycle of the engine in the engine speed region N1, and the D-VSV is turned on during the intake stroke of the cylinder 190 1 or #4 alternately for each two combustion cycles in the engine speed region N2. The purge gas distribution among the cylinders is thus equalized thereby to suppress the fluctuations of the air-fuel ratio. As described above, according to this invention, a delay time is set in step 631 in such a manner as to secure the valve opening time during the duty cycle when the duty factor is very large (say, 80% or more). Also, in the case where the duty factor is very large, the intermittent flow of the purge gas occurs less frequently, so that the D-VSV can be opened at the starting point of the cycle without setting a delay time. Consequently, a complicated duty control operation is eliminated. Further, the purge gas flow rate is stabilized.

Then, step 637 judges whether the delay time dpgdly is not more than a predetermined value or not, i.e., subtracts the present duty valve opening time (t_dpg) and the delay time guard value kpgv providing the off-time of the D-VSV required for securing a stable purge gas flow rate are subtracted from the present period T, (T−(t_dpg)−kpgv). Thus step 637 judges whether the delay time dpgdly≦T−(t_dpg)−kpgv or not. If the judgement is YES, the process proceeds to step 740, while when the judgement is NO, the process proceeds to step 638 for setting the delay time dpgdly to (T−(t_dpg)−kpgv). In this way, according to this invention, the delay time is set according to the valve opening timing in steps 637 and 638. Therefore, the D-VSV can be positively opened or closed while making it possible to supply the purge gas in a set amount to the intake path without any excess or shortage. Also, since the opening and closing operation of the D-VSV is accurately completed within a single period, the calculation of the delay time for the open/close control and the open/close control itself for the next period are not adversely affected.

Figure 16:
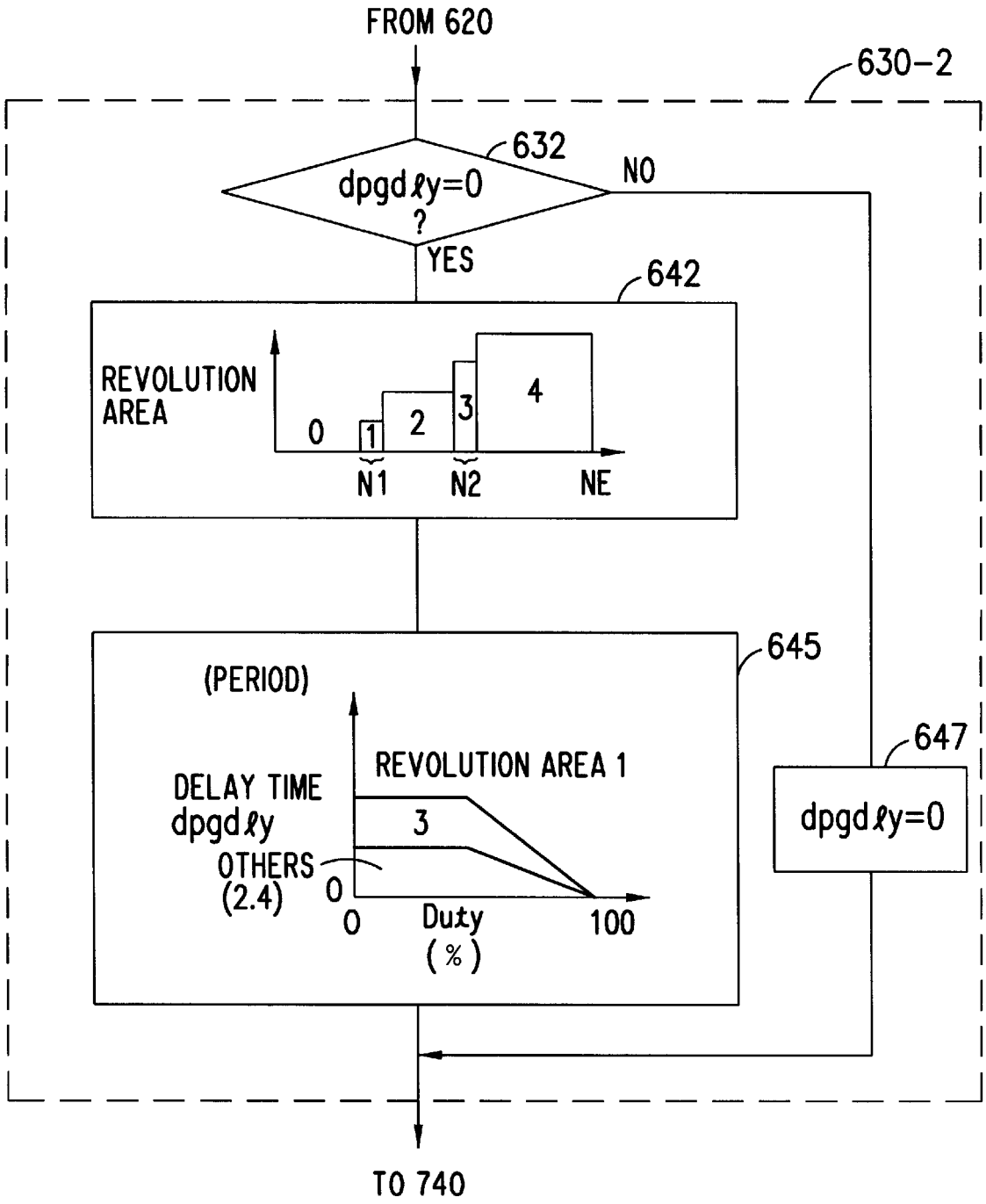
FIG. 16 is a flowchart showing a detailed process of step 630 shown in FIG. 9 according to a second embodiment of the present invention.

FIG. 16 is a flowchart showing another detailed process of step 630. In the flowchart according to the second embodiment of the invention, the process of step 630 in the flowchart of FIG. 9 is replaced by the flowchart 630-2 shown in FIG. 16. According to the second embodiment, a process is set for setting the delay time dpgdly corresponding to the duty factor and the region of the engine speed NE. First, step 632 judges whether the delay time dpgdly of the present processing period is zero or not. If dpgdly is zero, the process proceeds to step 642, while when dpgdly is not zero, the process is passed to step 647. In step 642, the rotational regions 0 to 4 corresponding to the engine speed NE are determined on the basis of the map stored in the ROM in advance. Step 645 calculates the delay time dpgdly of the next processing period in accordance with the duty factor and the rotational regions 0 to 4 on the basis of the map stored in the ROM in advance. As a result, the duty factor as well as the engine speed is taken into consideration. Specifically, the distribution is equalized among cylinders without setting any delay time when the duty factor is large unlike when the duty factor is small. Thus, as the duty factor increases beyond a predetermined value, the delay time is set steadily smaller. According to the present invention, the execution of the flowchart shown in FIG. 16 makes it possible to delay the valve opening start time of the D-VSV in such a manner as not to specify any cylinder into which the purge gas flows for each duty cycle in the engine rotational regions 1, 3 where the engine speed is substantially synchronized with the duty cycle. As a result, the purge gas is distributed uniformly among the cylinders thereby to suppress the fluctuations of the air-fuel ratio.

Now, the process for setting the delay time having a period switching means D according to a third embodiment of the invention will be explained with reference FIGS. 17 to 20.

Figure 1:
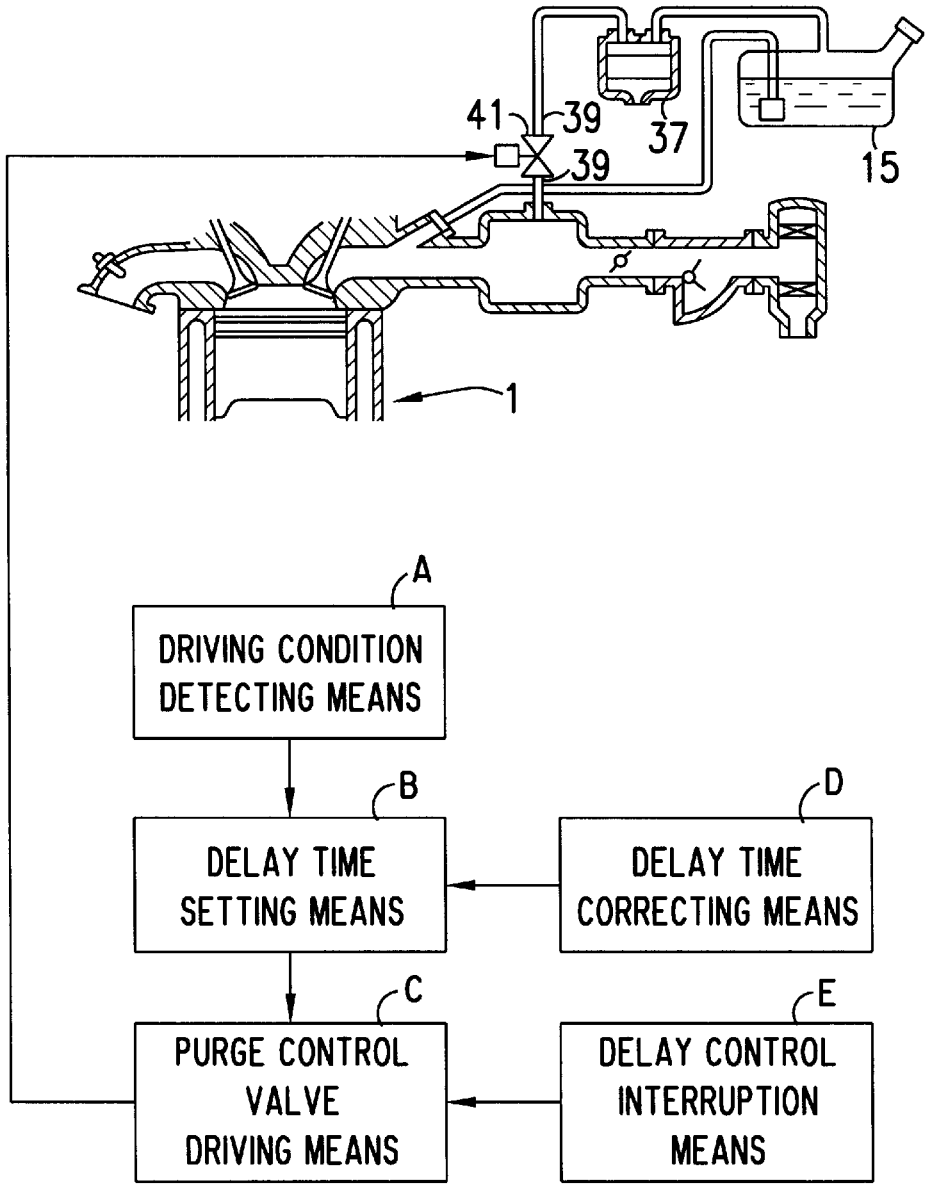
FIG. 1 is a drawing showing a basic constitution of the present invention.
Figure 17:
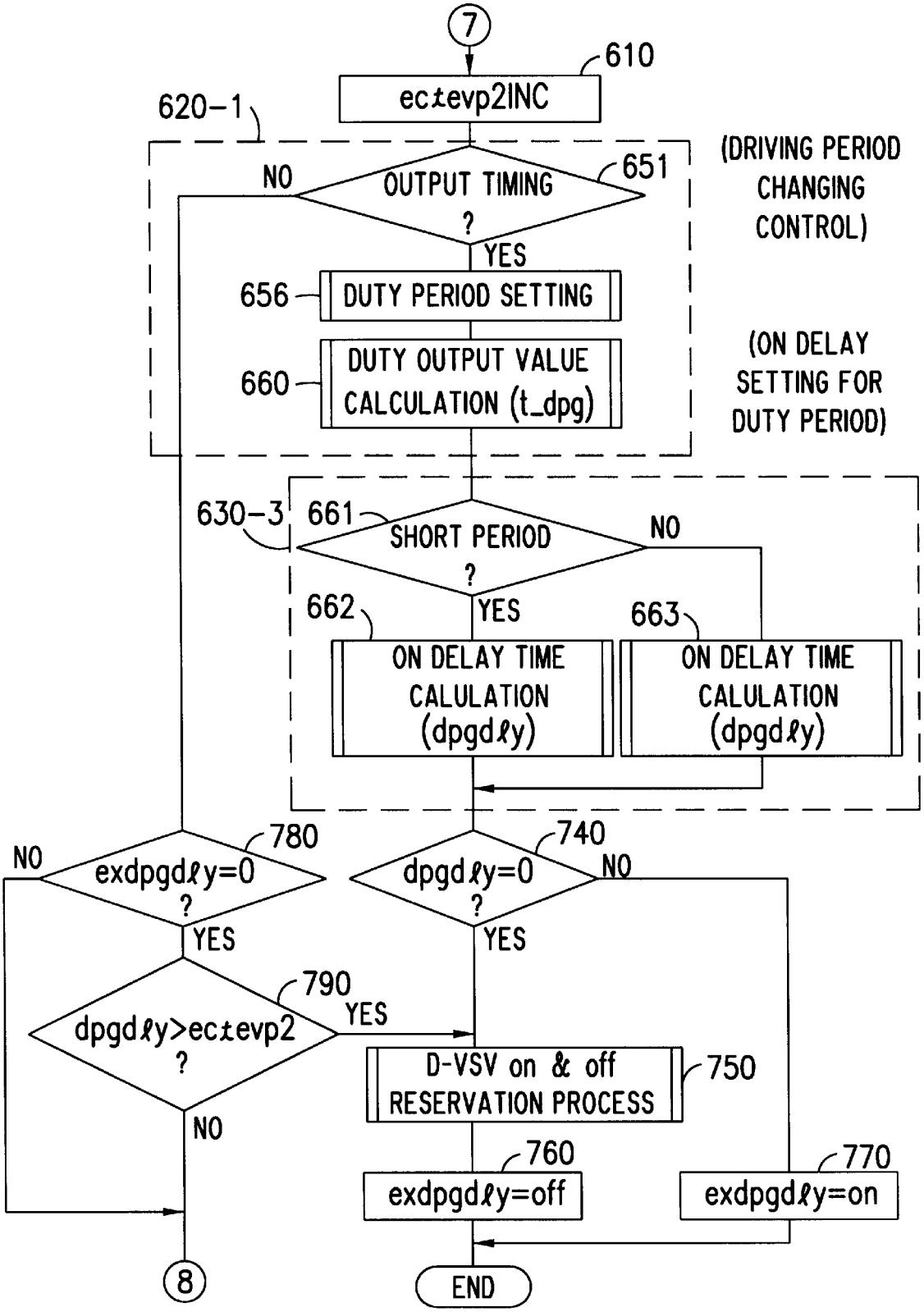
FIG. 17 is a flowchart showing a delay time setting process in outline according to a third embodiment of the present invention.

FIG. 17 is a flowchart schematically showing the process for setting the delay time according to the third embodiment of the invention. In the flowchart according to the third embodiment of the invention, the process of steps 620 and 630 in the flowchart of FIG. 9 are replaced by the process of steps 620-1 and 630-3, respectively. According to this third embodiment, step 620-1 switches the duty cycle of the D-VSV between two periods such as 100 msec and 67 msec, for example, and step 630-3 sets the delay time dpgdly corresponding to the respective periods. In FIG. 1 and subsequent drawings, the process of the same step number designates the same process. The process of steps 610, 740, 750, 760, 770, 780 and 790 in FIG. 17 will not be therefore omitted.

First, step 620-1 will be explained. Step 651 judges whether the timing has arrived for driving the D-VSV or not. If the judgement is YES, the process proceeds to step 656, while if the judgement is NO, the process proceeds to step 780. Step 656 sets the duty cycle, followed by step 660 for calculating the present duty valve opening time (t_dpg) corresponding to the period. Specifically, when the period T is 100 msec, the duty valve opening time (t_dpg) is set to DPG, and when the period T is 67 msec, the duty valve opening time (t_dpg) is set to DPG*67/100. The units of the duty valve opening time (t_dpg) are msec. Then, step 630-3, i.e., steps 661 to 663 calculate the delay time dpgdly corresponding to the duty factor in the following manner. First, step 661 judges whether the flag exevp2, indicating which of the two duty cycles is selected, is set to 1 (T=67 msec) or to 0 (T=100 msec). When exevp2 is set to 1, the process is passed to step 662 for setting the delay time dpgdly corresponding to the period T of 67 msec corresponding to the engine speed, while when exevp2 is zero, the process proceeds to step 663 for setting the delay time dpgdly corresponding to the period T of 100 msec. This setting is effected on the basis of the map described with reference to FIG. 16, for example. In this way, the period switching means according to the present invention is accomplished by executing the process of steps 620-1 and 630-3 in the flowchart of FIG. 17. As a result, the delay time corresponding to the duty cycle is set in an engine rotational region where the engine speed is substantially synchronized with the duty cycle of the D-VSV thereby to supply the purge gas into the intake path. Thus the valve opening timing of the D-VSV can be delayed in a manner to not specify any cylinder. Consequently, the purge gas is distributed uniformly among the cylinders and the fluctuations of the air-fuel ratio are suppressed. Now, the process of steps 651 and 657 in step 620-1 will be explained in detail.

Figure 18:
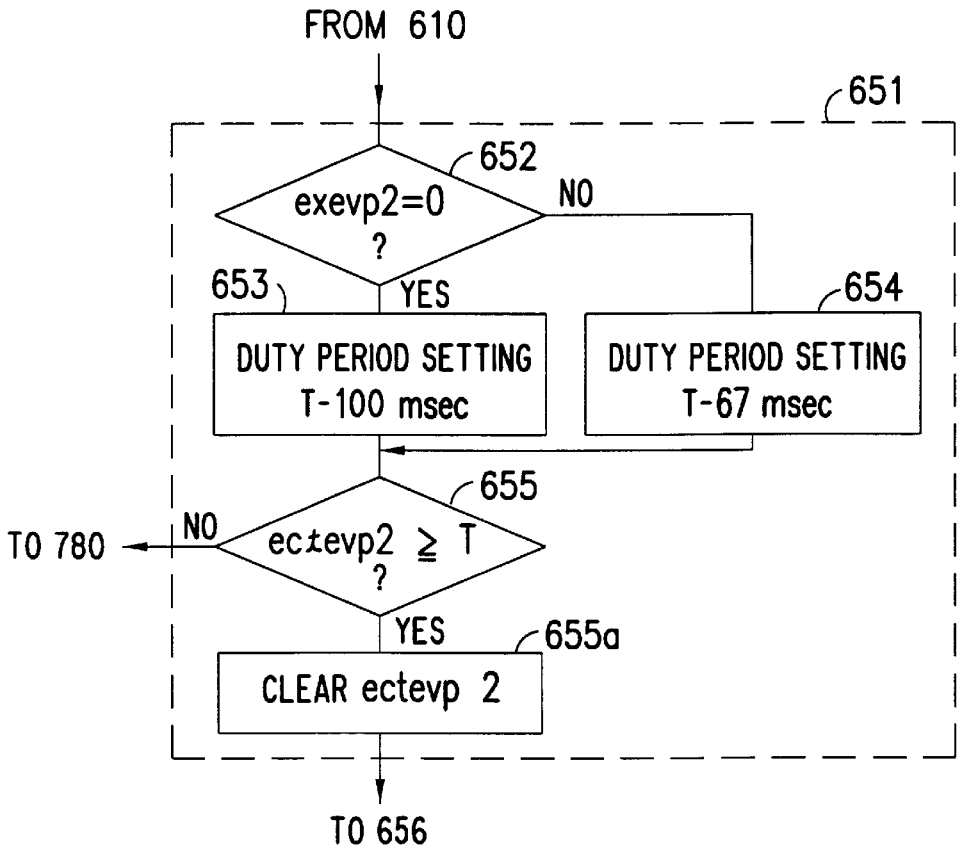
FIG. 18 is a flowchart showing a detailed process of step 651 shown in FIG. 17.

FIG. 18 is a flowchart showing a detailed process of step 651. First, step 652 judges whether the duty cycle ID flag exevp2 indicating which of the two duty cycles is selected is set to 0 (T=100 msec) or to 1 (T=67 msec). When exevp2 is set to zero, the process proceeds to step 653 for setting the duty cycle T to 100 msec, whereas if exevpt2 is set to 1, the process is passed to step 653 for setting the duty cycle T to 67 msec. Then, step 655 judges whether the counter ectevp2 of the present period has reached T or not. If the judgement is YES, the process is passed to step 655*a*, so that the counter ectevp2 of the present period is cleared followed by proceeding to step 656. In the case where the judgement in step 655 is NO, on the other hand, the process proceeds to step 780 shown in FIG. 9.

Figure 19:
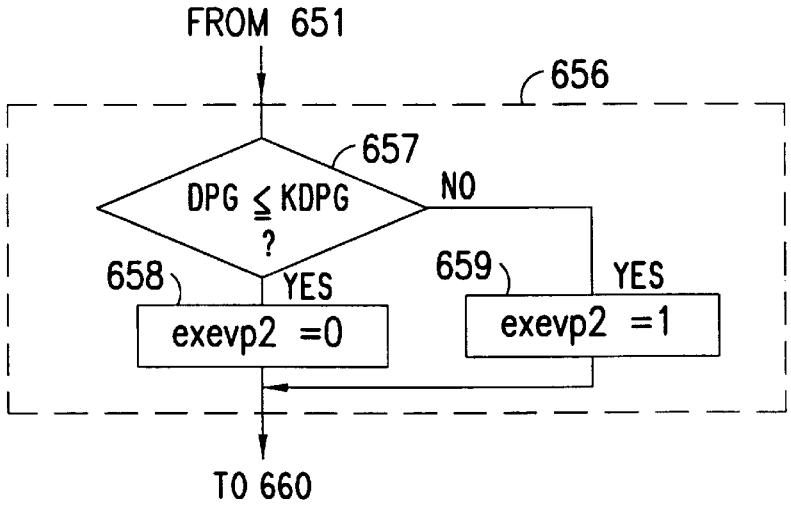
FIG. 19 is a flowchart showing a detailed process of step 656 shown in FIG. 17.

FIG. 19 is a flowchart showing a detailed process of step 656. First, step 657 compares the duty factor DPG with a lower limit setting KDPG (say, 10%) of the duty factor which deteriorates the flow rate characteristic of the purge gas, i.e., judges whether DPG≦KDPG. When DPG≦KDPG, the process proceeds to step 658 thereby to set the duty cycle ID flag exevp2 to zero (T=100 msec), while if DPG>KDPG, on the other hand, the process is passed to step 659 to set exevp2 to 1 (T=67 msec). In place of the lower limit setting KDPG of a duty factor described above, the upper limit setting K'DPG (say, 80%) can be provided, so that the duty ID flag can be set in accordance with the duty factor in the neighborhood of a high duty factor (80% or more) where the purge gas flow rate characteristic is deteriorated. Also, the duty ID flags can be set for both the upper and lower limit settings.

Figure 20:
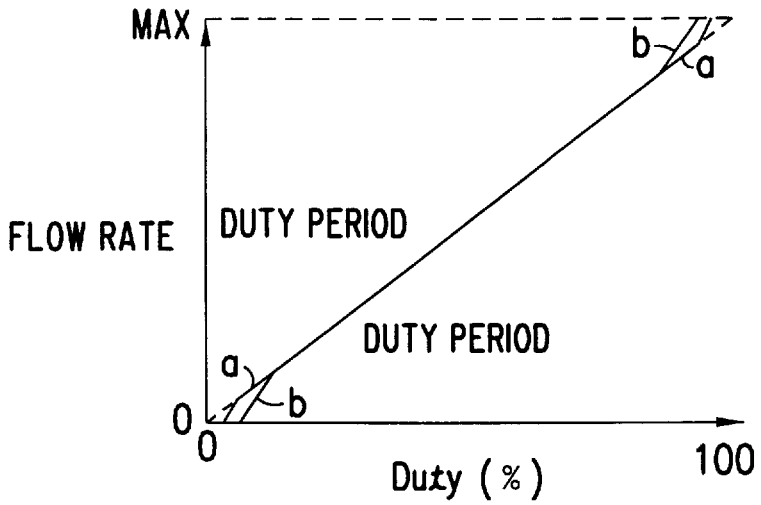
FIG. 20 is a drawing showing the relationship between a duty ratio and a flow quantity for two duty periods.

FIG. 20 is a diagram showing the relation between the duty factor and the flow rate of the two duty cycles. The flow rate characteristic for the duty cycle a (100 msec) has a better linearity than that for the duty cycle b (67 msec) in the neighborhood of 0% and 100%. In this way, in the case where the lower limit or the upper limit is exceeded for the duty cycle b, the duty cycle b is forcibly switched to the duty cycle a having a superior flow rate characteristic thereby to secure an appropriate flow rate characteristic.

Figure 21:
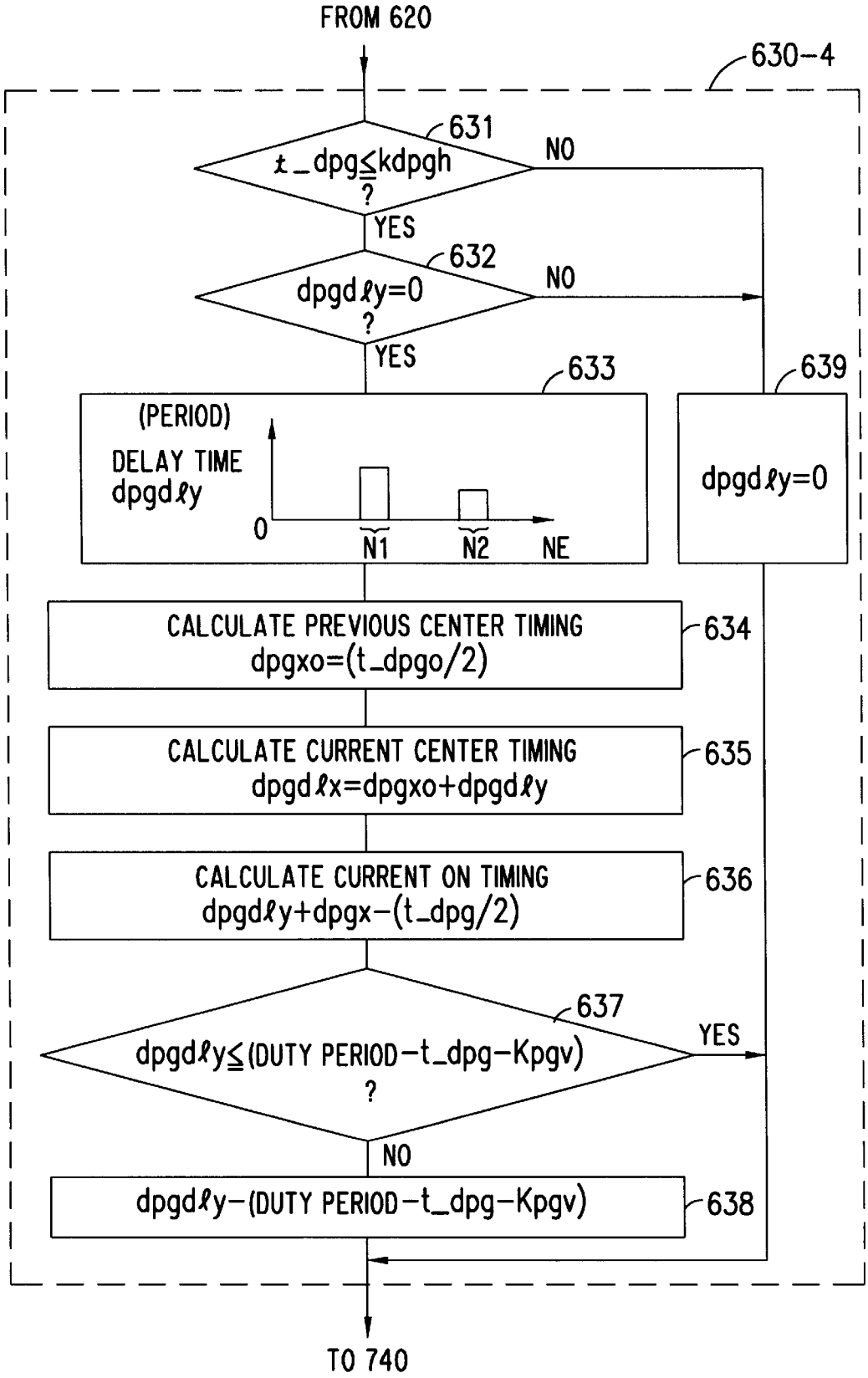
FIG. 21 is a flowchart showing a detailed process of step 630 shown in FIG. 9 according to a fourth embodiment of the present inventions

FIG. 21 is a flowchart showing a detailed process of step 630 in FIG. 9 according to a fourth embodiment of the invention. In the flowchart of 630-4 of FIG. 21, step 633 in the flowchart 630-1 of FIG. 15 is replaced by steps 634 to 636. The flowchart 630-4, therefore, shows the process for setting the optimum delay time corresponding to the duty factor for delaying the opening timing of the D-VSV. The process of steps 634 to 636 S will be described below. First, step 634 calculates the central timing dpgxo=(t_dpgo) of the valve opening time (t_dpgo) of the D-VSV in the previous period, and step 635 calculates the central timing dpgx=dpgxo+dpgdly of the valve opening time of the D-VSV in the present period. Further, step 636 subtracts one half of the valve opening time (t_dpg) of the D-VSV in the present period from the central timing dpgx of the valve opening time from the valve opening start (timing of turning D-VSV on) to the end of the valve opening (timing of turning D-VSV off) in the present period thereby to calculate the present valve opening timing dpgdly=dpgx−(t_dpg)/2. In this way, this invention is implemented by executing the process of the flowchart 630-4 shown in FIG. 21. As a result, especially at a transient time when the duty factor undergoes a sudden change at the time of acceleration or deceleration, the valve opening time can be changed (by lengthening the valve opening time, for example) with reference to the center of the valve opening time. The cylinders on intake stroke into which the purge gas flows can thus be distributed uniformly. Specifically, the purge gas can be easily introduced into a cylinder which closes the intake valve immediately before the purge gas purged immediately after the opening of the D-VSV reaches the particular cylinder, thereby promoting the distribution of the purge gas among the cylinders and thus suppressing fluctuations of the air-fuel ratio.

Figure 22A:
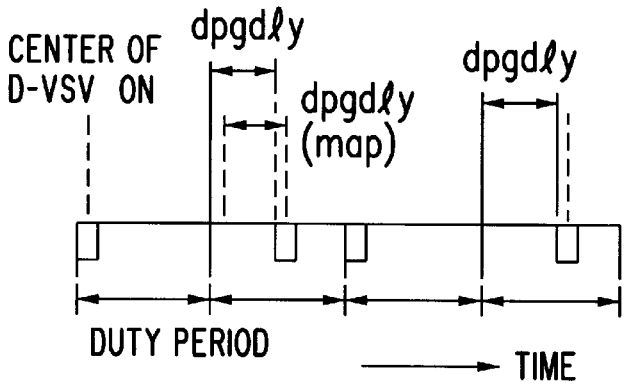
FIG. 22 is an explanatory drawing showing a delay process based on central timing of a duty period, (a) is a drawing showing that the valve opening timing is delayed every two periods, (b) is an explanatory drawing of steps 634 to 636 shown in FIG. 21.
Figure 22B:
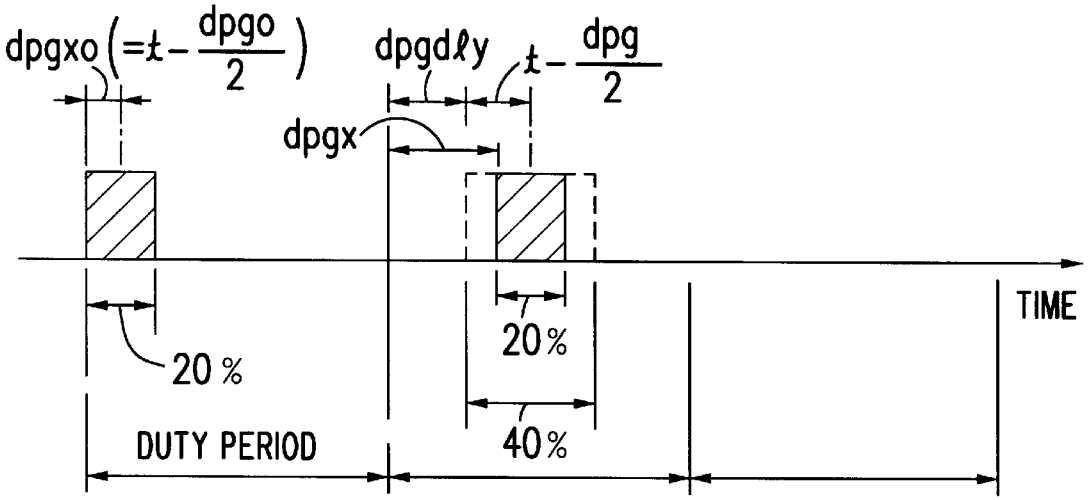

FIG. 22 is a diagram for explaining the process of delaying the valve opening time during the duty cycle based on the central timing of the valve opening time. FIG. 22*a* is a diagram showing that the valve opening time is delayed for each two periods of duty cycle, and FIG. 22*b* is a diagram for explaining steps 634 to 636 in FIG. 21. FIG. 22*a* shows that the delay time is set for each two periods based on the central timing of the duty cycle. FIG. 22*b*, on the other hand, indicates that when the duty factor changes from 20% to 40%, the delay time is shortened based on the central timing of the valve opening time in the duty cycle.

Figure 23:
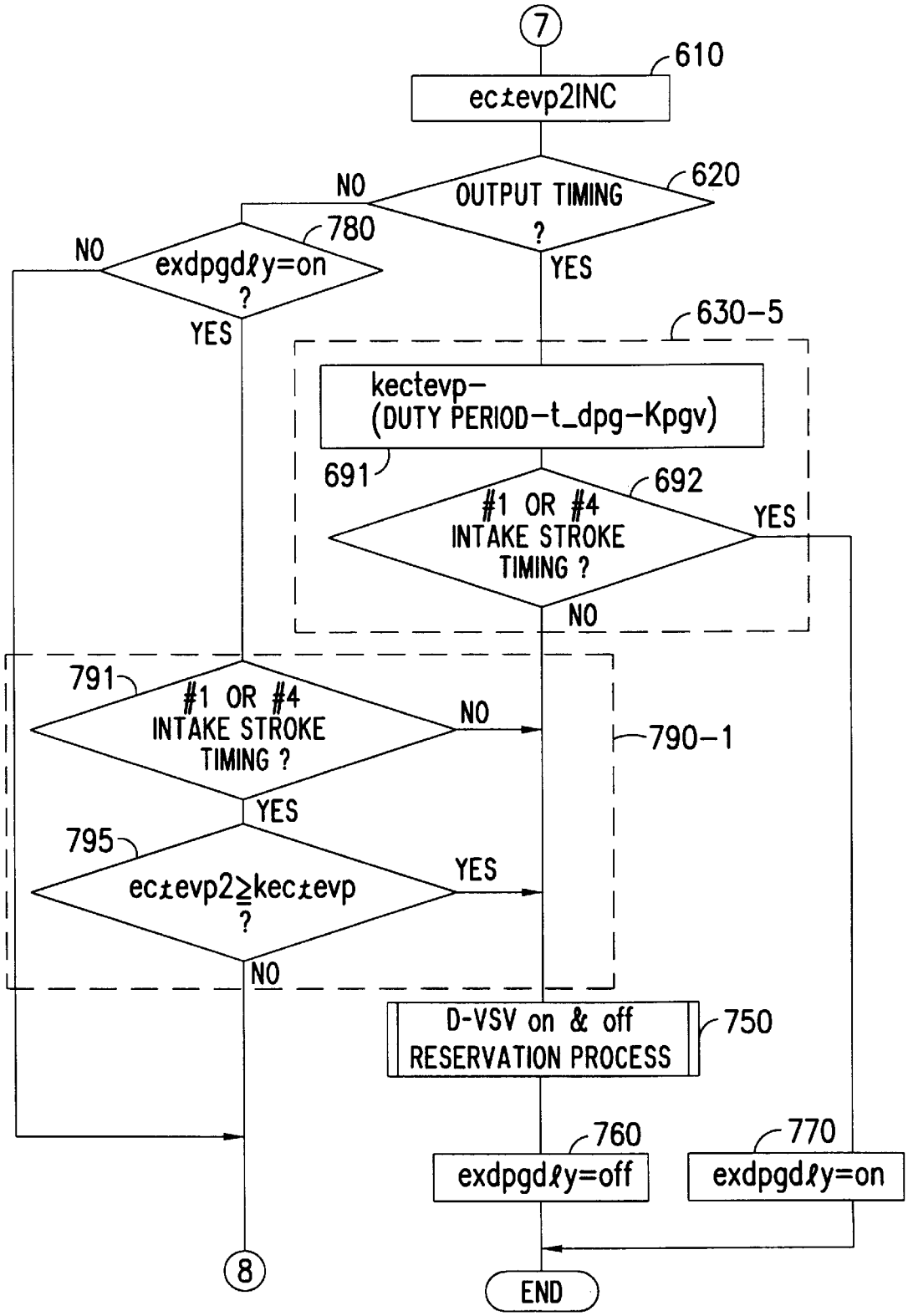
FIG. 23 is a flowchart showing a detailed delay time setting process according to a fifth embodiment of the present invention.

FIG. 23 is a flowchart showing a detailed process for setting the delay time according to a fifth embodiment hi the invention. In the flowchart according to the fifth embodiment of the invention shown in FIG. 23, the process of steps 630 and 790 in the flowchart of FIG. 9 are replaced by flowcharts 630-5 and 790-1. In the fifth embodiment of the invention, the time is detected when the intake timing of a specific cylinder is synchronized with the duty cycle of the D-VSV (uniform distribution judge means), and the delay time is intended to be set only in such a case. First, step 691 of step 630 in the flowchart 630-5 calculates the maximum value of the delay time (kectevp) from the following equation.

$$kectevp=T-(t_dpg)-(kpgv)$$

where T is the duty cycle, (t_dpg) is the valve opening time (duty valve opening time) per duty cycle of the D-VSV equivalent to the duty factor, and kpgv is the delay time guard value. Step 692 judges from the present crank angle whether the present valve opening time of the D-VSV is the intake stroke of the cylinder #1 or cylinder #4. In the case where the judgement is YES, the process proceeds to step 770, and the flag exdpgdly indicating that the delay control is proceeding is set to 1 (on), thus completing this routine. In the vase where the judgement is NO, on the other hand, the process proceeds to step 750 for opening the D-VSV without setting any delay time dpgdly. Step 791 in the flowchart 790-1, on the other hand, judges from the present crank angle whether the present valve opening time of the D-VSV is the intake stroke of the cylinder #1 or cylinder #4. If the judgement is YES, the process is passed to step 795, while when the judgement is NO, the process proceeds to step 750 for opening the D-VSV. Step 795 judges whether or not the count value ectevp2 on the counter for the present period has reached the maximum value kectevp of the delay time. In the case where the judgement is YES, the process proceeds to step 750 for opening the D-VSV. If the judgement is No, on the other hand, the process proceeds to step 755 in FIG. 10. In this way, according to thus-invention, the delay time is set in such a manner that a cylinder which is in an intake stroke for the next period of the D-VSV is different from a cylinder which is in an intake stroke at the valve opening time of the present period. The purge gas, therefore, is uniformly distributed among the cylinders, and the fluctuations of the air-fuel are suppressed.

Figure 24:
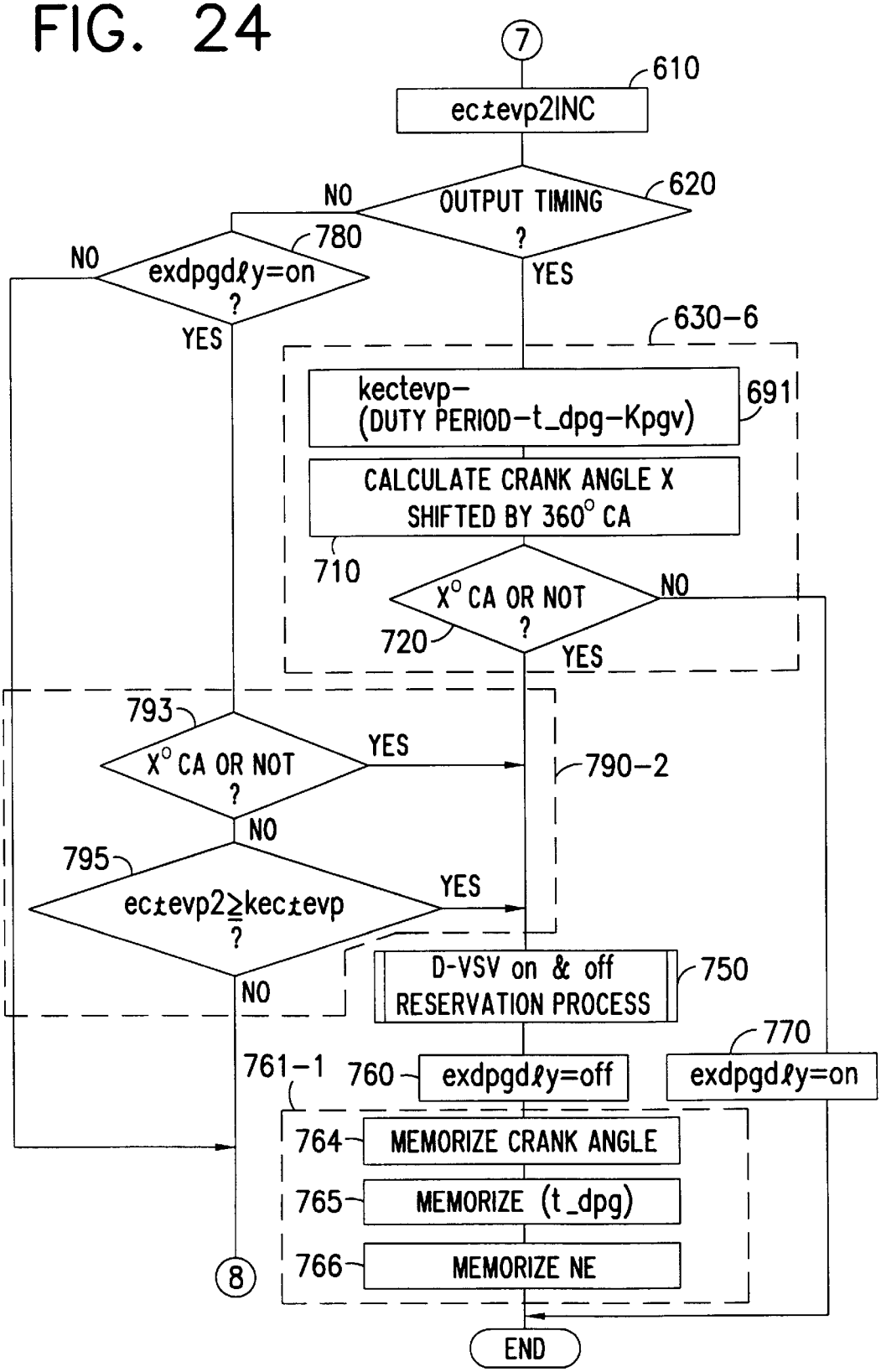
FIG. 24 is a flowchart showing a detailed delay time setting process according to a sixth embodiment of the present invention.

FIG. 24 is a flowchart showing a detailed process of setting the delay time according Lo a sixth embodiment of the invention. In the flowchart according to the sixth embodiment of the invention shown in FIG. 24, the process of steps 630, 761 and 790 in the flowchart of FIG. 9 are replaced by the flowcharts 630-6, 761-1 and 790-2, respectively. According to the sixth embodiment of the invention, the time is detected when the intake timing of a specific cylinder is synchronized with the duty cycle of the D-VSV, and the delay time at that timing is set to the crank angle of 360° CA so as to open the D-VSV by shifting the engine combustion cycle by one half. As a result, when the intake timing of a specific cylinder comes into synchronism with the duty cycle of the D-VSV, the particular specific cylinder, for example, the cylinder #1 and the cylinder #4 which is shifted by 36° CA from the cylinder #1 are controlled to open the D-VSV alternately when they are on intake stroke. Thus the distribution of the purge gas among the cylinders is equalized. First, step 691 in the flowchart 630-6 calculates the maximum value kectevp of the delay time as explained with reference to FIG. 23. Then, step 710 calculates the crank angle X shifted by 360° CA from the crank angle at the time of previous valve opening start of the D-VSV stored in step 764 as described later. In other words, the cylinder #1 is calculated which is in an intake stroke by 360° CA behind the #4 cylinder. Then, step 720 judges whether the present crank angle CCRNK is X° CA or not. In the case where the judgement is YES, the process proceeds to step 750 for opening the D-VSV, while if the judgement is NO, the process proceeds to step 770, where the flag exdpgdly indicating that the delay control is going on set to 1 (on), thus completing the routine.

After that, in the flowchart 761-1, the present crank angle is stored (step 764), the present duty valve opening time (t_dpg) is stored (step 765), and the present engine speed NE is stored (step 766). Step 793 in the flowchart 790-2 judges whether the present crank angle CCRNK is X° CA or not. If the judgement is YES, the process proceeds to step 750 for opening the D-VSV, while if the judgement is NO, on the other hand, the process proceeds to step 795 for judging whether the count value ectevp2 of the counter for the present period has reached the maximum value of the delay time. If the judgement is YES, the process is passed to step 750, while if the judgement is NO, the process proceeds to step 755 in FIG. 10.

Figure 25:
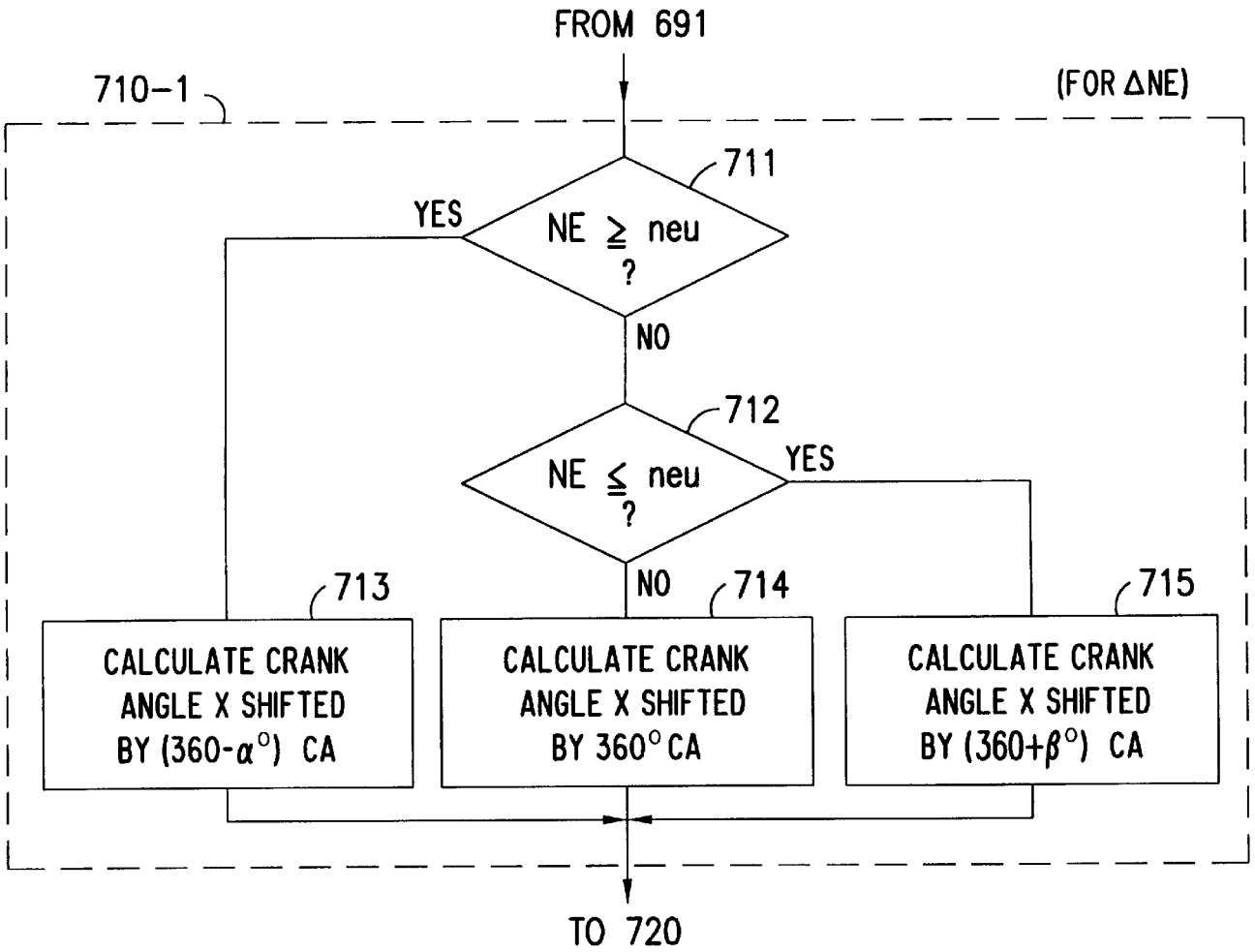
FIG. 25 is a flowchart showing a detailed process of step 710 shown in FIG. 24.

FIG. 25 is a flowchart showing a detailed process of step 710. The process shown in the flowchart 710-1 of FIG. 25 is intended to equalize the distribution of the purge gas among the cylinders at the time of acceleration and deceleration taking the response to the purge gas flow into account. First, step 711 judges whether the engine speed NE assumes a value neu or more which the previous result of calculation of NE+25 (RPM). When NE≧neu, the process proceeds to step 713, while if NE<neu, the process proceeds to step 712. Further, step 712 judges whether the engine speed NE assumes a value not more than ned which is the previous result of calculation of NE−25 (RPM). If NE≦ned, the process proceeds to step 715, and when the judgement is NE>ned, on the other hand, the process proceeds to step 714. Steps 713, 714, and 715 calculate the crank angle X shifted by (360−α) (α>0))° CA, 360° CA and (360+β (β>0))° CA, respectively, with respect to the crank angle at the previous valve opening start time of D-VSV stored in step 764.

Figure 26:
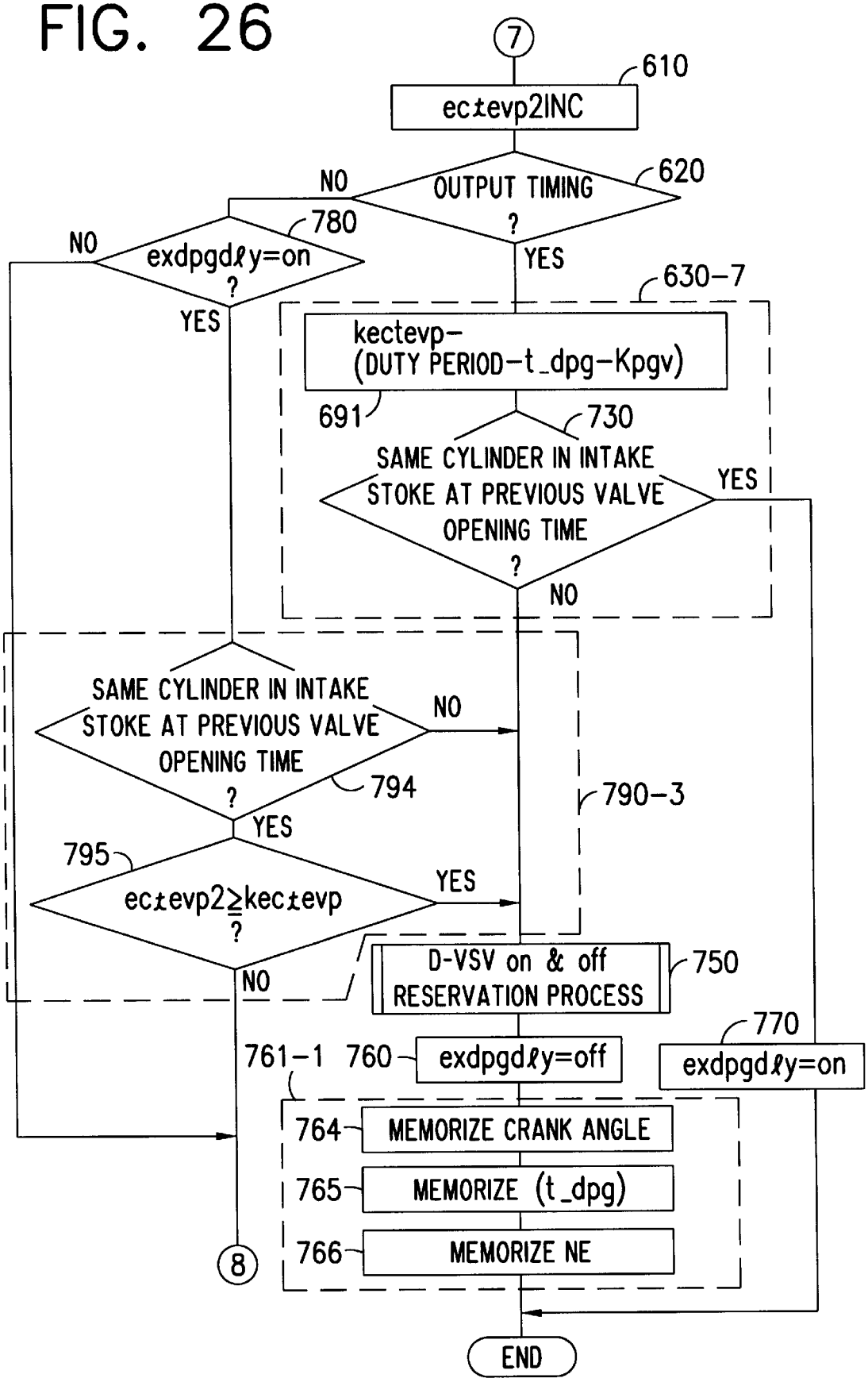
FIG. 26 is a flowchart showing a detailed delay time setting process according to a seventh embodiment of the present invention.

FIG. 26 is a flowchart showing a detailed process for setting the delay time according to a seventh embodiment of the invention. In the flowchart according to the seventh embodiment of the invention shown in FIG. 26, the process of steps 630, 761 and 790 in the flowchart of FIG. 9, as in FIG. 24, are replaced by the flowcharts 630-7, 761-1 and 790-2, respectively. According to the seventh embodiment of the invention, the delay time is set when the cylinder which is in an intake stroke at the present time of valve opening of the D-VSV is identical to the cylinder which is in an intake stroke at the previous time of valve opening of the D-VSV, and the delay time is set to zero otherwise. As a result, the distribution of the purge gas among the cylinders is equalized. In the flowchart shown in FIG. 26, steps 710 and 720 of FIG. 24 are replaced by step 730 of FIG. 26, and step 793 in FIG. 24 is replaced by step 794 in FIG. 26. As a result, only steps 730 and 794 will be described below. Step 730 judges whether the cylinder which is in an intake stroke at the present valve opening Lime of the D-VSV is identical to the cylinder which is in an intake stroke at the previous time of valve opening of the D-VSV. If the judgement is YES, the process proceeds to step 770 for setting flag exdpgdly indicating that the delay control is in process to 1 (on) thereby to complete the routine. In the case where the judgement in step 730 is NO, on the other hand, the process proceeds to step 750 for opening the D-VSV. In similar fashion, step 794 judges whether the cylinder which is in an intake stroke at the present time of valve opening of the D-VSV is identical to the cylinder which is in an intake stroke at the previous time of valve opening of the D-VSV. If the judgement is YES, the process proceeds to step 795 for judging whether the count value ectevp2 on the counter for the present period has reached the maximum value kectevp of the delay time. In the case where the judgement is YES, the process proceeds to step 750, while if the judgement is NO, the process is passed to step 755 in FIG. 10.

Figure 27:
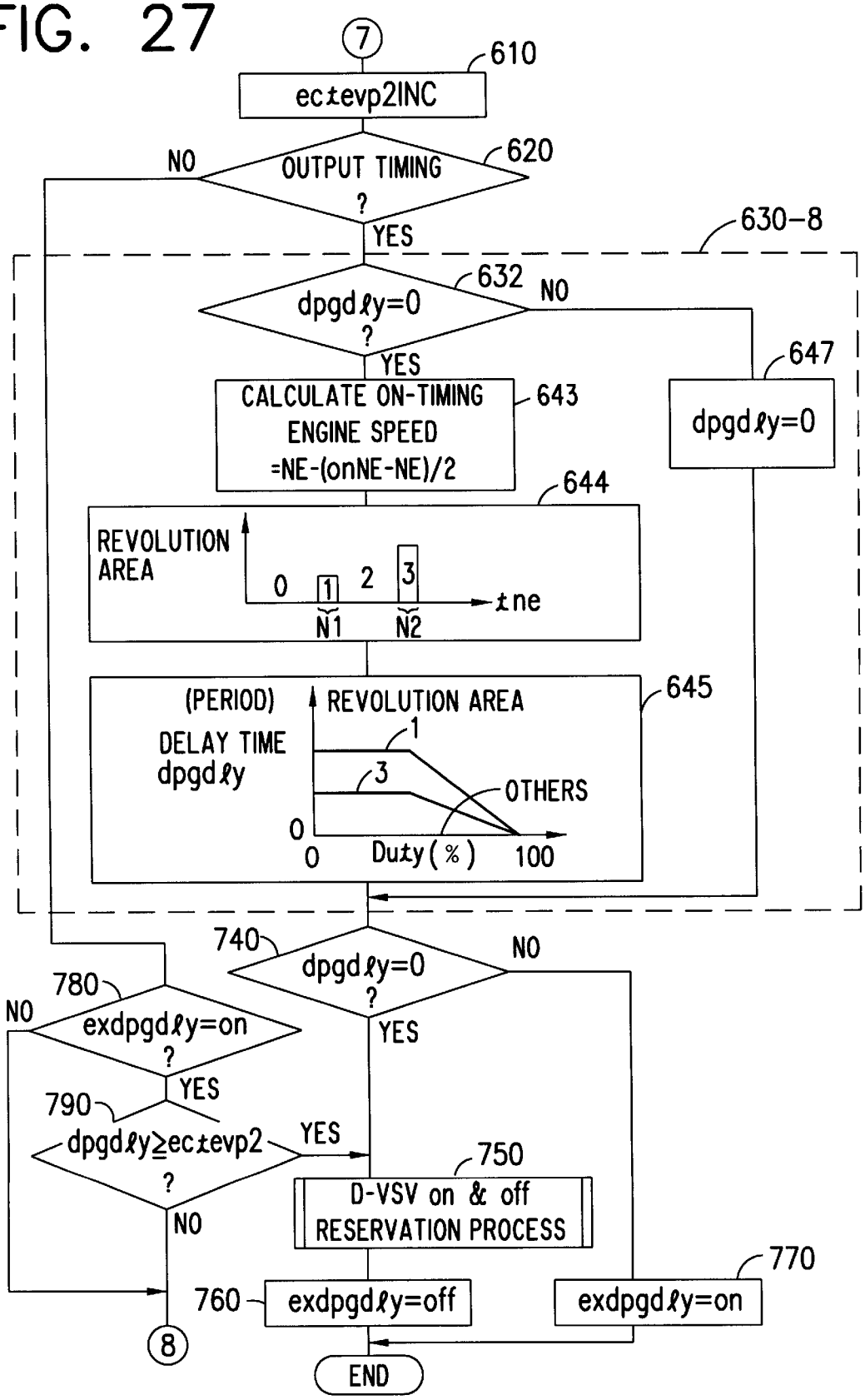
FIG. 27 is a flowchart showing a detailed delay time setting process according to an eighth embodiment of the present invention.

FIG. 27 is a flowchart showing a detailed process for setting the delay time according to an eighth embodiment of the invention. In the flowchart according to the eighth embodiment of the invention shown in FIG. 27, the process of step 630 in the flowchart of FIG. 9 is replaced by the flowchart 630-8. According to the eighth embodiment of the invention, an optimum delay time is set in accordance with the engine speed regardless of the rotational change of the engine at the time of acceleration or deceleration. Specifically, the engine speed associated with the calculated delay time set for each of a plurality of rotational regions is used to calculate the engine speed up to the end of the particular duty cycle. Thus an engine speed corresponding to the present duty cycle is calculated from the difference between the previous engine speed and the present engine speed. As a result, the engine speed at the center of the present duty cycle is predicted, and the delay time is set on the basis of the predicted engine speed. A satisfactory delay time can thus be set even at the time of acceleration or deceleration. Now, a specific process of the flowchart 630-8 will be explained below.

First, step 632 judges whether the delay time dpgdly of the present processing cycle is zero or not. If dpgdly is zero, the process proceeds to step 643, while if dpgdly is not zero, the process proceeds to step 740. Step 643 calculates the predicted engine speed tne at the center of the present duty cycle from the present engine speed NE and the previous engine speed OnNE according to the following equation.

$$tne=NE-(onNE-NE)/2$$

Then, step 644.calculates the rotational region 1, 2, 3 or 4 corresponding to the predicted engine speed tne calculated in step 644 based on the map stored in a ROM in advance. Step 645 calculates the delay time dpgdly corresponding to the duty factor and the rotational region calculated in step 644 based on the map stored in a ROM in advance, and then process proceeds to step 740.

In the embodiment described above, an example of the duty control operation is explained, in which the purge control with a delay time set (pattern with delay time) and the purge control with a delay time not set (pattern without delay time) are alternately executed within the duty cycle regardless of the operating conditions of the internal combustion engine. The present invention, however, is not limited to such a control operation. Specifically, in setting a pattern with or without the delay time, a plurality of maps are stored in a ROM for determining the presence or absence of the delay time in accordance with the operating conditions of the internal combustion engine (including the engine speed, load, intake air amount, throttle valve opening degree, cooling water temperature, battery voltage, and output value of the air-fuel ratio sensor) or the canister conditions, the conditions of the fuel tank, the purge gas concentration, etc., and the maps are switched and are used at the same time in accordance with the engine operating conditions, the canister conditions, the fuel tank conditions, the purge gas concentration, etc. For example, a first map is prepared for determining the presence or absence of the delay time on the basis of the engine load, and a second map is prepared for determining the presence or absence of the delay time on the basis of the engine cooling water temperature. The presence or absence of the delay time can be determined from the first map in accordance with the engine load conditions, or the presence or absence of the delay time can be determined using both the first and second maps only at the time of starting the engine when the water temperature is low.

Although (the length of) the delay time is determined in accordance with the engine speed in the above-mentioned embodiment, the invention is not limited to such a method. The delay time can alternatively be set in accordance with a main map for calculating the delay time and an auxiliary map for calculating a correction value of the delay time in accordance with the engine operating conditions, the canister conditions, the fuel tank conditions, the purge gas concentration, etc. in addition to the engine speed. For example, the main map is prepared for calculating the delay time based on a predicted engine load (detected by the load estimating means), and an auxiliary map is prepared for calculating a correction value of the delay time based on the engine water temperature. In accordance with the engine road conditions, the delay time is calculated from the main map, and the delay time is corrected using the auxiliary map only at the time of engine start when the water temperature is low.

Further, the present invention is not confined to the above-mentioned case in which a plurality of the periods of the D-VSV, i.e., the purge control valve 41 are switched alternately between 67 msec and 100 msec. Instead, three or more periods can be switched alternately, or the same period can be repeated a plurality of times (twice or thrice, for example), followed by switching to another period. In this way, the switching pattern can be altered in accordance with the engine operating conditions, the canister conditions, the fuel tank conditions, the purge gas concentration, etc. This pattern can of course be predetermined by experiment and can be set accordingly.

Figure 28:
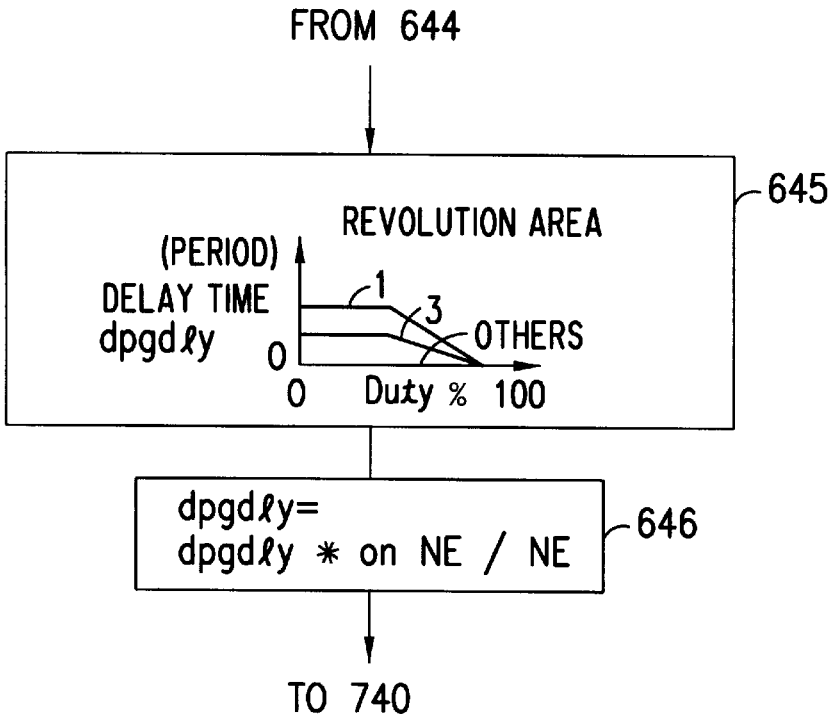
FIG. 28 is a flowchart showing a detailed delay time setting process according to a ninth embodiment of the present invention.

FIG. 28 is a flowchart showing a process for setting the delay time according to a ninth embodiment of the present invention. In the flowchart according to the ninth embodiment of the invention shown in FIG. 28, step 646 for correcting the delay time is added to step 645 in the flowchart of FIG. 27. According to the ninth embodiment, the delay time is corrected to decrease at the time engine acceleration and increase at the time of engine deceleration. Step 646 calculates a new delay time dpgdly by calculating the dpgdly*onNE/NE from the delay time dpgdly calculated in step 645, the present engine speed NE and the and the previous engine speed onNE. As a result, the delay time dpgdly is corrected to decrease at the time of acceleration when the present engine speed is higher than the previous engine speed, and corrected to increase at the time of deceleration when the present engine speed is lower than the previous engine speed.

Figure 29:
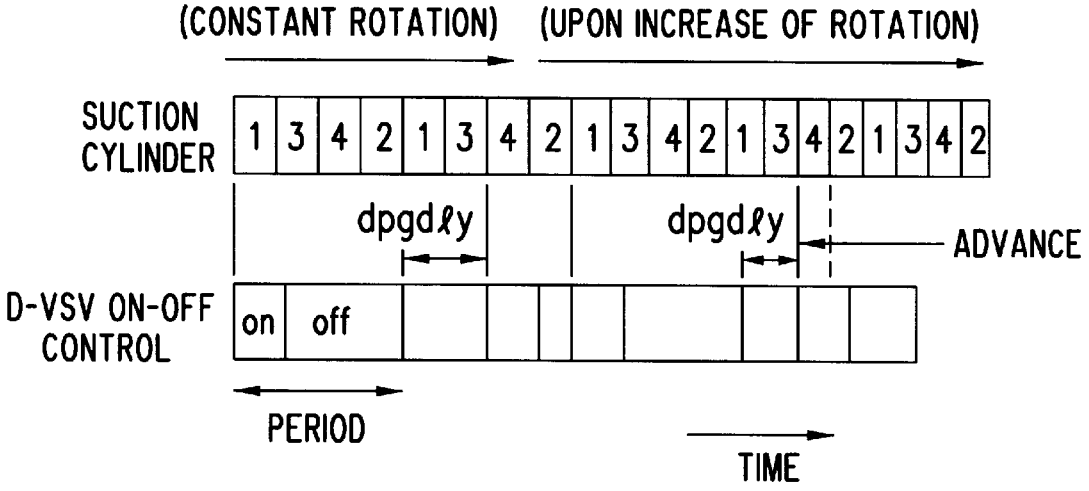
FIG. 29 is an explanatory drawing showing the delay time setting process according to a ninth embodiment of the present invention.

FIG. 29 is a diagram for explaining the delaying process according to the ninth embodiment of the invention. As shown in FIG. 29, the delay time dpgdly is corrected in such a manner as to decrease at the time of acceleration when the present engine speed is higher than the previous engine speed.

Figure 30:
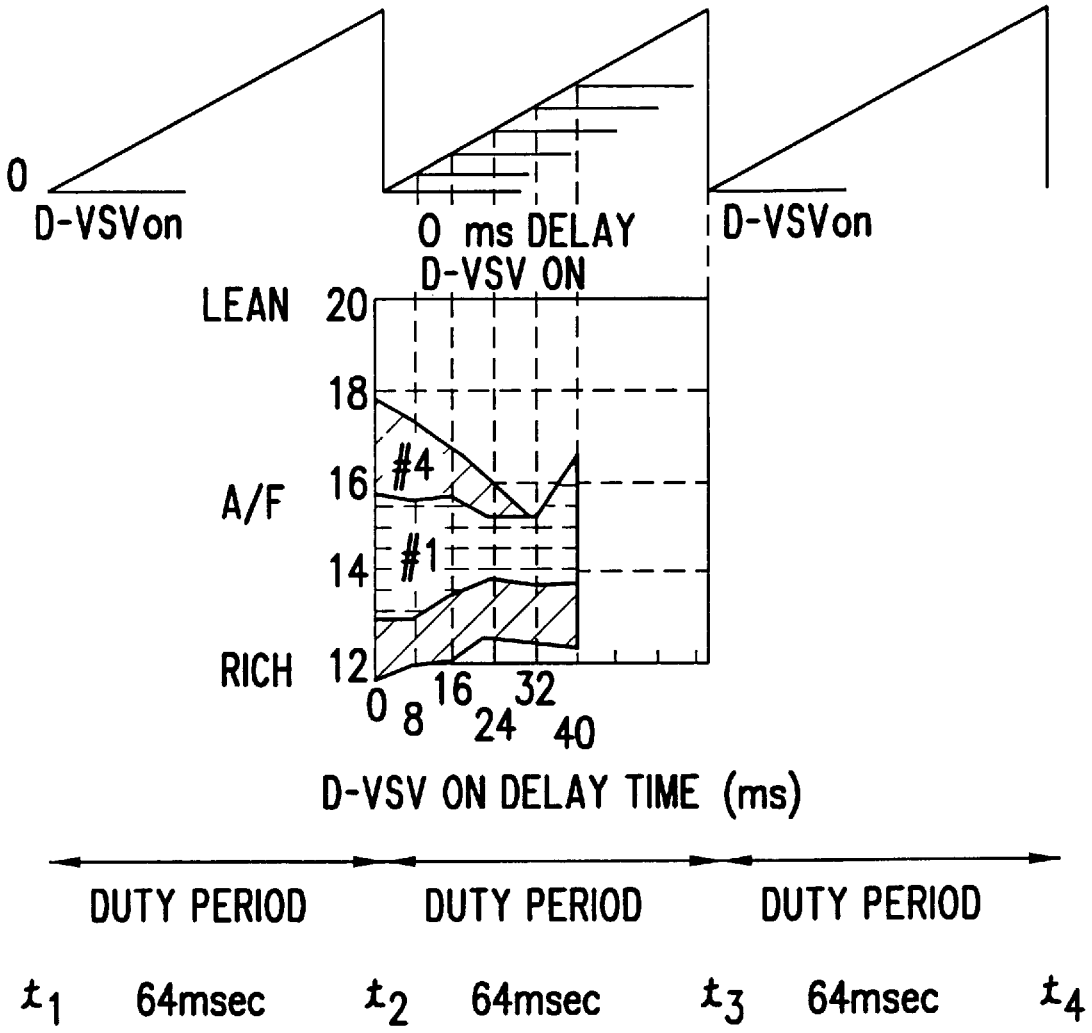
FIG. 30 is a drawing showing air-fuel ratio fluctuation when a first duty period according to the delay process of the present invention is used.

FIG. 30 is a diagram showing the fluctuations of the air-fuel ratio when a first duty cycle is used for the delay process according to the invention. FIG. 30 shows the result of an experiment conducted for measuring the fluctuations of the air-fuel ratio when the delay time of the D-VSV is changed to 8, 16, 24, 32 to 40 msec, for each two periods of the duty cycle. It is also shown that the #4 cylinder is in an intake stroke at time points t1, t2, t3, t4 at 64-msec intervals. Experiments shown in FIG. 30 show that the air-fuel ratio of the #1 cylinder is not affected by the delay time for every two periods of the duty cycle, while, the fluctuations of the air-fuel ratio of the #4 cylinder can be minimized when the delay time is set to 32 msec for every two periods of the duty cycle.

Figure 31:
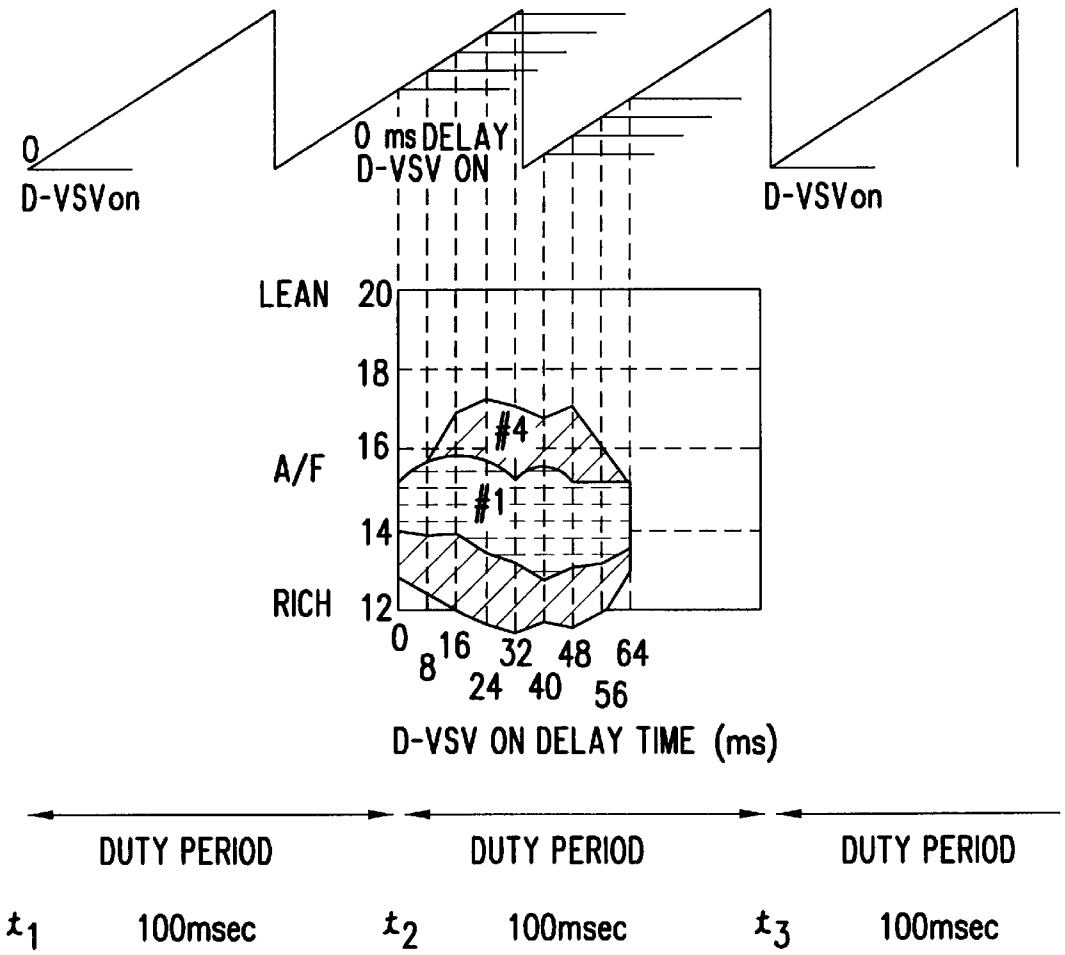
FIG. 31 is a drawing showing air-fuel ratio fluctuation when a second duty period according to the delay process of the present invention is used.

FIG. 31 is a diagram showing the fluctuations of the air-fuel ratio when a second duty cycle is used for the delaying process according to the present invention. FIG. 31 shows the result of an experiment conducted for measuring the fluctuations of the air-fuel ratio when the delay time of the D-VSV is changed from 8, 16, 24, 32, 40, 48, 56, 64 msec in that order for every two periods of the duty cycle. It is also shown that the cylinder #4 is in an intake stroke at time points t1, t2, t3, t4 at time intervals of 100 msec. The result of the experiment of FIG. 31 shows that the air-fuel ratio of the cylinder #1 is not affected by the delay time for each two periods of the duty cycle, but the fluctuations of the air-fuel ratio of the cylinder #4 can be minimized when the delay time is set to 0 or 64 msec for every two periods of the duty cycle.

Now, other driving conditions detection means A according to the tenth to 14th embodiments of the invention will be explained.

Figure 32:
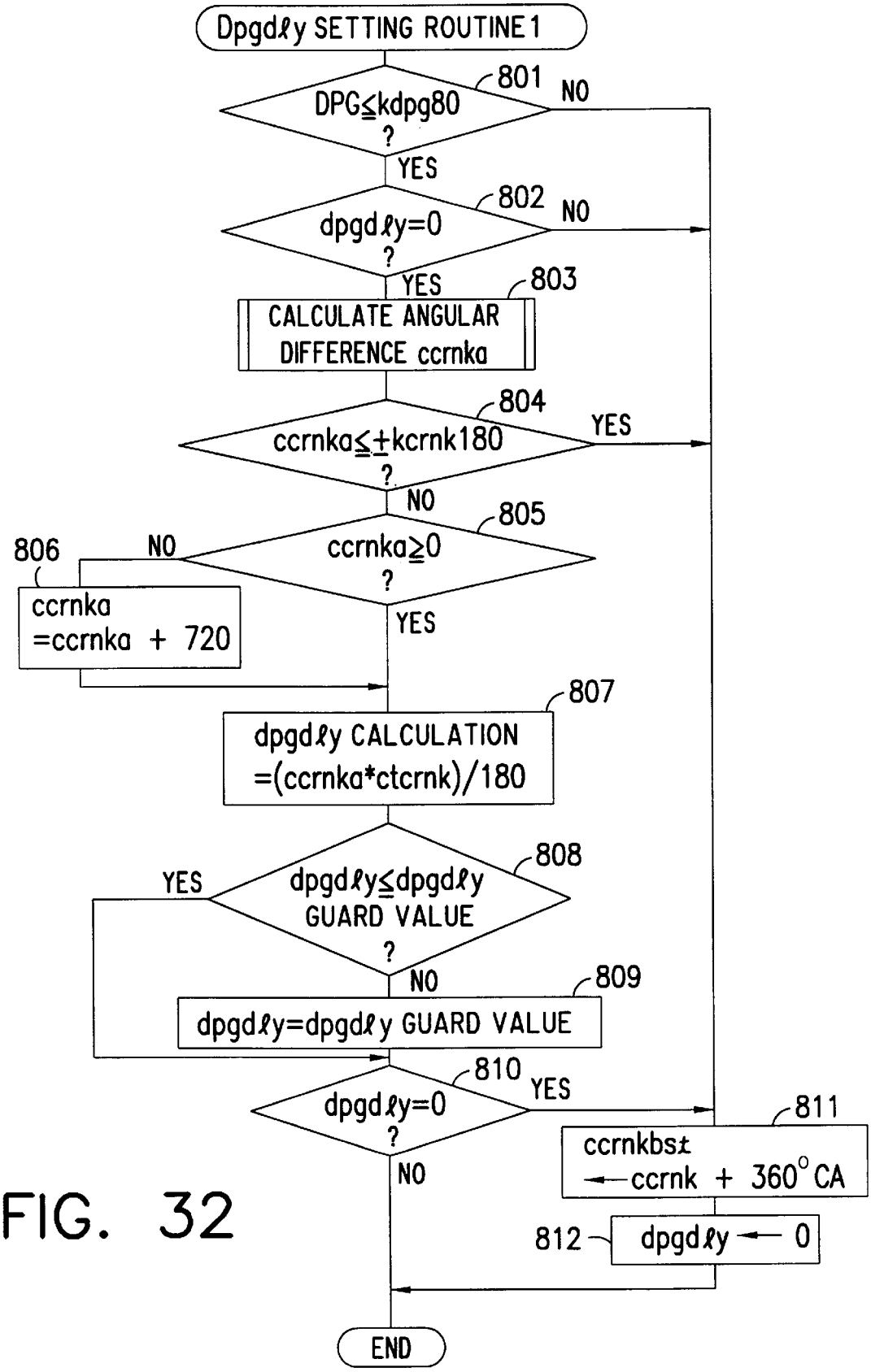
FIG. 32 is a flowchart showing a detailed delay time setting routine of a driving condition detecting process according to a tenth embodiment of the present invention.

FIG. 32 is a flowchart of a delay time setting routine 1 for the driving condition detection process according to the tenth embodiment of the invention. In the tenth embodiment, the crank angle is used instead of the engine speed in the first embodiment as the operating condition detection means for calculating the delay time. The crank angle for setting the delay time can thus be calculated more accurately than when using the engine speed. The processing routine of the flowcharts shown in FIG. 32 and subsequent drawings is initiated by a timer interruption generated at predetermined time intervals (say, 1 ms).

First, step 801 judges whether or not the duty factor DPG is not more than kdpg80 (duty factor of 80%). In the case where the judgement is YES, it is judged that the intermittent purge flow is large, and the process proceeds to step 802. In the case where the judgement is NO, on the other hand, a small intermittent purge flow, i.e., a substantially continuous flow is decided, so that the process proceeds to steps 811, 812 for interrupting the delay control. Step 802 judges whether delay time (on-delay time) dpgdly is zero or not. If dpgdly is not zero, the process is passed to step 803, while if dpgdly is zero, the process proceeds to step 811. Step 803 calculates the angular difference ccrnka between the optimum crank angle ccrnkbst and the present crank angle ccrnk.

$$ccrnka = ccrnkbst - ccrnk$$

The optimum crank angle ccrnkbst is defined as a crank angle 360° CA shifted from the crank angle at the valve opening start time in the previous duty cycle of the D-VSV. Specifically, in order to prevent the engine combustion cycle from being synchronized with the duty cycle of the D-VSV and prevent the purge gas from being drawn continuously into a specific cylinder, the purge gas is drawn during the next duty cycle of the D-VSV into the cylinder in opposite phase to the cylinder that has drawn the purge gas during the present duty cycle. For this purpose, the crank angle at the present time of valve opening start of the D-VSV is shifted by 360° CA with respect to the crank angle at the previous time of valve opening start thereby to optimize the distribution among the cylinders. Also, the optimum crank angle is not limited to the crank angle 360° CA shifted from the crank angle at the time of valve opening start during the previous duty cycle of the D-VSV, but the shift angle can be appropriately selected from among 120° CA, 180° CA, etc.

Step 804 judges whether the angular difference ccrnka calculated in step 803 is included in a specific range kcrnk180 (say, 180° CA). If the judgement is YES (ccrnka≧±kcrnk180) involving a substantially optimum crank angle, the process proceeds to step 811. When the judgement is NO involving a considerable displacement from the optimum crank angle, on the other hand, the process proceeds to step 805. Step 805 judges whether the angular difference ccrnka≧0. In the case where the optimum crank angle at which ccrnka≧0 is not yet reached (ccrnk<ccrnkbst), the process proceeds to step 807. In the case where ccrnka is smaller than zero when the optimum crank angle has already been passed (ccrnk>ccrnkbst), the process proceeds to step 806. Step 806 calculates the crank angular difference ccrnka providing a target in the next duty cycle of the D-VSV from the equation described below, and the process proceeds to step 807. Specifically, when ccrnk <ccrnkbst, the delay time is set in such a manner that the valve opening start time during the present duty cycle of the D-VSV is at or before the optimum crank angle ccrnkbst. When ccrnk>ccrnkbst, on the other hand, it indicates that the valve opening start time during the present duty cycle of the D-VSV already exceeds the optimum crank angle ccrnkbst. Therefore, the delay time for valve opening during the next duty cycle is set.

$$ccrnka = ccrnka + 720$$

Then, step 807 calculates the delay time dpgdly based on the following equation.

$$dpgdly = (ccrnka * ctcrnk)/180$$

where ctcrnk is shown in units of ms at time intervals of 180° CA.

Next, step 808 judges whether or not the delay time dpgdly calculated in step 807 is included in the delay time guard value or not. In the case where the judgement is YES, the process proceeds to step 810, while if the judgement is NO, the process is passed to step 809. This delay time guard value is calculated from T−(t_dpg)−kdpgv, where T is the duty cycle, t_dpg is the valve opening time during the present processing period, and kdpgv is a predetermined valve opening time required for completely closing the valve D-VSV. Step 809 updates the delay time dpgdly to the guard value, and the process proceeds to step 810. Step 810 judges whether the delay time dpgdly is zero or not. If the judgement is YES, the process proceeds to step 811, while when the judgement is NO, the routine is completed. Step 811 calculates the next optimum crank angle ccrnkbst with respect to the present crank angle ccrank in order to suspend the delay control operation.

$$ccrnkbst=ccrnk+360\ (^\circ\ CA)$$

Figure 33:
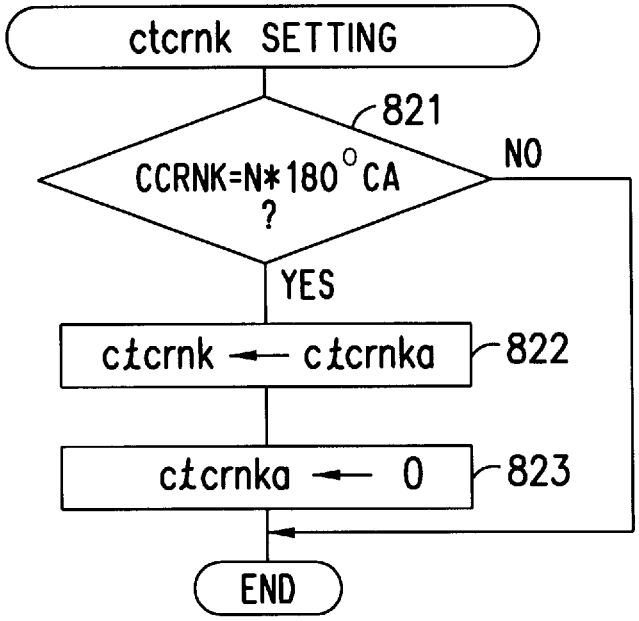
FIG. 33 is a drawing showing a process of step 003 of a flowchart shown in FIG. 32.

Then, step 812 clears the delay time dpgdly to zero. FIG. 33 is a diagram showing the process of step 803 in the flowchart of FIG. 32. First, step 821 judges whether the present crank angle ccrnk is a reference crank angle or an integer multiple of 180° CA for the four-cylinder engine, or an integer multiple of 120° CA for the six-cylinder engine, that is to say, whether ccrnk=N*180° CA (N=0, 1, 2, and so on). If the judgement is YES, the process proceeds to step 822 for setting ctcrnk to ctrnaka, while if the judgement is NO, step 823 clears the ctcrinka to zero. This ctcrnka is incremented for each 1 ms in response to a timer interruption, and after updating ctcrnk in step 822 for each 180° CA, cleared in step 823.

Figure 34:
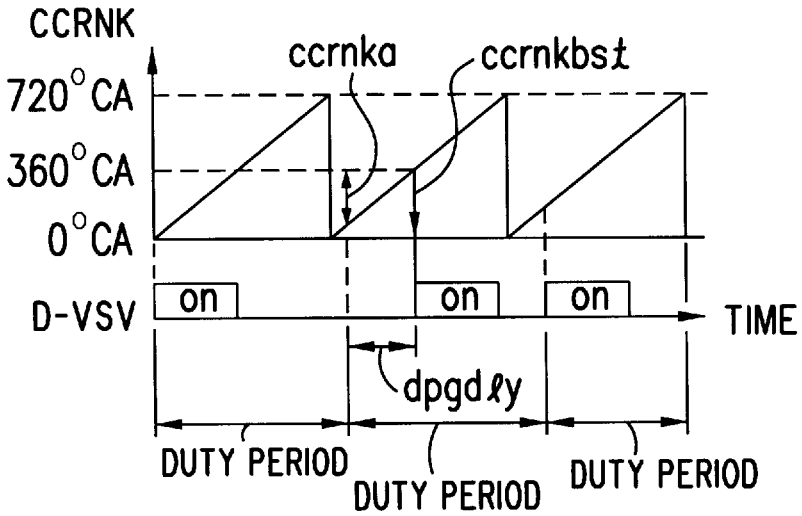
FIG. 34 is a supplemental drawing for explaining the tenth embodiment of the present invention.

FIG. 34 is a diagram for explaining the tenth embodiment as a complement. In FIG. 34, the abscissa represents the time, and the ordinate represents the crank angle (° CA) and the on-off state of the D-VSV. As shown in FIG. 34, the valve begins to open at the start of the first and third duty cycle (zero point in period). During the second duty cycle, on the other hand, the valve begins to be opened after the lapse of the delay time dpgly from the start of the second duty cycle, or preferably at the crank angle of ccrnkbst.

Figure 35:
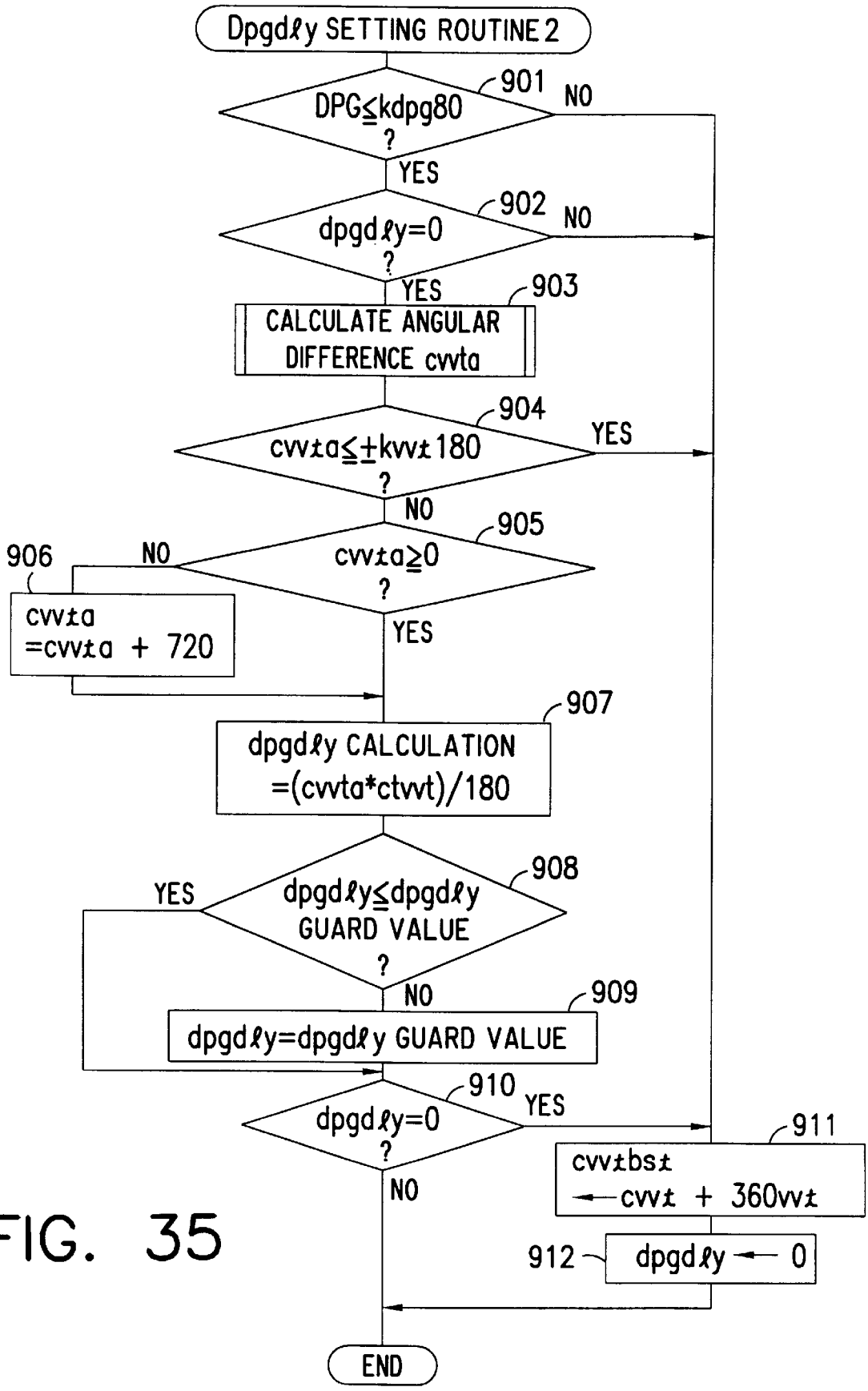
FIG. 35 is a flowchart showing a detailed delay time setting routine of a driving condition detecting process according to an eleventh embodiment of the present invention.

FIG. 35 is a flowchart showing the delay time setting routine 2 for the process of the driving conditions detection according to an 11th embodiment of the invention. Comparison between FIGS. 32 and 35 shows that the delay time setting routine shown in FIG. 35 is different only in that the crank angle crnk for the delay time setting routine is replaced by the valve timing angle vvt for detecting the valve opening time of the intake valve. This difference is realized by detecting the rotational position of the engine, i.e., the valve timing angle vtt by the cam sensor mounted on the cam shaft of the intake valve instead of detecting the crank angle from the crank angle sensor. As a result, the opening time of the intake valve can be detected more accurately than using the crank angle sensor. In other words, the crankshaft and the cam shaft are operatively interlocked with each other through a timing chain or the like, and the chain can lengthen. The rotational position of the engine (valve timing angle vvt) can thus be detected more accurately based on the valve opening start time of the intake valve by the cam sensor than by the crank angle sensor.

Figure 36:
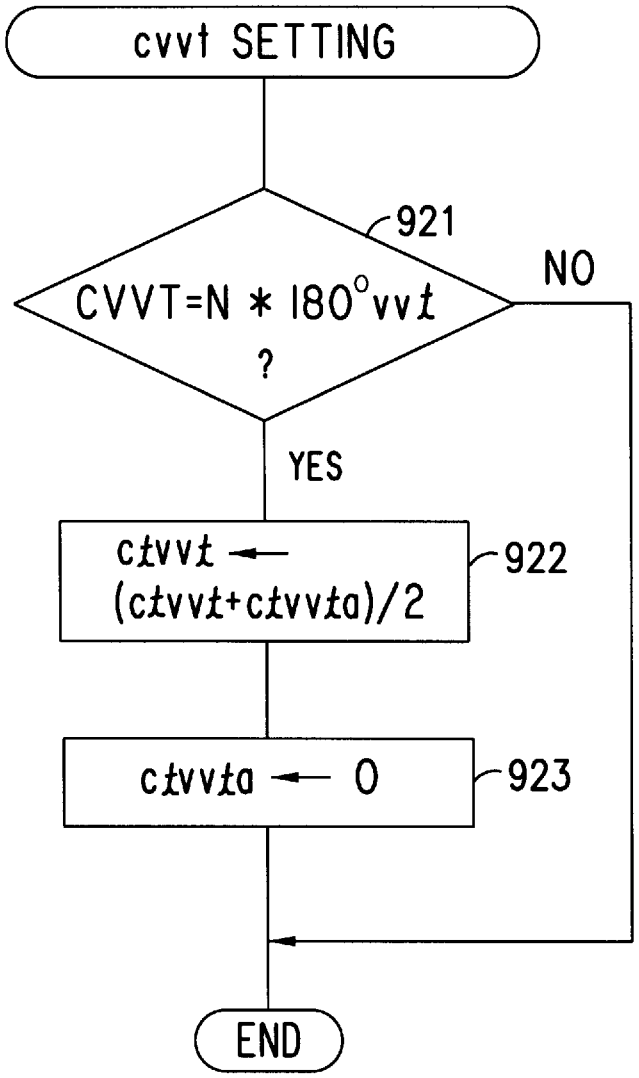
FIG. 36 is a drawing showing a process of step 903 of a flowchart shown in rig. 35.

FIG. 36 is a diagram showing the process of step 903 in the flowchart of FIG. 35. First, step 921 judges whether the present valve timing angle cvvt is a reference angle or an integer multiple of 180° vvt for the four-cylinder engine and 120 vvt for the six-cylinder engine with respect to the reference angle, that is, whether cvvt=N*180° vvt (N=0, 1, 2 and so on). In the case where the judgement is YES, the process proceeds to step 922 for setting ctvvt to (ctvvt+ctvvta)/2, while-if the judgement is NO, step 923 clears ctvvta to zero. This ctvvta is incremented for each one ms by a timer interruption, so that step 922 updates ctvvt for each 180 vvt, after which it is cleared in step 923.

Figure 37:
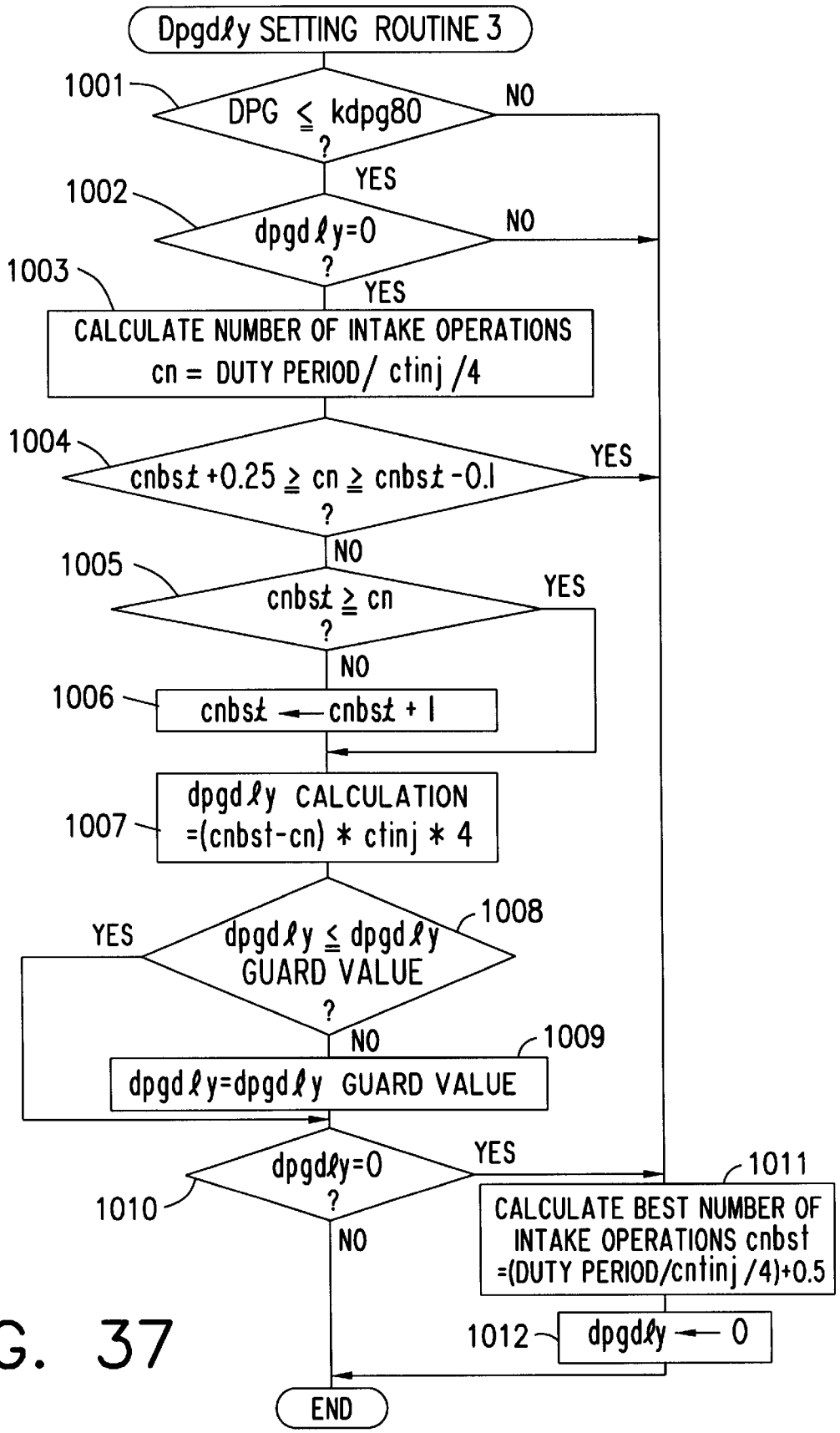
FIG. 37 is a flowchart showing a detailed delay time setting routine of a driving condition detecting process according to a twelfth embodiment of the present invention.

FIG. 37 is a flowchart showing a delay time setting routine 3 for the driving condition detection process according to a 12th embodiment of the invention. In the 12th embodiment, the fuel injection interval time is used in place of the engine speed in the first embodiment, the crank angle in the tenth embodiment or the intake valve timing in the 11th embodiment as the driving condition detection means for calculating the delay time. Specifically, the best number of intake operations, i.e., the optimum number of fuel injections to each cylinder within the duty cycle, is determined, and the delay time dpgdly is calculated on the basis of the difference between the best number of intake operations and the present number of intake strokes at the duty cycle starting time and the time intervals of fuel injection.

The best number of intake operations is the number of intake operations at which the purge gas purged by the valve opening during the next driving period to the next intake cylinder in opposite phase to the present intake cylinder (a phase 360° CA shifted in terms of crank angle) absorbing the purge gas purged by the valve opening in the present drive period. This best number of intake operations can be determined by adding 0.5 (360° CA in terms of crank angle) to the number of intake operations during the present drive period as described later. The delay time setting routine based on this fuel injection time interval will be described below with reference to the flowchart of FIG. 37. This routine is executed for each drive period of the D-VSV. Also, the above-mentioned opposite phase is not limited to the crank angle 360° CA shifted from the crank angle at the valve opening start time during the previous duty cycle of the D-VSV, but cap; be appropriately selected as 120° CA, 180° CA or the like.

First, step 1001 judges whether the duty factor DPG is not more than kdpg80 (duty factor of 80%). In the case where the judgement is YES, a large intermittent purge flow is decided and the process proceeds to step 1002. It the judgement is NO, on the other hand, a small intermittent purge flow is decided, so that the process proceeds to steps 1011, 1012 for interrupting the delay control. Step 1002 judges whether the delay time (on-delay time) dpgdly is zero or not. If dpgdly is not zero, the process proceeds to step 1003, while if dpgdly is zero, the process proceeds to step 1011. Step 1003 calculates the number of intake operations on, i.e., the number of fuel injections into a single cylinder during the duty cycle, from the following equation.

$$cn=\text{duty cycle}/ctinj/4$$

where ctinj is a fuel injection interval time equivalent to the crank angle of 180° CA for the four-cylinder engine.

Step 1004 judges from the following equation whether the number cn of intake operations is proximate to the best number cnbst of the intake operations (optimum injections) for turning on the D-VSV.

$$cnbst+0.25 \geqq cn \geqq cnbst-0.1$$

where the one-fourth intake number 0.25 is a reference value for judging whether there is a shift by a amount equivalent to one cylinder when cn<cnbst, and the one-tenth intake number 0.1 is a reference value smaller than 0.25 as the delay time can be set without any one-cylinder shift when cn<cnbst.

Step 1004 judges whether the number of intake operations cn is near to cnbst, and if the judgement is YES, the process proceeds to step 1011. If the judgment is NO, on the other hand, the process proceeds to step 1005. Step 1005 compares the number of intake operations cn and the best number of intake operations cnbst. When cnbst≧cn, the process proceeds to step 1007, while if cnbst<cn, the process proceeds to step 1006. Step 1006 calculates the following equation.

$$cnbst=cnbst+1$$

Then, step 1007 calculates the delay time dpgdly on the basis of the following equation.

$$dpgdly=(cnbst-cn)*ctinj*4$$

where ctinj*4 is equivalent to the time required for the engine to rotate by 720° CA in terms of the crank angle.

Step 1008 judges whether the delay time dpgdly calculated in step 1007 is included in the delay time guard value. If the judgement is YES, the process proceeds to step 1010, while if the judgement is NO, the process proceeds to step 1009. This delay time guard value is calculated from T−(t_dpg)−kdpgv, where T is the duty cycle, t_dpg is the valve opening time for the present processing period and kdpgv is a predetermined valve opening time required for positively completing the valve opening of the D-VSV. Step 1009 updates the delay time dpgdly to the guard value and the process proceeds to step 1010. Step 1010 judges whether the delay time dpgdly is zero or not. It the judgement is YES, the process proceeds to step 1011, while if the judgement is NO, this routine is terminated. Step 1011 calculates the best number of intake operations chbst from the equation below for interrupting the delay control, followed by step 1012 for clearing the delay time dpgdly to zero.

$$cnbst=(\text{duty cycle}/ctinj/4)+0.5$$

where 0.5 is equivalent to 360° CA in terms of the engine crank angle.

Figure 38:
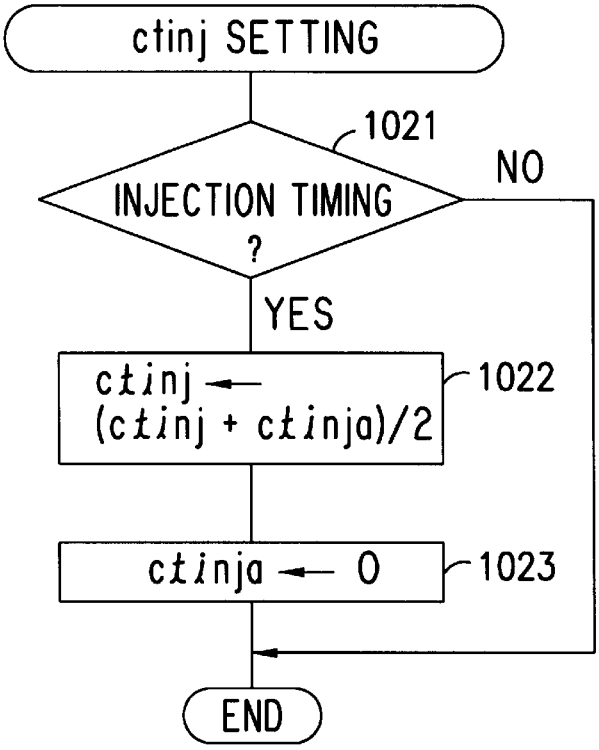
FIG. 38 is a flowchart showing a process for calculating fuel injection interval time in a flowchart shown in FIG. 37.

FIG. 38 is a flowchart showing the calculation process of the fuel injection time intervals in the flowchart of FIG. 37. First, step 1021 judges whether the present fuel injection time interval ctinj is the injection time of a particular cylinder. If the judgement is YES, the process proceeds to step 1022 where ctinj is subjected to calculation (ctinj+ctinja)/2, while if the judgement is NO, ctinja is cleared to zero in step 923. In this case, ctinja is incremented for each 1 ms by a timer interruption, and cleared to zero in step 1023 after ctinj is updated in step 1022 for each injection time.

Figure 39:
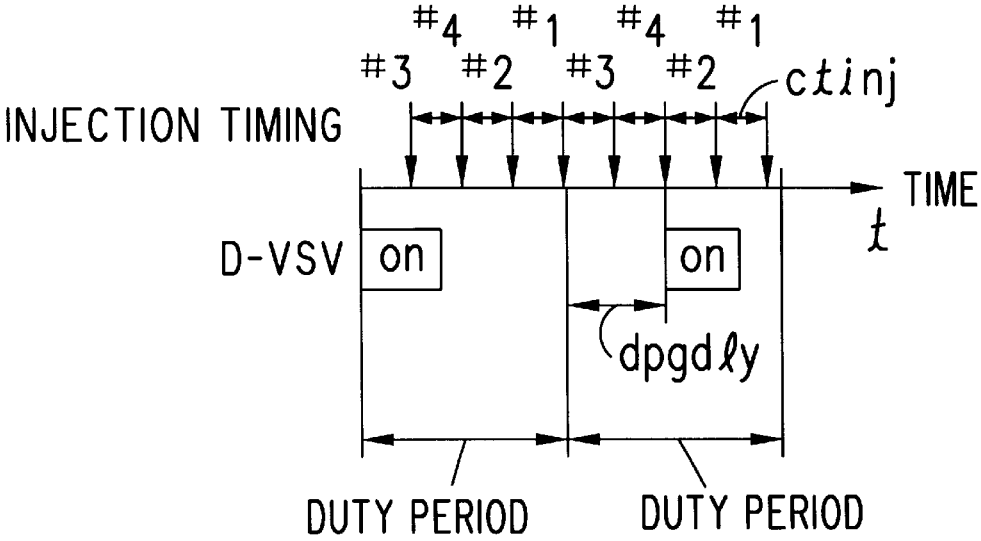
FIG. 39 is an explanatory drawing showing the relationship between a fuel injection timing and on delay time.

FIG. 39 is a diagram for explaining the relation between the fuel injection timing and the on-delay time. In FIG. 39, the abscissa represents the time, and the ordinate represents the injection timing and the D-VSV on-off state. As shown in FIG. 39, the valve begins to open at the start (the point where the period is zero) of a first duty cycle of the D-VSV, whereas it begins to open after the lapse of the delay time dpgdly from the start of a second duty cycle.

Figure 40:
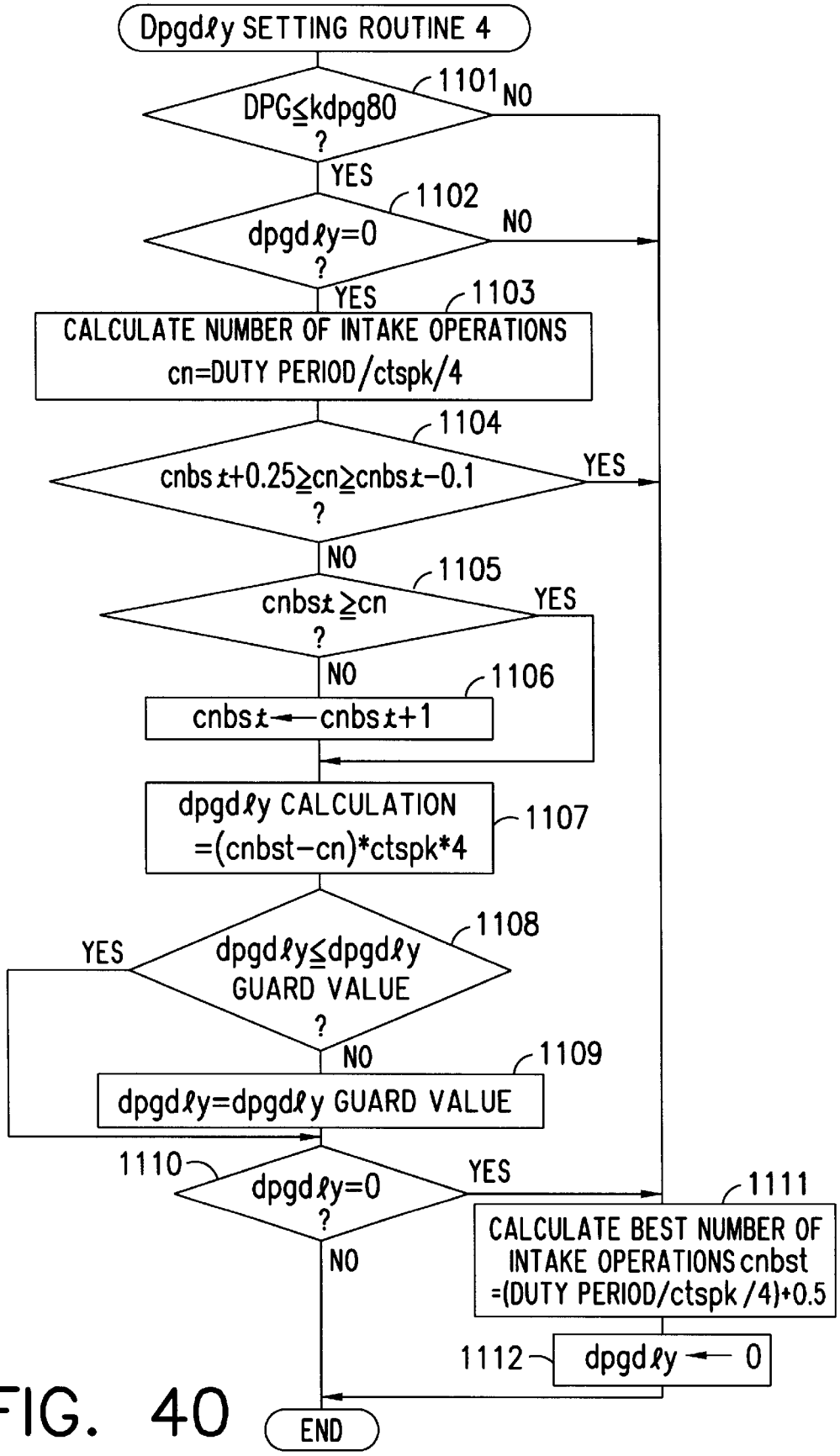
FIG. 40 is a flowchart showing a detailed delay time setting routine of a driving condition detecting process according to an thirteenth embodiment of the present invention.
Figure 41:
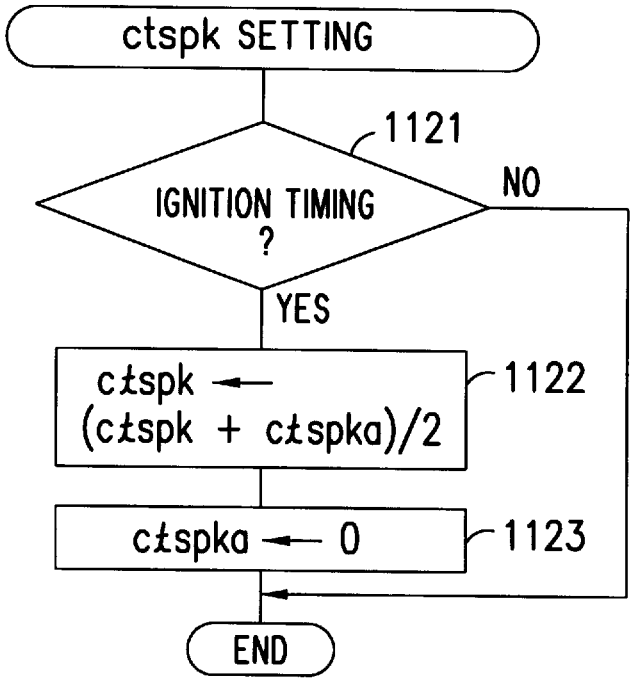
FIG. 41 is a drawing showing an example of measuring ignition interval.

FIG. 40 is a flowchart of the delay time setting routine 4 based on the driving condition detection process according to a 13th embodiment of the invention. FIG. 41 is a diagram showing an example of a measurement of the ignition timing intervals. The routine shown in FIG. 40 is executed for each drive period of the D-VSV. Comparison of FIG. 40 with FIG. 37 and comparison of FIG. 41 with FIG. 38 shows that the delay time setting routines shown in FIGS. 40 and 41 perform similar control operations except that the fuel Injection time interval ctinj is replaced by the ignition timing interval ctspk. Specifically, the best number of intake operations, i.e., the optimum number of ignitions for each cylinder in the duty cycle is determined from the number of ignitions, and the delay time dpgdly is calculated on the basis of the displacement between the best number of intake operations and the present number of intake operations at the starting time of the duty cycle of the D-VSV and the ignition timing intervals. This control operation can set a short delay time when the ignition timing is advanced as a result of ignition timing detection. Specifically, when the engine load condition changes from high to low, the negative pressure in the intake pipe increases, the throttle valve closes, and the air intake rate and the purge gas flow rate are reduced, so that a longer time is required for the purge gas to reach the cylinder. A short delay time is set taking this fact into consideration. The other parts of the control operation are similar to the corresponding parts of the 12th embodiment, and will not be described any further.

Figure 42:
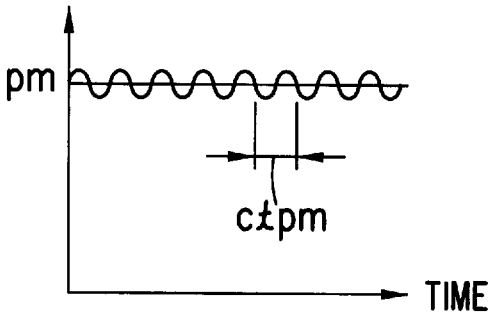
FIG. 42 is a drawing showing a fourteenth embodiment that detects intake air pressure as a driving condition detecting means of the present invention.

FIG. 42 is a diagram showing a 14th embodiment in which the pressure in the intake pipe is detected as a means of detecting the driving conditions according to this invention. According to the 14th embodiment, the engine speed as in the first embodiment, the crank angle as in the tenth embodiment, the intake valve timing as in the 11th embodiment, the fuel injection time interval as in the 12th embodiment, or the ignition timing interval as in the 13th embodiment, is not used as a means of detecting the operating conditions to calculate the delay time. Instead, according to the 14th embodiment, the time required for one amplitude, i.e., the amplitude time ctpm is measured from the pulsation of the pressure in the intake pipe, or otherwise the open/close period of the intake valve is detected from the pressure of the intake valve. Thus the fuel injection timing interval according to the 12th embodiment or the ignition timing interval according to the 13th embodiment is replaced by the amplitude time ctpm.

In the process (delay control interrupt means) of step 801 in the flowchart of FIG. 32, step 901 in the flowchart of FIG. 35, step 1001 in the flowchart of FIG. 37 and step 1101 in the flowchart of FIG. 40 described above, the delay time is not provided in the case where the purge gas has a duty factor of at least 80% and is substantially considered a continuous flow having 4 very small proportion of intermittent flows. As a result, the burden of the processing in the CPU is reduced.

In the case where the amount of adsorption of the evaporated fuel by the activated carbon in the canister is small (when the purge execution time has passed a predetermined time, for example), or in the case where the internal condition of the fuel tank is such that vapor is hardly generated (at a low temperature, for example), the ratio of the purge gas amount to the fuel injection amount is so small that the fluctuation of the air-fuel ratio of the internal combustion engine is not caused even when the purge gas distribution among the cylinders is not uniform, and therefore no delay time is provided. As a result, the burden of the processing by the CPU is reduced.

Now, an explanation will be given of delay time correction means D according to a 15th embodiment of the invention. The 15th embodiment is intended to correct the delay time dpgdly taking the purge gas transfer rate in the intake pipe into consideration. For example, the change in the engine load is detected from the change in the internal pressure of the intake pipe. The negative pressure in the intake pipe is increased at the time of deceleration resulting in an increased negative pressure in the intake pipe. In accordance with this pressure change, the delay time dpgdly is corrected downward.

Figure 43:
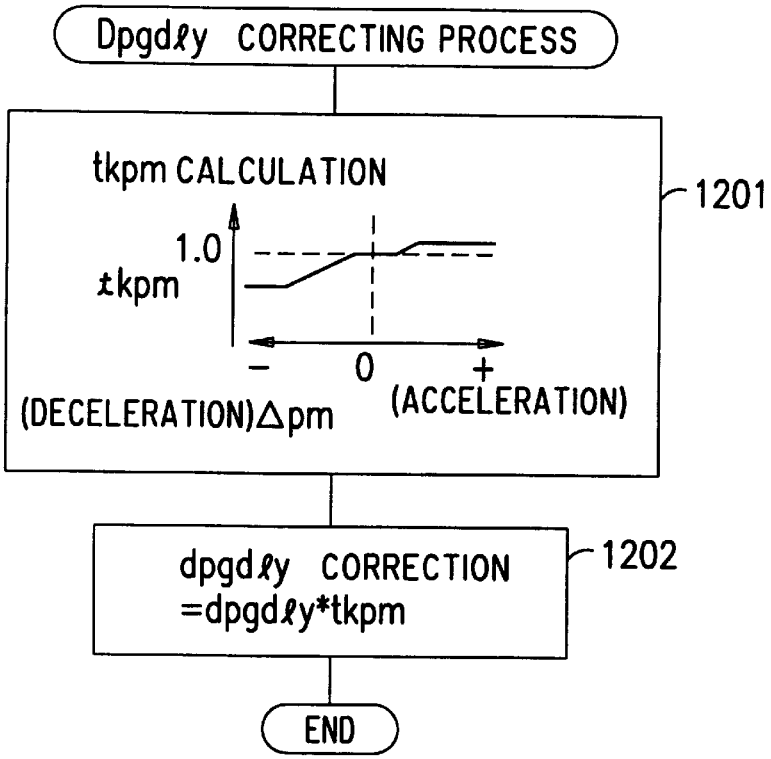
FIG. 43 is a flowchart showing a delay time correcting process according to a fifteenth embodiment of the present invention.

FIG. 43 is a flowchart showing the delay time correction process according to the 15th embodiment of the invention. First, step 1201 calculates a delay time correction coefficient tkpm against a change Δpm in the internal pressure of the intake pipe from the map stored in a ROM 62. This delay time correction coefficient, which is determined experimentally, is set smaller than unity for higher deceleration rate and set larger than unity for a higher acceleration rate. The delay time is therefore set shorter, the higher the deceleration rate. Step 1202 updates the delay time dpgdly by multiplying the delay time dpgdly by the delay time correction coefficient tkpm.

Figure 44:
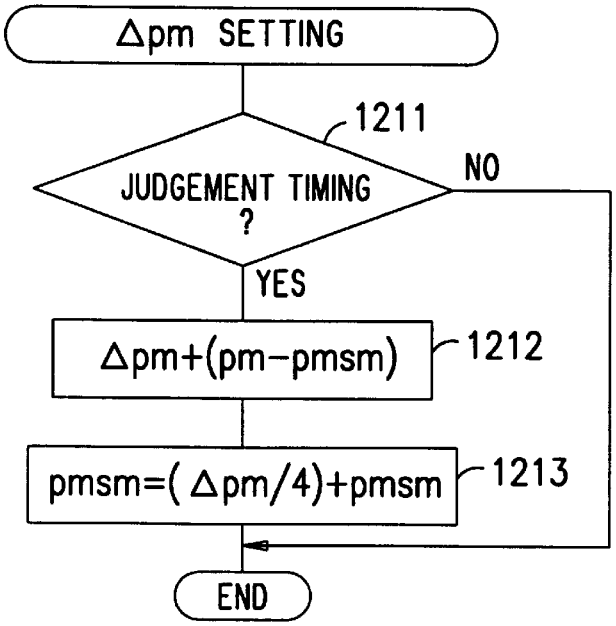
FIG. 44 is a drawing showing an example of measuring result of intake air pressure change.

FIG. 44 is a diagram showing an example measurement of the change Δpm of the internal pressure of the intake pipe. First, step 1211 judges whether the tinting has come to judge the change Δpm of the internal pressure of the intake pipe. In the case where the judgement is YES, the process proceeds to step 1212, while if the judgement is NO, this routine is terminated. Step 1212 subtracts the average value (general value) pmsm of the internal pressure of the intake pipe from the internal pressure pm of the intake pipe for the present processing period (pm−pmsm), and the difference is assumed to be Δpm. Step 1213 calculates the average value pmsm of the pressure in the intake pipe from the following equation.

$$pmsm=(\Delta pm/4)+pmsm$$

The change Δpm of the internal pressure of the intake pipe calculated in step 1212 indicates the degree to which the internal pressure pm of the intake pipe for the present processing period deviates from the average value pmsm of the internal pressure of the intake pressure.

Instead of correcting the delay time dpgdly by the load change (pressure change) described above, the delay time dpgdly can be corrected based on the parameters affecting the transfer rate of the purge gas in the intake pipe such as the change in throttle valve opening degree, the change in the flow rate in the intake pipe or the intake air amount per rotation.

As described above, according to the present invention, there is provided an evaporative fuel control system for a multicylinder internal combustion engine, wherein the valve opening timing of the purge control valve is delayed in accordance with the delay time set by the delay time setting means in such a manner that the purge gas may not flow continuously into a specific cylinder fur each drive period under the engine driving conditions detected by the driving condition detection means such au in an engine speed region where the engine speed is substantially synchronized with the purge control valve drive period. Thus an abrupt change in the amount of the purge gas generated can be suppressed for an improved purity of the exhaust gas.

Also, according to the present invention, there is provided an evaporative fuel control system for a multicylinder internal combustion engine, in which the delay time is set properly in accordance with the duty factor, and therefore when the duty factor is small (i.e., when the amount of the purged vapor is small), the delay time is not necessarily set, while when the duty factor is large (i.e., when there is less intermittent flow), the purge control valve can be opened positively during the drive period.

Further, according to the present invention, there is provided an evaporative fuel control system for a multicylinder internal combustion engine, in which the delay time is set in accordance with the end of the valve opening time during the drive period of the purge control valve 41, and therefore thee purge control valve can be positively opened or cloud within the drive period, while at the same time supplying a proper amount of the purge gas into the intake air passage.

Furthermore, according to the present invention, there is provided an evaporative fuel control system for a multicylinder internal combustion engine, in which the change in the internal pressure of the intake pipe is detected, for example, by the traveling speed detection means for detecting the purge gas and the transient state of the engine is detected from the detected pressure change, so that the delay time is set longer at the time of acceleration when the purge gas flow rate in the intake pipe is high, and the delay time is set shorter at the time of deceleration when the purge gas flow rate is low. The traveling time of the purge gas in the intake pipe thus can be optimally controlled during the transient period of the engine, thereby assuring a uniform distribution of the purge gas distribution among the cylinders.

In addition, according to the present invention, there is provided an evaporative fuel control system for a multicylinder internal combustion engine, in which a plurality of drive periods for driving the purge control valve are switched in a predetermined order by the period changing means to set the delay time in accordance with each drive period, and therefore the purge gas distribution among the cylinders is equalized and the fluctuations in the air-fuel ratio of the engine is suppressed, thereby improving the purity of the exhaust gas.

What is more, according to the present invention, there is provided an evaporative fuel control system for a multicylinder internal combustion engine, in which the delay time is set on the basis of the middle point between the start and end of the valve opening period of the purge control valve, and therefore the distribution of the purge gas among the cylinders during the transient period is promoted, with the result that the fluctuations in the air-fuel ratio of the engine is suppressed for an improved purity of the exhaust gas.

Further, according to the present invention, there is provided an evaporative fuel control system for a multicylinder internal combustion engine, in which a cylinder in an intake stroke during the valve opening time for the present drive period of the purge control valve is detected by the cylinder detection means, and the delay time is set in such a manner that the detected cylinder is not in an intake stroke for the next drive period, so that the purge gas distribution among the cylinders is equalized and the fluctuations of the air-fuel ratio of the engine are suppressed, thereby improving the purity of the exhaust gas.

Also, according to the present invention, there is provided an evaporative fuel control system for a multicylinder internal combustion engine, in which the engine load for the next drive period is estimated from the change in engine load during the present drive period by the load estimating means, and the delay time is set on the basis of the estimated load, so that the purge gas distribution among the cylinders at the time of acceleration and deceleration is equalized and the fluctuations of the engine air-fuel ratio are suppressed for an improved purity of the exhaust gas.

Furthermore, according to the present invention, there is provided an evaporative fuel control system for a multicylinder internal combustion engine, in which the engine speed for the next drive period is estimated from the change in engine speed for the present drive period, and the delay time is set based on the estimated engine speed, so that the purge gas distribution among the cylinders especially at the time of acceleration and deceleration is equalized and the fluctuation of the engine air-fuel ratio is suppressed for an improved purity of the exhaust gas.

Further, according to the present invention, there is provided an evaporative fuel control system for a multicylinder internal combustion engine, in which under the conditions where the engine air-fuel ratio undergoes no change due to the purge gas supplied to the internal combustion engine, such as when there is only a small amount of intermittent purge gas which substantially constitutes a continuous flow with a duty factor of 80% or more, the purge gas distribution among the cylinders is satisfactory and therefore the cpu load can be reduced by interrupting the setting of the delay time by the delay control interruption means.

I claim:

1. An evaporative control system for a multicylinder internal combustion engine comprising a purge passage for purging fuel vapor evaporated from a fuel tank to an intake passage of the engine, and a purge control valve disposed in the purge passage, to control the quantity of gas to be purged into the intake passage by opening and closing the valve at a given frequency, characterized in that it comprises:

a drive condition detecting means for detecting driving conditions of the engine;

a delay time setting means for setting a delay time to delay the valve opening start timing in the driving period from the start of the driving period in response to the engine driving conditions detected by the drive condition detecting means; and a purge control valve driving means for driving the purge control valve with the delay time set by the delay time setting means.

2. An evaporative control system for a multicylinder internal combustion engine as recited in claim 1, wherein said drive condition detecting means comprises an equal distribution judging means that detects on-off periods of the intake valve of the engine and judges whether or not the purged gas is equally distributed into cylinders of the engine on the basis of the detected on-off period of the intake valve and the driving period of the purge control valve, and said delay time setting means sets a delay time so as to equally distribute the purged gas into cylinders when the equal distribution judging means judged that the purged gas is unequally distributed into cylinder.

3. An evaporative control system for a multicylinder internal combustion engine as recited in claim 1, wherein said drive condition detecting means comprises a revolution speed detecting means for detecting the revolution speed of the engine, and said delay time setting means sets a delay time in response to the revolution speed detected by the revolution speed detecting means.

4. An evaporative control system for a multicylinder internal combustion engine as recited in claim 1, wherein said system further comprises a delay time correcting means for correcting a delay time set by the delay time setting means, and said delay time correcting means corrects the delay time in response to a duty factor that determines a valve opening interval in the driving period of the purge control valve.

5. An evaporative control system for a multicylinder internal combustion engine as recited in claim 1, wherein said system further comprises a delay time correcting means for correcting a delay time set by the delay time setting means, and said delay time correcting means corrects the delay time in response to a valve opening end timing in the driving period of the purge control valve.

6. An evaporative control system for a multicylinder internal combustion engine as recited in claim 1, wherein said delay time setting means comprises a traveling speed detecting means for detecting a traveling speed of the purged gas in the intake passage of the engine, and sets the delay time in response to the detected traveling speed.

7. An evaporative control system for a multicylinder internal combustion engine as recited in claim 1, wherein said system further comprises a delay time correcting means for correcting a delay time set by the delay time setting means, and said delay time correcting means comprises a period changing means being provided with a plurality of driving periods of the purge control valve and changes driving periods in a given order by sequentially selecting from the plurality of driving periods, and corrects the delay time in response to the driving period changed by the period changing means.

8. An evaporative control system for a multicylinder internal combustion engine as recited in claim 1, wherein said system further comprises a delay time correcting means for correcting a delay time set by the delay time setting meals, and said delay time correcting means corrects the delay time on the basis of the central timing between the start and the end timings of the valve opening interval in the driving period of the purge control valve.

9. An evaporative control system for a multicylinder internal combustion engine as recited in claim 1, wherein said drive condition detecting means comprises a cylinder detecting means for detecting a cylinder under the intake stroke when the purge control valve is opened in the current driving period, and said delay time setting means sets the delay time in such a way that a cylinder to be under the intake stroke when the purge control valve is opened in the next driving period will be different from the cylinder detected by the cylinder detecting means.

10. An evaporative control system for a multicylinder internal combustion engine as recited in claim 1, wherein said system further comprises a delay time correcting means for correcting a delay time set by the delay time setting means, and said delay time correcting means comprises a load estimating means for estimating a load of the engine in the next driving period during the current driving period of tie purge control valve, and corrects the delay time on the basis of the load in the next driving period estimated by the load estimating means.

11. An evaporative control system for a multicylinder internal combustion engine as recited in claim 1, wherein said system further comprises a delay time correcting means for correcting a delay time set by the delay time setting means, and said delay time correcting means comprises an engine revolution speed estimating means for estimating a revolution speed of the engine in the next driving period during the current driving period of the purge control valve, and corrects the delay time on the basis of the revolution speed in the next driving period estimated by the engine revolution speed estimating means.

12. An evaporative control system for a multicylinder internal combustion engine as recited in claim 1, wherein said drive condition detecting means comprises a crank angle detecting means for detecting a crank angle at each valve opening start timing in each driving period of the purge control valve, and said delay time setting means sets the delay time in such a way that a valve opening start timing in the next driving period will be at a second crank angle which is different from a first crank angle in the current driving period detected by the crank angle detecting means.

13. An evaporative control system for a multicylinder internal combustion engine as recited in claim 1, wherein said drive condition detecting means comprises a valve timing angle detecting means for detecting a valve timing angle of the intake valve at each valve opening start timing in each driving period of the purge control valve, and said delay time setting means sets the delay time in such a way that a valve opening start timing in the next driving period will be at a second valve timing angle which is different from a first valve timing angle detected by the valve timing angle detecting means.

14. An evaporative control system for a multicylinder internal combustion engine as recited in claim 1, wherein said drive condition detecting means comprises an intake air frequency calculation means for calculating an intake air frequency of the engine in the current driving period from the fuel injection frequency in the current driving period of the purge control valve, and for calculating the difference between the calculated intake air frequency and a best intake air frequency, and said delay time setting means sets the delay time in such a way that the next cylinder in an intake stroke, that is to draw gas to be purged at the valve opening start timing in the next driving period will be different from a cylinder currently in an intake stroke, that has drawn the gas purged at the valve opening start timing in the current driving period on the basis of the calculated intake air frequency calculated by the intake air frequency calculation means and the best intake air frequency.

15. An evaporative control system for a multicylinder internal combustion engine as recited in claim 1, wherein said drive condition detecting means comprises an intake air frequency calculation means for calculating an intake air frequency of the engine in the current driving period from the ignition frequency in the current driving period of the purge control valve, and for calculating the difference between the calculated intake air frequency and a best intake air frequency, and said delay time setting means sets the delay time in such that the next cylinder in an intake stroke, that is to draw gas to be purged at the valve opening start tinting in the next driving period will be different from a cylinder currently in an intake stroke, that has drawn the gas purged at the valve opening start timing in the current driving period on the basis of the calculated intake air frequency calculated by the intake air frequency calculation means and the best intake air frequency.

16. An evaporative control system for a multicylinder internal combustion engine as recited in claim 1, wherein said drive condition detecting means comprises an intake air frequency calculation means for calculating an intake air frequency of the engine in the current driving period from an air pressure pulse signal in the intake passage of the engine, and for calculating the difference between the calculated intake air frequency and a best intake air frequency, and said delay time setting means sets the delay time in such a way that the next cylinder in an intake stroke, that is to draw gas to be purged at the valve opening start timing in the next driving period will be different from a cylinder currently in an intake stroke, that has drawn the gas purged at the valve opening start timing in the current driving period on the basis of the calculated intake air frequency calculated by the intake air frequency calculation means and the best intake air frequency.

17. An evaporative control system for a multicylinder internal combustion engine as recited in claim 1, wherein said system further comprises a delay control interruption means for interrupting the delay time setting to be performed by the delay time setting means under the conditions that a fluctuation in an air-fuel ratio in the engine does not occur even though the purged gas is supplied into the engine.

* * * * *

UNITED STATES PATENT AND TRADEMARK OFFICE

CERTIFICATE OF CORRECTION

PATENT NO. : 5,862,795
DATED : January 26, 1999
INVENTOR(S) : Akinori Osanai

It is certified that error appears in the above-identified patent and that said Letters Patent is hereby corrected as shown below:

Column 1,
Line 67, after "example" insert a comma.

Column 3,
Line 1, delete "means" after "time".
Line 56, change "A" to "D".

Column 4,
Line 14, change "means 5" to -- means 5" to -- means B --.

Column 7,
Line 19, change "inventions the" to -- invention, the --.
Line 44, change "inventions" to -- invention; --.

Column 8,
Line 14, change "003" to -- 803 --.
Line 24, change "rig. 35;" to -- Fig. 35; --.

Column 10,
Line 34, change "tinner" to -- timer --.
Line 59, change "NIL" to -- KIL --.

Column 11,
Line 3, change "Correction" to -- correction --.
Line 42, change "carried out," to -- carried out. --.
Line 58, change "FAFAV≥0.98" to -- FAFAV≤0.98 --.
Line 63, "The vapor" should start a new paragraph.

Column 12,
Line 17, change "tfC" to -- tFG --.

Column 13,
Line 35, change "tPFGR" to -- tPGR --.
Line 37, change "toga" to --to a --.

Column 14,
Line 62, change "D-VSV," to -- DVSV. --.
Line 66, change "754," to -- 754. --.

UNITED STATES PATENT AND TRADEMARK OFFICE

CERTIFICATE OF CORRECTION

PATENT NO. : 5,862,795
DATED : January 26, 1999
INVENTOR(S) : Akinori Osanai

It is certified that error appears in the above-identified patent and that said Letters Patent is hereby corrected as shown below:

Column 16,
Line 29, delete "190" and insert -- # -- before "1".

Column 19,
Line 31, change "hi" to -- of --.
Line 54, change "vase" to -- case --.

Column 20,
Line 1, change "thus-invention" to -- this invention --.
Line 9, change "Lo" to -- to --.
Line 23, change "36°" to -- 360° --.

Column 21,
Line 22, change "Lime" to -- time --.

Column 22,
Line 1, delete the period after "644".
Line 52, change "road" to -- Load --.

Column 23,
Line 33, delete the comma after "while".

Column 24,
Line 36, change "≥" to --≤ --.

Column 25,
Line 64, change "120" to -- 120° --.

Column 26,
Line 4, change "180" to -- 180° --.
Line 41, change "It the" at end of line to -- If the --.
Line 49, change "on" to -- cn --.

Column 27,
Line 67, change "Injection" to -- injection --.

Column 28,
Line 42, change "4" to -- a --.

UNITED STATES PATENT AND TRADEMARK OFFICE

CERTIFICATE OF CORRECTION

PATENT NO. : 5,862,795
DATED : January 26, 1999
INVENTOR(S) : Akinori Osanai

It is certified that error appears in the above-identified patent and that said Letters Patent is hereby corrected as shown below:

Column 29,
Line 15, change "tinting" to -- timing --.
Line 46, change "fur" to -- for --.
Line 48, change "au" to -- as --.
Line 66, change "thee" to -- the --.
Line 66, change "cloud" to -- closed --.

Column 31,
Line 7, change "cpu" to -- CPU --.
Line 40, change "cylinder." to -- cylinders. --.

Column 32,
Line 21, change "meals" to -- means --.
Line 46, change "tie" to -- the --.

Column 34,
Line 5, after "such" insert -- a way --.
Line 7, change "tinting" to -- timing --.

Signed and Sealed this

Twenty-first Day of August, 2001

*Attest:*

Nicholas P. Godici

NICHOLAS P. GODICI
*Acting Director of the United States Patent and Trademark Office*

*Attesting Officer*